US007240999B2

(12) United States Patent
Kumagai et al.

(10) Patent No.: US 7,240,999 B2
(45) Date of Patent: Jul. 10, 2007

(54) LIQUID EJECTION APPARATUS AND CONTROL METHOD OF THE LIQUID EJECTION APPARATUS

(75) Inventors: Toshio Kumagai, Nagano (JP); Atsushi Kobayashi, Nagano (JP); Hidetoshi Masuda, Fukuoka (JP)

(73) Assignee: Seiko Epson Corporation, Tokyo (JP)

( * ) Notice: Subject to any disclaimer, the term of this patent is extended or adjusted under 35 U.S.C. 154(b) by 217 days.

(21) Appl. No.: 10/841,466

(22) Filed: May 10, 2004

(65) Prior Publication Data

US 2005/0046681 A1 Mar. 3, 2005

(30) Foreign Application Priority Data

May 9, 2003 (JP) ..... P2003-132344
Oct. 17, 2003 (JP) ..... P2003-358088
Mar. 31, 2004 (JP) ..... P2004-105795

(51) Int. Cl.
*B41J 2/175* (2006.01)
*B41J 2/195* (2006.01)
*B41J 29/38* (2006.01)

(52) U.S. Cl. ..... 347/85; 347/7; 347/14

(58) Field of Classification Search ..... 347/85, 347/86, 84, 7, 14
See application file for complete search history.

(56) References Cited

U.S. PATENT DOCUMENTS 4,558,326 A * 12/1985 Kimura et al. ..... 347/30
4,634,430 A * 1/1987 Polaschegg ..... 604/141
4,858,478 A * 8/1989 Kush et al. ..... 73/864.35
5,453,770 A 9/1995 Katakura et al.
5,485,187 A * 1/1996 Okamura et al. ..... 347/85
6,224,198 B1 * 5/2001 Cook et al. ..... 347/85
6,290,343 B1 * 9/2001 Lewis et al. ..... 347/85
2002/0047881 A1 * 4/2002 Lewis et al. ..... 347/85
2002/0085050 A1 * 7/2002 Aruga et al. ..... 347/7
2003/0030706 A1 * 2/2003 Jagannathan et al. ..... 347/85

FOREIGN PATENT DOCUMENTS

EP 0 518 380 A2 6/1992
JP 4-366643 A 12/1992
JP 2000-352379 A 12/2000

* cited by examiner

*Primary Examiner*—Stephen Meier
*Assistant Examiner*—Rene Garcia, Jr.
(74) *Attorney, Agent, or Firm*—Sughrue Mion, PLLC

(57) ABSTRACT

A liquid ejection apparatus has a liquid cartridge including a liquid container that has a flexible portion and stores liquid therein and a pressure chamber for applying pressure to the flexible portion of the liquid container; a liquid ejection head for ejecting liquid; a liquid flow path for guiding liquid from the liquid container to the liquid ejection head; a pressure pump for generating pressurized air; and an air flow path for guiding the pressurized air to the pressure chamber. The pressure pump includes an air chamber that communicates with the air flow path and a pressing member for pressing the air chamber so as to decrease the capacity of the air chamber. The capacity of the air chamber is decreased by the pressing member so as to increase the pressure in the air chamber to an upper limit value of a liquid supply pressure range where a prescribed liquid ejection characteristic is obtained, before a liquid ejecting operation is performed on an ejection target member. A continuous liquid ejecting operation is performed on an ejection target member having a maximum size for the liquid ejection apparatus in a state that the capacity of the air chamber is fixed.

13 Claims, 25 Drawing Sheets

LIQUID EJECTION APPARATUS AND CONTROL METHOD OF THE LIQUID EJECTION APPARATUS

BACKGROUND OF THE INVENTION

The present invention relates to a liquid ejection apparatus and a liquid pressure control method of the liquid ejection apparatus.

The term "liquid ejection apparatus" as used herein is not limited to recording apparatus such as an ink-jet recording apparatus, a copier, and a facsimile machine that perform recording on a recording subject member such as a recording sheet by ejecting ink from a recording head toward the recording subject member, but includes apparatus that cause, instead of ink, a liquid for a particular purpose to stick to an ejection target member corresponding to the recording subject member by ejecting the liquid from a liquid ejection head corresponding to the recording head toward the ejection target member. Examples of the liquid ejection head are, in addition to the above-mentioned recording head, a colorant ejection head that is used for manufacture of color filters of a liquid crystal display or the like, an electrode material (conductive paste) ejection head that is used for formation of electrodes of an organic EL display, a field emission display (FED), or the like, a bioorganic material ejection head that is used for manufacture of a biochip, and a sample ejection head as a precision pipette that ejects a sample.

Conventionally, ink-jet recording apparatus have been used widely as liquid ejection apparatus that eject liquid toward a target. More specifically, those ink-jet recording apparatus include a carriage, a recording head that is mounted on the carriage, and an ink cartridge that stores ink as liquid. Printing is performed on a recording medium as a target in such a manner that ink is supplied from the ink cartridge to the recording head and the ink is jetted from nozzles that are formed in the recording head while the carriage is moved relatively to the recording medium.

Among those ink-jet recording apparatus are ones in which the ink cartridge is not mounted on the carriage (what is called an off-carriage type) for the purposes of reducing the load of the carriage or reducing the size or thickness of the apparatus. Usually, such an ink cartridge has an ink pack that accommodates ink and a case that houses the ink pack.

The ink pack is crushed by supplying air that is pressurized by a pressure pump into the space between the ink pack and the case, whereby ink is supplied from the ink pack to the recording head that is mounted on the carriage.

For example, it is known to use a diaphragm pump as such a pressure pump (refer to JP-A-2000-352379, for example). More specifically, the diaphragm pump disclosed in JP-A-2000-352379 includes a pump chamber having a diaphragm, a suction unidirectional valve, and a discharge unidirectional valve. The capacity of the pump chamber is varied by deformation of the diaphragm.

The suction unidirectional valve, which is disposed between the pump chamber and the outside (i.e., atmosphere) is opened and thereby allows air to flow into the pump chamber only when the pressure in the pump chamber has become approximately lower than atmospheric pressure. Further, the suction unidirectional valve is closed and thereby prevents the air from flowing out of the pump chamber to the outside when the pressure in the pump chamber has become approximately higher than atmospheric pressure. As such, the suction unidirectional valve is a valve for allowing passage of only air that is going to flow into the pump chamber from the outside and for stopping air that is going to flow in the opposite direction.

The discharge unidirectional valve, which is disposed between the pump chamber and the space between the ink pack and the case, is opened and thereby allow air to flow out of the pump chamber to the space between the ink pack and the case only when the pressure in the pump chamber has become higher than the pressure of the space between the ink pack and the case. Further, the discharge unidirectional valve is closed and thereby prevents air from flowing backward from the space between the ink pack and the case into the pump chamber when the pressure in the pump chamber has become lower than the pressure of the space between the ink pack and the case. As such, the discharge unidirectional valve is a valve for allowing passage of only air that is going to flow into the space between the ink pack and the case from the pump chamber and for stopping air that is going to flow in the opposite direction.

In the diaphragm pump having the above structure, as the capacity of the pump chamber is increased and decreased repeatedly, air is sucked through the suction unidirectional valve and the sucked air is pressurized and sent to the space between the ink pack and the case.

Incidentally, the diaphragm pump disclosed in JP-A-2000-352379 is configured in such a manner that the air in the space between the ink pack and the case cannot flow backward into the pump chamber. Therefore, the air in the space between the ink pack and the case is always in a pressurized state. This results in a problem that the pressurized air in the space between the ink pack and the case expands the case to possibly cause an event that the ink cartridge is hard to remove from a main body case of the inkjet recording apparatus when it is attempted to do so.

Further, the ink pack is always in a pressurized state, too. This results in a problem that ink may leak out of a connecting portion between the ink pack and an ink supply tube or the like when the ink cartridge is removed from the main body case of the ink-jet recording apparatus.

In view of the above, it has been conceived to provide, in a certain portion between the diaphragm pump and the ink cartridge, an air release valve or the like capable of making the air pressure in the ink cartridge equal to atmospheric pressure. This measure can solve the above problems because the air pressure in the ink cartridge can be made equal to atmospheric pressure when the ink cartridge is removed from the main body case of the ink-jet recording apparatus.

However, the provision of the air release valve increases the number of components of the entire apparatus and hence may lower the production efficiency or increase the space occupied by the apparatus. In a case that the air release valve is an electromagnetic valve or the like, the control may be complicated.

Liquid ejection apparatus as typified by ink-jet recording apparatus incorporate a liquid ejection head for ejecting liquid toward an ejection target member, and a large number of liquid ejection nozzles for ejecting very small amounts of liquid jets are arranged on a head surface that is opposed to the ejection target member. For example, the liquid ejection head is configured in such a manner that piezoelectric elements are provided in pressure chambers that are provided adjacent to the nozzle openings of the liquid ejection nozzles, respectively. When an electrical signal is applied to a piezoelectric element, the piezoelectric element expands or contracts, as a result of which the liquid pressure in the pressure chamber is varied and a very small amount of liquid is ejected from the nozzle opening. In general, a negative pressure that is caused by expansion or contraction of the pressure chamber that is provided adjacent to the nozzle opening of each liquid ejection nozzle allows liquid to be supplied to (i.e., sucked into) the liquid ejection nozzle from a liquid storage portion that liquid-communicates with the liquid ejection nozzle. However, in liquid ejection apparatus such as large-size ink-jet recording apparatus in which the recording head (liquid ejection head) and the ink cartridge (liquid storage portion) are distant from each other and liquid-communicate with each other via a hollow tube or the like, the negative pressure occurring in each liquid ejection nozzle at the time of liquid ejection may be insufficient to supply a necessary and sufficient amount of ink (liquid) from the ink cartridge to the liquid ejection nozzle through suction. In view of this, various measures have been taken in such ink-jet recording apparatus. For example, the ink cartridge is provided with a mechanical pressure applying member such as a leaf spring and ink is pressurized and sent from the ink cartridge to the recording head by spring force of the lead spring. In another example, ink is pressurized and sent by utilizing the siphon phenomenon of atmospheric pressure (refer to, for example, JP-A4-366643, which has a corresponding U.S. Pat. No. 5,453,770 and a corresponding European patent No. 518,380).

However, in the liquid ejection apparatus in which liquid is pressurized and sent from the liquid storage portion to the liquid ejection head by the mechanical pressure applying member such as a leaf spring or by utilizing the siphon phenomenon of atmospheric pressure, the liquid supply pressure cannot be controlled. This may result in an event that the pressure of the ink supply to the recording head has dispersion or the ink supply pressure varies to a large extent due to variation of the ink residual amount. It is therefore difficult to continue to supply ink from the ink cartridge to the recording head with the ink supply pressure kept stable. In previous recording apparatus such as ink-jet recording apparatus, it is rare that deterioration of the recording image quality due to such dispersion or variation of the ink supply pressure becomes a problem. However, in recent years, the image quality of ink-jet recording apparatus has been improved greatly, their recording execution speeds have been increased, and the liquid ejection accuracy that is required for various liquid ejection apparatus using the ink-jet technology has been increased. For these reasons, lowering of the liquid ejection accuracy due to dispersion or variation of the ink supply pressure is becoming a problem.

SUMMARY OF THE INVENTION

The present invention has been made in view of the above problems, and a first object of the invention is therefore to provide a liquid ejection apparatus that is composed of a small number of components and in which the pressure of the air located between a liquid container and a pressure chamber of a liquid cartridge can be made equal to atmospheric pressure by a simple control, as well as a control method of such a liquid ejection apparatus.

A second object of the invention is to reduce the degree of lowering of the liquid ejection accuracy due to dispersion or variation of the liquid supply pressure of a liquid ejection head in liquid ejection apparatus such as ink-jet recording apparatus.

The invention provides the following liquid ejection apparatus and control methods of a liquid ejection apparatus.

(1) A liquid ejection apparatus comprising:

a liquid cartridge including:

a liquid container having a flexible portion, for storing liquid therein; and a pressure chamber for applying pressure to the flexible portion of the liquid container;

a liquid ejection head for ejecting liquid; and a pressure pump for generating pressurized air to be supplied to the pressure chamber to compress the flexible portion so as to supply liquid from the liquid container to the liquid ejection head, the pressure pump including:

an air chamber that communicates with the pressure chamber, has a variable capacity, and has a communication portion through which an inner space and an outer space of the air chamber communicate with each other; and a pressing member that is moved in a first direction in which a capacity of the air chamber decreases while being pressed against the communication portion of the air chamber, thereby closing the communication portion and generating the pressurized air.

(2) The liquid ejection apparatus as set forth in item (1), wherein the pressure pump has an urging member disposed between the pressing member and the air chamber, for urging the air chamber in a second direction that is opposite to the first direction when the pressing member presses the air chamber.

(3) The liquid ejection apparatus as set forth in item (1), wherein the pressing member is pressed against the air chamber while closing the communication portion when the liquid ejection head is performing a liquid ejecting operation; and the pressing member is separated from the air chamber while opening the communication portion when the liquid ejection head is not performing a liquid ejecting operation.

(4) The liquid ejection apparatus as set forth in item (1), wherein the air chamber is formed by blow molding.

(5) The liquid ejection apparatus as set forth in item (1), wherein the pressing member has a contact portion to be brought in contact with the air chamber, the contact portion being made of an elastic material.

(6) The liquid ejection apparatus as set forth in item (1), wherein the air chamber has a bellows shape.

(7) The liquid ejection apparatus as set forth in item (1), wherein the pressing member includes:

a motor;

an abutment portion for closing the communication portion when the pressing member is pressed against the air chamber, and for opening the communication portion when the pressing member is separated from the air chamber; and a conversion member for converting a rotational movement of the motor into a reciprocative movement of the abutment portion in the first direction or a second direction that is opposite to the first direction.

(8) The liquid ejection apparatus as set forth in item (7), wherein the conversion member is a lead screw.

(9) The liquid ejection apparatus as set forth in item (7), wherein the conversion member is a plurality of lead screws.

(10) The liquid ejection apparatus as set forth in item (7), further comprising:

a capacity detector for detecting the capacity of the air chamber; and a controller for controlling a movement of the abutment portion on the basis of the capacity detected by the capacity detector.

(11) The liquid ejection apparatus as set forth in item (10), wherein the capacity detector is a sensor for detecting a position of the abutment portion.

(12) A method for controlling a liquid ejection apparatus, comprising the steps of:

decreasing a capacity of an air chamber that is in an airtight state, to generate pressurized air;

increasing the capacity of the air chamber in a state that an inner space of the air chamber communicates with atmosphere; and compressing a liquid container by the pressurized air so that liquid stored in the liquid container is supplied to a liquid ejection head.

(13) The method as set forth in item (12), further comprising the steps of:

detecting the capacity of the air chamber; and halting a liquid ejecting operation of the liquid ejection head if the capacity of the air chamber detected by the detecting step is smaller than or equal to a prescribed value.

(14) The method as set forth in item (13), further comprising the step of moving a target to which liquid ejected from the liquid ejection head is to stick when the capacity of the air chamber detected by the detecting step is smaller than or equal to the prescribed value.

(15) A liquid ejection apparatus comprising:

a liquid container for storing liquid therein;

a liquid ejection head for ejecting liquid;

an air chamber having a variable capacity;

a capacity changing member for changing a capacity of the air chamber to apply pressure to the air chamber so that liquid is supplied from the liquid container to the liquid ejection head by liquid supply pressure that corresponds to the pressure applied to the air chamber;

a pressure detector for detecting pressure in the air chamber; and a controller for setting a minimum capacity value of the air chamber so that a pressure reduction, caused by performing a continuous liquid ejecting operation on an ejection target member having a maximum size for the liquid ejection apparatus with the capacity of the air chamber fixed, is smaller than a pressure difference between an upper limit value and a lower limit value of a liquid supply pressure range where a prescribed liquid ejection characteristic is obtained, wherein the pressure in the air chamber is increased to the upper limit value before a liquid ejecting operation is performed on an ejection target member; and wherein the liquid ejecting operation is performed in a state that the capacity of the air chamber is fixed.

(16) The liquid ejection apparatus as set forth in item (15), wherein the air chamber has a communication portion through which an inner space of the air chamber communicates with atmosphere;

wherein the capacity changing member is a valve member that is moved in a first direction in which the capacity of the air chamber decreases and in a second direction in which the capacity of the air chamber increases;

wherein the valve member is moved in the first direction while being pressed against the communication portion, thereby closing the communication portion and increasing the pressure in the air chamber; and wherein the valve member is moved in the second direction while being separated from the communication portion, thereby causing the communication portion to communicate with the atmosphere and reducing the pressure in the air chamber to atmospheric pressure.

(17) The liquid ejection apparatus as set forth in item (15), wherein when liquid ejecting operations are performed continuously on a plurality of ejection target members, the pressure in the air chamber is increased to the upper limit value in an interval between one liquid ejecting operation of the liquid ejecting operations and a next liquid ejecting operation.

(18) The liquid ejection apparatus as set forth in item (16), further comprising:

a first position detector for detecting whether the valve member has been moved to a first limit position corresponding to the minimum capacity value; and a second position detector for detecting whether the valve member has been moved to a second limit position past which the valve member is prohibited to move in the second direction, wherein when the valve member has been moved to the first limit position before the pressure in the air chamber reaches a prescribed value, the valve member is moved to the first limit position to increase the pressure in the air chamber to the upper limit value.

(19) A method for controlling liquid pressure of a liquid ejection apparatus, comprising the steps of:

changing a capacity of an air chamber to change pressure therein;

compressing a liquid container storing liquid by the pressure in the air chamber;

supplying liquid to a liquid ejection head by liquid supply pressure corresponding to the pressure in the air chamber;

detecting the pressure in the air chamber;

setting a minimum capacity value of the air chamber so that a pressure reduction, caused by performing a continuous liquid ejecting operation on an ejection target member having a maximum size for the liquid ejection apparatus with the capacity of the air chamber fixed, is smaller than a pressure difference between an upper limit value and a lower limit value of a liquid supply pressure range where a prescribed liquid ejection characteristic is obtained;

increasing the pressure in the air chamber to the upper limit value before a liquid ejecting operation is performed on an ejection target member; and performing the liquid ejecting operation in a state that the capacity of the air chamber is fixed.

(20) The method as set forth in item (19), further comprising the step of increasing the pressure in the air chamber to the upper limit value in an interval between one liquid ejecting operation of liquid ejecting operations and the next liquid ejecting operation when the liquid ejecting operations are performed continuously on a plurality of ejection target members.

(21) The liquid ejection apparatus as set forth in item (19), wherein the capacity changing step includes the substeps of:

moving the valve member to press the air chamber in a first direction in which the capacity of the air chamber decreases; and moving the valve member in a second direction in which the capacity of the air chamber increases, the method further comprising the steps of:

detecting whether the valve member has been moved to a first limit position corresponding to the minimum capacity value;

detecting whether the valve member has been moved to a second limit position past which the valve member is prohibited to move in the second direction; and moving the valve member to the first limit position to increase the pressure in the air chamber to the upper limit value when the valve member has been moved to the first limit position before the pressure in the air chamber reaches a prescribed value.

(22) A liquid ejection apparatus comprising:

a liquid cartridge including:

a liquid container having a flexible portion, for storing liquid therein; and a pressure chamber for applying pressure to the flexible portion of the liquid container;

a liquid ejection head for ejecting liquid;

a liquid flow path for guiding liquid from the liquid container to the liquid ejection head;

a pressure pump for generating pressurized air; and an air flow path for guiding the pressurized air to the pressure chamber, wherein the pressure pump includes:

an air chamber that communicates with the air flow path; and a pressing member for pressing the air chamber so as to decrease a capacity of the air chamber;

wherein the capacity of the air chamber is decreased by the pressing member so as to increase the pressure in the air chamber to an upper limit value of a liquid supply pressure range where a prescribed liquid ejection characteristic is obtained, before a liquid ejecting operation is performed on an ejection target member; and wherein a continuous liquid ejecting operation is performed on an ejection target member having a maximum size for the liquid ejection apparatus in a state that the capacity of the air chamber is fixed.

(23) A liquid ejection apparatus comprising:

a liquid cartridge including:

a liquid container having a flexible portion, for storing liquid therein; and a pressure chamber for applying pressure to the flexible portion of the liquid container;

a liquid ejection head for ejecting liquid;

a liquid flow path for guiding liquid from the liquid container to the liquid ejection head;

a pressure pump for generating pressurized air; and an air flow path for guiding the pressurized air to the pressure chamber, wherein the pressure pump includes:

an air chamber that communicates with the air flow path;

a pressing member for pressing the air chamber so as to decrease a capacity of the air chamber; and a communication portion for disconnecting an inner space of the air chamber from an outer space thereof as the pressing member is moved in a direction in which the capacity of the air chamber decreases, and for causing the inner space to communicate with the outer space as the pressing member is moved in which the capacity of the air chamber increases.

The invention provides a liquid ejection apparatus according to the invention comprising a liquid cartridge including a liquid container having a flexible portion and being capable of storing liquid therein, and a pressure chamber for applying pressure to the flexible portion of the liquid container; a liquid ejection head for ejecting liquid; a liquid flow path for guiding liquid from the liquid container to the liquid ejection head; a pressure pump for generating pressurized air; and an air flow path for guiding the pressurized air to the pressure chamber, wherein the pressure pump includes an air chamber that communicates with the air flow path and a pressing member for decreasing a capacity of the air chamber by pressing the air chamber while being in contact with the air chamber; and wherein the air chamber has a communication member for causing an inner space of the air chamber to communicate with an outer space thereof when the pressing member is in contact with the communication member, and to disconnect the inner space from the outer space when the pressing member is not in contact with the communication member.

In this liquid ejection apparatus, as the pressing member is pressed against the air chamber, the capacity of the air chamber is decreased and the air pressure in the air chamber and the air flow path is increased. As a result, the pressure pump is rendered in a pressurized state, whereby air that flows from the air chamber into the pressure chamber of the liquid cartridge via the air flow path crushes the liquid container and liquid is guided from the liquid container to the liquid ejection head. A non-contact state is established when the pressing member is separated from the air chamber after the pressing of the air chamber by the pressing member was stopped. As a result, the pressure pump is rendered in an unpressurized state, whereby air stops flowing from the air chamber into the pressure chamber of the liquid cartridge via the air flow path and liquid also stops flowing to the liquid ejection head.

When the pressure pump is in a pressurized state, the communication member is rendered incommunicable by the pressing member and the air chamber is kept airtight. The air can thus be pressurized effectively. On the other hand, when the pressure pump is in an unpressurized state and the pressing member is separated from the air chamber, the communication member communicates with the air and air flows from the outer space into the inner space of the air chamber through the communication member. As a result, the pressure in the air chamber and the air flow path is made approximately equal to atmospheric pressure.

As described above, in the above liquid ejection apparatus, the air pressure in the air flow path and the pressure chamber of the liquid cartridge is made equal to atmospheric pressure when the pressure pump is in an unpressurized state. This prevents deformation of the liquid cartridge and facilitates attachment and removal of the ink cartridge to and from the main body case or the like of the liquid ejection apparatus. Further, liquid leakage from the connecting portion of the liquid container and the liquid flow path can be prevented in attaching or removing the liquid cartridge.

In the above liquid ejection apparatus, pressurized air can be generated by the pressure pump and the pressure in the air chamber and the air flow path can be made equal to atmospheric pressure by changing the position of the pressing member. That is, a new air release valve such as an electromagnetic valve is not necessary for the purpose of making the pressure in the air chamber and the air flow path approximately equal to atmospheric pressure. This prevents increase in the number of components and complication of the control.

In the above liquid ejection apparatus, the pressure pump may have an urging member disposed between the pressing member and the air chamber, for urging the air chamber toward the pressing member so as to cause their contact when the pressing member presses the air chamber.

There may occur an event that the air chamber comes not to be in contact with the pressing member due to creeping or the like of the air chamber. Even in such a case, the urging member urges the air chamber toward the pressing member so as to cause their contact and hence the pressing member can press the air chamber while being kept in contact with the air chamber.

The above liquid ejection apparatus may be such that the pressing member is kept in contact with the air chamber during a liquid ejecting operation, and that the pressing member is separated from the air chamber while no liquid ejecting operation is performed.

In this configuration, while no liquid ejecting operation is performed, the pressing member of the pressure pump is separated from the air chamber and the inner space of the air chamber is made to communicate with the outer space. That is, the pressure chamber of the liquid cartridge is made to communicate with the outer space while no liquid ejecting operation is performed. Therefore, the pressure chamber of the liquid cartridge does not expand and the liquid cartridge can easily be removed from the liquid ejection apparatus. Further, no liquid leaks from the outlet of the liquid container in attaching or removing the liquid cartridge to or from the liquid ejection apparatus.

In the above liquid ejection apparatus, the air chamber may be formed by blow molding.

With this configuration, the air chamber can be manufactured easily by using a simple manufacturing apparatus and the manufacturing cost can be reduced.

The above liquid ejection apparatus may be such that the air chamber has a contact portion to be brought in contact with the pressing member and the contact portion is made of an elastic material.

This configuration increases the closeness of the contact between the air chamber and the pressing member and hence the occlusiveness of the communication member. The airtightness can thus be increased in a pressurized state.

In the above liquid ejection apparatus, the air chamber may have a bellows shape.

With this configuration, the air chamber contracts or expands linearly when its capacity is changed. Therefore, a conversion member can be made compact and the load to be imposed to press the air chamber can be reduced.

In the above liquid ejection apparatus, the pressing member may include a motor; an abutment portion for closing the communication member of the air chamber when the pressing member is pressed against the air chamber, and for opening the communication member when the pressing member is separated from the air chamber; and a conversion member for converting a rotational movement of the motor into a reciprocative movement of the abutment portion in a direction in which the abutment portion comes into contact with or is separated from the air chamber.

This configuration can make the entire apparatus compact and facilitates the control.

In the above liquid ejection apparatus, the conversion member may be a lead screw.

This configuration can make the entire apparatus compact because the lead screw is more compact than a cam mechanism. Further, this configuration can facilitate the control for changing the capacity of the air chamber because the lead screw can displace the abutment portion linearly.

In the above liquid ejection apparatus, the conversion member may be a plurality of lead screws.

This configuration prevents buckling of the air chamber having a bellows shape and makes it possible to change the capacity of the air chamber stably.

The above liquid ejection apparatus may further comprise a capacity detector for detecting the capacity of the air chamber; and a controller for controlling rotation of the motor on the basis of the capacity detected by the capacity detector.

This configuration makes it possible to recognize, on the basis of the capacity detected by the capacity detector, that contraction of the air chamber has made it impossible to keep the pressure in the air flow path at a prescribed value. If it is judged that the air chamber has contracted to the maximum, the pressure in the air flow path can be kept at the prescribed value again by rotating the motor so as to increase the capacity of the air chamber and then rotating the motor so as to decrease the capacity of the air chamber.

In the above liquid ejection apparatus, the capacity detector may be a sensor for detecting a position of the abutment portion.

In this case, it becomes possible to detect the capacity with a simple configuration.

The invention provides a driving method of a liquid ejection apparatus comprising a liquid cartridge including a liquid container having a flexible portion and being capable of storing liquid therein, and a pressure chamber for applying pressure to the flexible portion of the liquid container; a liquid ejection head for ejecting liquid; a liquid flow path for guiding liquid from the liquid container to the liquid ejection head; a pressure pump for generating pressurized air; and an air flow path for guiding the pressurized air to the pressure chamber, the pressure pump including an air chamber that communicates with the air flow path; a motor; an abutment portion for closing a communication member through which an inner space of the air chamber is to communicate with an outer space thereof when pressed against the air chamber, and for opening the communication member when separated from the air chamber; and a conversion member for converting a rotational movement of the motor into a reciprocative movement of the abutment portion in a direction in which the abutment portion comes into contact with or is separated from the air chamber, the method comprising the steps of a capacity detector's detecting a capacity of the air chamber; and a controller's controlling driving of the liquid ejection head so as to stop ejection of liquid from the liquid ejection head if the capacity of the air chamber detected by the capacity detector is smaller than or equal to a prescribed value.

In this driving method, ejection of liquid from the liquid ejection head is stopped if the capacity detector has detected that the capacity of the air chamber is smaller than or equal to the prescribed value. As a result, ejection of liquid from the liquid ejection head is stopped when the air chamber of the pressure pump has contracted to the maximum and hence the pressure in the pressure chamber of the liquid cartridge can no longer be increased by the pressure pump and no liquid is supplied from the liquid container to the liquid ejection head. This prevents empty ejection of the liquid ejection head.

The above driving method of a liquid ejection apparatus may be such that the liquid ejection apparatus further comprises the target moving device for moving a target to which liquid ejected from the liquid ejection head is to stick, and may further comprise the step of the controller's controlling driving of a target moving device so that the target moving device moves a target if the capacity of the air chamber detected by the detecting step is smaller than or equal to the prescribed value.

In this driving method, ejection of liquid from the liquid ejection head is stopped and the target moving device moves a target if the capacity detector has detected that the capacity of the air chamber is smaller than or equal to the prescribed value. Therefore, a target can be moved while liquid ejection is not performed on the target. The efficiency of liquid ejection can thus be increased.

To attain the above objects, in a liquid ejection apparatus that comprises a liquid ejection head for ejecting liquid to an ejection target member; a liquid container that is charged with liquid airtightly; an air compressor that has an air chamber, a valve body for compressing and pressurizing air in the air chamber, and an open-close valve for the air chamber and in which the air in the air chamber is compressed and pressurized and is sent to the liquid container with the open-close valve closed when the valve body is moved in a compression direction and the open-close valve is opened and the pressure of the air in the air chamber is reduced to atmospheric pressure when the valve body is moved in a direction opposite to the compression direction; and a pressure detector for detecting the pressure in the air chamber, and in which liquid is pressure-sent from the liquid container to the liquid ejection head by supply pressure corresponding to the pressure of the air compressed and pressurized by the air compressor, the invention provides a liquid pressure control apparatus for controlling increase and decrease of the supply pressure of the liquid to be sent from the liquid container to the liquid ejection valve by controlling a driving source of the valve body on the basis of the pressure detected by the pressure detector, wherein a pressurization limit position as a movement limit position of the valve member in the compression direction is set in advance for the air compressor so that a pressure reduction of the air chamber, caused by performing a continuous liquid ejecting operation on an ejection target member having a maximum size for the liquid ejection apparatus with a movement position of the valve body fixed, is smaller than a pressure difference between an upper limit value and a lower limit value of a liquid supply pressure range where a prescribed liquid ejection characteristic is obtained; and wherein the pressure in the air chamber is increased to the upper limit value of the liquid supply pressure range where the prescribed liquid ejection characteristic is obtained before a liquid ejecting operation is performed on an ejection target member, and the liquid ejecting operation is performed on the ejection target member without increasing the pressure in the air chamber during the liquid ejecting operation.

As described above, the liquid ejection apparatus is provided with the air compressor, the driving source for moving the valve body of the air compressor, and the pressure detector for detecting the pressure in the air chamber of the air compressor, and liquid is pressure-sent from the liquid container to the liquid ejection head by the supply pressure corresponding to the pressure of the air compressed and pressurized by the air compressor. The air compressor is configured in such a manner that the air in the air chamber is compressed and pressurized with the open-close valve closed when the valve body is moved in the compression direction and the open-close valve is opened, and that the pressure of the air in the air chamber is reduced to atmospheric pressure when the valve body is moved in the direction opposite to the compression direction. Therefore, the increase and decrease of the pressure of liquid supply from the liquid container to the liquid ejection head can be controlled by controlling the movement position of the valve body by controlling the driving source of the valve body on the basis of the pressure detected by the pressure detector. As for the air compressor, the pressurization limit position as the movement limit position of the valve member in the compression direction is set in advance so that the pressure reduction of the air chamber, caused by performing a continuous liquid ejecting operation on an ejection target member having the maximum size for the liquid ejection apparatus with the movement position of the valve body fixed, is smaller than the pressure difference between the upper limit value and the lower limit value of the liquid supply pressure range where the prescribed liquid ejection characteristic is obtained.

That is, the pressurization limit position of the valve body is set so as to secure such a capacity of the air chamber that the liquid supply pressure does not become lower than the lower limit of the liquid supply pressure range where the prescribed liquid ejection characteristic is obtained while a continuous liquid ejecting operation is performed on an ejection target member having the maximum size for the liquid ejection apparatus. This assures that a liquid ejecting operation on an ejection target member can be completed without the need for increase the pressure in the air chamber again during the liquid ejecting operation. A liquid ejecting operation is started after the pressure in the air chamber is increased to the upper limit value of the liquid supply pressure range where the prescribed liquid ejection characteristic is obtained, and the liquid ejecting operation is performed without increasing the pressure in the air chamber again during the liquid ejecting operation. As a result, a continuous liquid ejecting operation on an ejection target member can be performed without interruption and the liquid supply pressure can always be kept stable with high accuracy during the continuous liquid ejecting operation on the ejection target member.

Since a continuous liquid ejecting operation on an ejection target member can be performed without interruption and the liquid supply pressure can always be kept stable with high accuracy during a continuous liquid ejecting operation on an ejection target member, an advantage is obtained that the degree of reduction of the liquid ejection accuracy due to dispersion or variation of the pressure of liquid supply to the liquid ejection head can be lowered in a liquid ejection apparatus such as an ink-jet recording apparatus. Further, since a continuous liquid ejecting operation on an ejection target member having the maximum size for the liquid ejection apparatus can be performed without interruption, reduction of the throughput of liquid ejecting operations can be prevented.

The above liquid ejection apparatus may be such that when liquid ejecting operations are performed continuously on a plurality of ejection target members, the pressure in the air chamber is increased to the upper limit value of the liquid supply pressure range where the prescribed liquid ejection characteristic is obtained in an interval between a liquid ejecting operation on one ejection target member and a liquid ejecting operation on a next liquid ejecting operation.

As described above, when liquid ejecting operations are performed continuously on a plurality of ejection target members, the pressure in the air chamber is increased to the upper limit value of the liquid supply pressure range where the prescribed liquid ejection characteristic is obtained in an interval between a liquid ejecting operation on one ejection target member and a liquid ejecting operation on a next liquid ejecting operation. Therefore, a liquid ejecting operation on each ejection target member is started in a state that the pressure of liquid supply to the liquid ejection head has been increased to the upper limit value of the liquid supply pressure range where the prescribed liquid ejection characteristic is obtained. As a result, also in the case of performing liquid ejecting operations continuously on a plurality of ejection target members, the liquid ejecting operations can be completed without interruption. And the liquid supply pressure can always be kept stable with high accuracy during the continuous liquid ejecting operations on the ejection target members.

The above liquid ejection apparatus may be configured as follows. The air compressor of the liquid ejection apparatus further comprises a pressure limit position detector for detecting whether the valve body has been moved to the pressure limit position and an initial pressurization position detector for detecting whether the valve body has been moved to an initial pressurization position that is set in advance as a movement limit position in a direction opposite to the compression direction of the valve body, and if the valve body has reached the pressurization limit position during pressurization of the air chamber, the valve body is moved to the initial pressurization position and then the air chamber is pressurized to the upper limit value of the liquid supply pressure range where the prescribed liquid ejection characteristic is obtained.

As described above, if the valve body has reached the pressurization limit position during pressurization of the air chamber, the valve body is moved to the initial pressurization position and then the air chamber is pressurized to the upper limit value of the liquid supply pressure range where the prescribed liquid ejection characteristic is obtained. Therefore, the pressurization control for the liquid supply pressure can be performed by fully utilizing the maximum valve body movable range from the initial pressurization position to the pressurization limit position. Since the number of movements of the valve body in the pressure reduction direction (opposite to the compression direction) can be minimized, the pressurization control for the liquid supply pressure can be performed efficiently.

In a liquid ejection apparatus that comprises a liquid ejection head for ejecting liquid to an ejection target member; a liquid container that is charged with liquid airtightly; an air compressor that has an air chamber, a valve body for compressing and pressurizing air in the air chamber, and an open-close valve for the air chamber and in which the air in the air chamber is compressed and pressurized and is sent to the liquid container with the open-close valve closed when the valve body is moved in a compression direction and the open-close valve is opened and the pressure of the air in the air chamber is reduced to atmospheric pressure when the valve body is moved in a direction opposite to the compression direction; and a pressure detector for detecting the pressure in the air chamber, and in which liquid is pressure-sent from the liquid container to the liquid ejection head by supply pressure corresponding to the pressure of the air compressed and pressurized by the air compressor, the invention provides a liquid pressure control program for causing a computer to control increase and decrease of the supply pressure of the liquid to be sent from the liquid container to the liquid ejection valve by controlling a driving source of the valve body on the basis of the pressure detected by the pressure detector, wherein a pressurization limit position as a movement limit position of the valve member in the compression direction is set in advance for the air compressor so that a pressure reduction of the air chamber, caused by performing a continuous liquid ejecting operation on an ejection target member having a maximum size for the liquid ejection apparatus with a movement position of the valve body fixed, is smaller than a pressure difference between an upper limit value and a lower limit value of a liquid supply pressure range where a prescribed liquid ejection characteristic is obtained; and wherein the liquid pressure control program comprises the steps of increasing the pressure in the air chamber to the upper limit value of the liquid supply pressure range where the prescribed liquid ejection characteristic is obtained before a liquid ejecting operation is performed on an ejection target member, and performing the liquid ejecting operation on the ejection target member without increasing the pressure in the air chamber during the liquid ejecting operation.

This control program provides the same workings and advantages as the above-described liquid ejection apparatus does. Further, this control program allows an arbitrary liquid ejection apparatus capable of executing it to provide the same workings and advantages as the above-described liquid ejection apparatus does.

The above liquid pressure control program may further comprise the step of increasing the pressure in the air chamber to the upper limit value of the liquid supply pressure range where the prescribed liquid ejection characteristic is obtained in an interval between a liquid ejecting operation on one ejection target member and a liquid ejecting operation on a next liquid ejecting operation when liquid ejecting operations are performed continuously on a plurality of ejection target members.

This control program provides the same workings and advantages as the above-described corresponding liquid ejection apparatus does. Further, this control program allows an arbitrary liquid ejection apparatus capable of executing it to provide the same workings and advantages as the above-described corresponding liquid ejection apparatus does.

The above liquid pressure control program may be as follows. The air compressor of the liquid ejection apparatus further comprises a pressure limit position detector for detecting whether the valve body has been moved to the pressure limit position and an initial pressurization position detector for detecting whether the valve body has been moved to an initial pressurization position that is set in advance as a movement limit position in a direction opposite to the compression direction of the valve body, and the liquid pressure control program further comprises the step of moving the valve body to the initial pressurization position and then pressurizing the air chamber to the upper limit value of the liquid supply pressure range where the prescribed liquid ejection characteristic is obtained if the valve body has reached the pressurization limit position during pressurization of the air chamber.

This control program provides the same workings and advantages as the above-described corresponding liquid ejection apparatus does. Further, this control program allows an arbitrary liquid ejection apparatus capable of executing it to provide the same workings and advantages as the above-described corresponding liquid ejection apparatus does.

BRIEF DESCRIPTION OF THE DRAWINGS

The above objects and advantages of the invention will be apparent from the following detailed description of the preferred embodiments with reference to the accompanying drawings, wherein.

DETAILED DESCRIPTION OF THE PREFERRED EMBODIMENTS

First Embodiment

A first embodiment of the present invention will be hereinafter described with reference to FIGS. 1-7.

Figure 1:
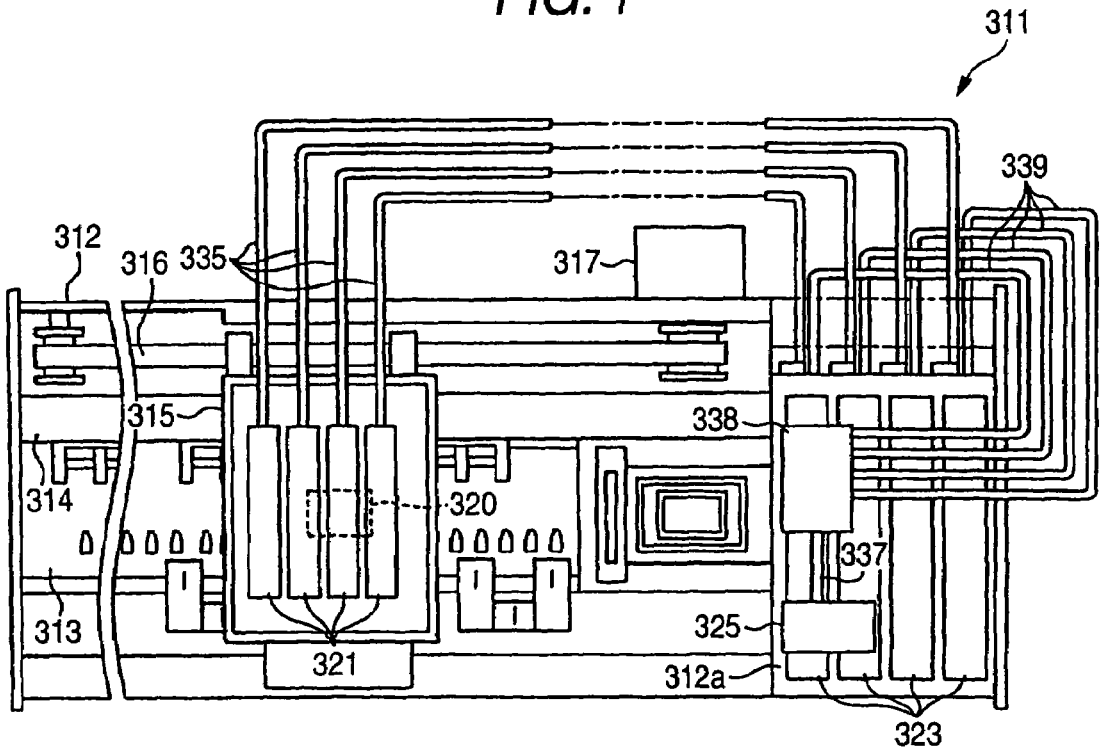
FIG. 1 is a plan view of an ink-jet recording apparatus according to a first embodiment.

As shown in FIG. 1, an ink-jet recording apparatus 311 as a liquid ejection apparatus according to this embodiment includes a main body case 312, a platen 313, a guide shaft 314, a carriage 315, a timing belt 316, a carriage motor 317, and a recording head 320 as a liquid ejection head. The ink-jet recording apparatus 311 further includes valve units 321, ink cartridges 323 as liquid cartridges, and a pressure pump 325. The main body case 312 is a box that generally takes the form of a rectangular parallelepiped, and is formed with a cartridge holder 312*a* at the right end (as viewed in FIG. 1). In this embodiment, the longitudinal direction of the main body case 312 is referred to as a main scanning direction.

The platen 313, which is laid in the main body case 312 so as to extend in the main scanning direction, is a member for supporting a recording medium (not shown) as a target that is sent from a sheet feeding device (not shown) as a target moving device. In this embodiment, a recording medium is moved in the auxiliary scanning direction, that is, the direction perpendicular to the main scanning direction.

The guide shaft 314, which has a rod shape, is laid in the main body case 312 so as to extend parallel with the platen 313, that is, in the main scanning direction. The carriage 315 is disposed so as to be opposed to the platen 313 and to be able to move relatively to the guide shaft 314 that penetrates through the carriage 315. That is, the carriage 315 can reciprocate in the main scanning direction.

The carriage 315 is connected to the carriage motor 317 via the timing belt 316. The carriage motor 317 is supported by the main body case 312. When the carriage motor 317 is driven, the carriage 315 is driven via the timing belt 316 and is reciprocated along the guide shaft 314, that is, in the main scanning direction.

The recording head 320, which is provided on the surface of the carriage 315 that is opposed to the platen 313, is equipped with a plurality of nozzles (not shown) for ejecting inks toward the platen 313. The valve units 321, which are mounted on the carriage 315, supplies temporarily stored inks to the recording head 320 in a pressure-adjusted state. In this embodiment, four valve units 321 are provided that correspond to respective ink colors (black, yellow, magenta, and cyan).

Figure 2:
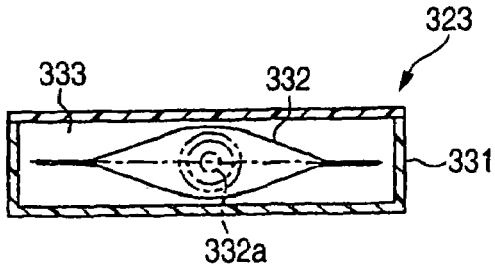
FIG. 2 is a sectional view of an ink cartridge of the ink-jet recording apparatus according to the first embodiment.

The ink cartridges 323 are accommodated so as to be detachable from the cartridge holder 312*a*. Four ink cartridges 323 are provided that correspond to respective ink colors. FIG. 2 shows one of the four ink cartridges 323. The ink cartridge 323 has an ink case 331 as a pressure chamber and an ink pack 332 as a liquid container. The ink case 331 generally takes the form of a rectangular parallelepiped.

The ink pack 332 is formed by laying two film members as flexible portions on each other, and ink as liquid is enclosed by the ink pack 332.

The ink pack 332 has an ink outlet 332*a* and is housed in the ink case 331. Only the ink outlet 332*a* of the ink pack 332 is exposed from the ink case 331 and the other part is housed in the ink case airtightly. Therefore, a space 333 is formed between the ink case 331 and the ink pack 332.

A communication hole (not shown) is formed through the ink case 331 so as to communicate with the space 333. Force for crushing the ink pack 332 can be generated by introducing air into the space 333 through the communication hole and thereby increasing the pressure there. As shown in FIG. 1, the ink outlets 332*a* of the ink packs 332 are connected to the valve units 321 via ink supply tubes 335 as liquid flow paths, respectively, that are provided for the respective ink colors. Therefore, by introducing air into the spaces inside the ink cases 331, inks can be supplied from the ink packs 332 to the valve units 321 via the ink supply tubes 335, respectively.

In this embodiment, the pressure pump 325 is fixed to the main body case 312 so as to be located above the ink cartridges 323. The pressure pump 325 can suck air and discharge the sucked air as pressurized air. A detailed structure of the pressure pump 325 will be described later. Pressurized air that is produced by the pressure pump 325 is supplied to a pressure detector 338 via a pressure tube 337 constituting an air flow path.

The pressure detector 338 detects the pressure of air that is supplied from the pressure pump 325. In this embodiment, the driving of the pressure pump 325 is adjusted on the basis of the detected pressure. Therefore, the pressure of air that is supplied from the pressure pump 325 is adjusted by using the pressure detector 338 so as to fall within a prescribed range. The pressure detector 338 is connected to the communication holes of the ink cartridges 323 via four air supply tubes 339 constituting air flow paths, respectively. Therefore, air whose pressure is adjusted so as to fall within the prescribed range is introduced into the spaces 333 of the ink cartridges 323.

As described above, the ink pack of each ink cartridge 323 is pressurized by pressurized air that is supplied from the pressure pump 325 and ink is supplied from the ink pack 332 to the corresponding valve unit 321. Ink that has been stored temporarily in each valve unit 321 is supplied to the recording head 320 in a pressure-adjusted state.

Based on image data, printing can be performed on a recording medium by ejecting inks from the recording head 320 while the recording medium is moved in the auxiliary direction by the sheet feeding device and the carriage 315 is moved in the main scanning direction.

Next, the pressure pump 325 will be described with reference to FIGS. 3 and 4.

Figure 3:
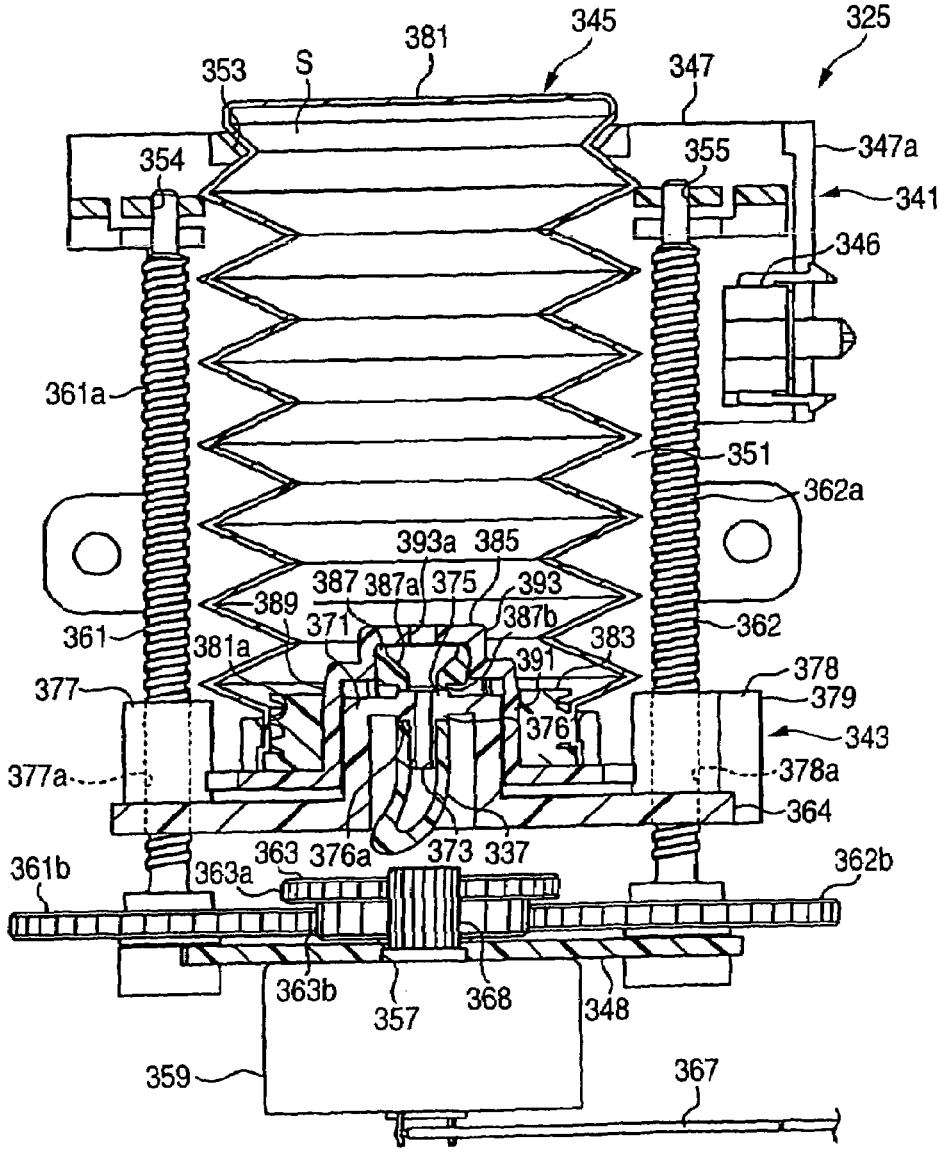
FIG. 3 is a sectional view of a pressure pump of the ink-jet recording apparatus according to the first embodiment.
Figure 4:
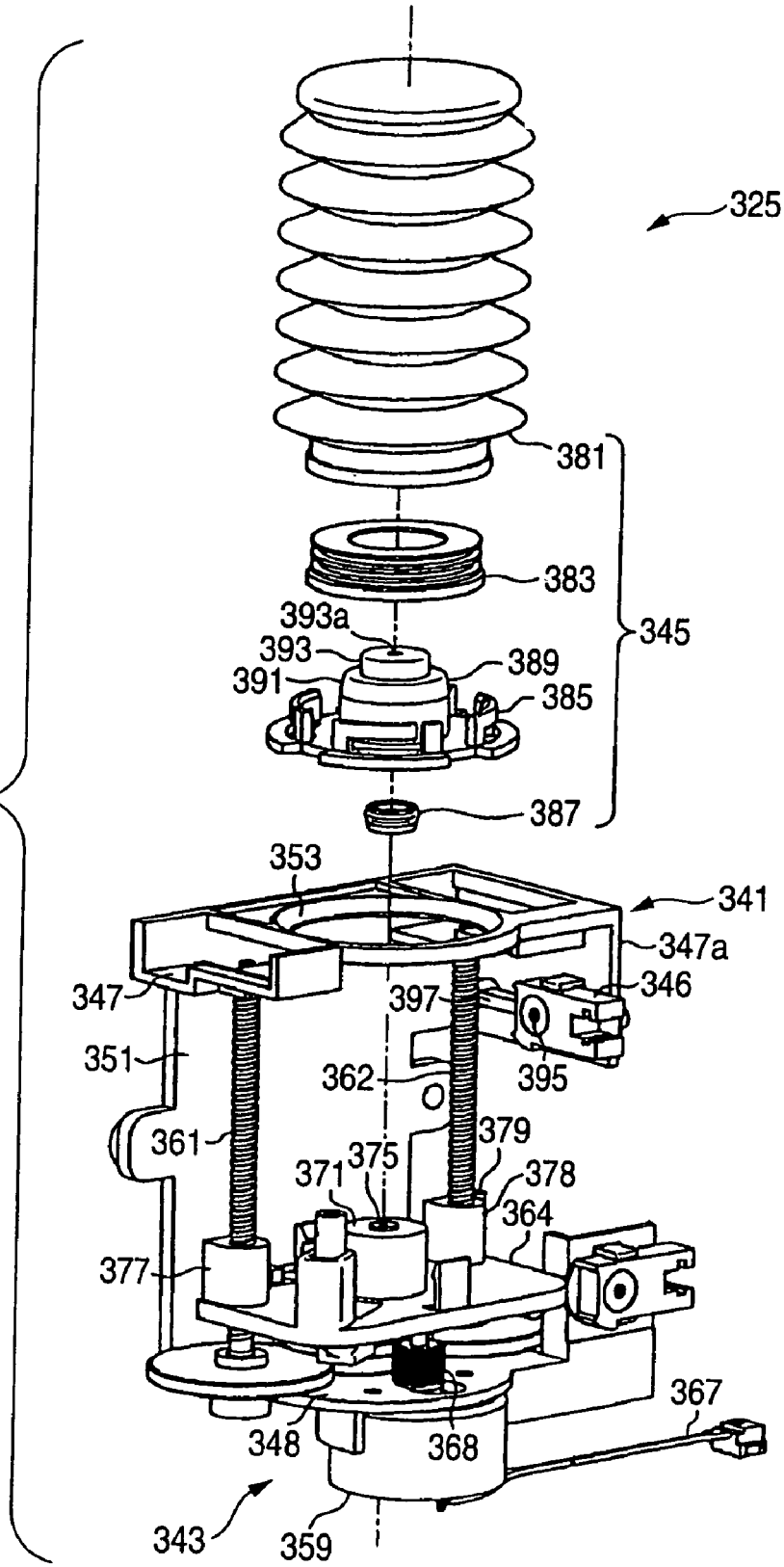
FIG. 4 is an exploded perspective view of the pressure pump according to the first embodiment.

As shown in FIGS. 3 and 4, the pressure pump 325 has a support body 341, a pressing device 343 as a pressing member, an air chamber 345, and a detecting portion 346. The support body 341 has a top plate 347 and a bottom plate 348 that are opposed to each other so as to be parallel with each other. The support body 341 is integrally formed with a link plate 351 that is perpendicular to the top plate 347 and the bottom plate 348.

The top plate 347 is formed with a large-diameter hole 353 at its center and has a pair of, that is, right and left, small-diameter holes 354 and 355 (see FIG. 3) on both sides of the large-diameter hole 353. The small-diameter holes 354 and 355 have the same inner diameter that is very smaller than the inner diameter of the large-diameter hole 353.

The bottom plate 348 is formed with a gear insertion hole 357 approximately at its center and has a pair of, that is, right and left, lead screw support portions (not shown) on both sides of the gear insertion hole 357.

The lead screw support portions are disposed at such positions as to be opposed to the respective small-diameter holes 354 and 355 of the top plate 347. The link plate 351 is disposed on the backside (as viewed in FIG. 3) between the top plate 347 and the bottom plate 348 so as to link the top plate 347 and the bottom plate 348 to each other. The link plate 351, and hence the support body 341, is fixed to the main body case 312.

The pressing device 343 includes a pressure pump motor 359 as a motor, two lead screws 361 and 362 as conversion members, and an abutment portion 364. The pressure pump motor 359 has a terminal 367 and an output shaft 368 that is rotated in the normal or reverse direction on the basis of power and a control signal that are supplied via the terminal 367. The pressure pump motor 359 is fixed to the main body case 312 in such a manner that the output shaft 368 is inserted into the gear insertion hole 357 of the bottom plate 348 from below (as viewed in FIG. 3). Since the output shaft 368 is formed with a plurality of grooves, the output shaft 368 functions as a gear.

The lead screws 361 and 362, which have the same shape, have shaft portions 361*a* and 362*a* and follower gears 361*b* and 362*b*, respectively. Central portions of the shaft portions 361*a* and 362*a* are formed with male threads in the same direction.

Top portions and bottom portions of the shaft portions 361*a* and 362*a* are not formed with male threads, and the top portions are inserted in the respective small-diameter holes 354 and 355 of the top plate 347 and supported by the top plate 347 rotatably. The bottom portions of the shaft portions 361*a* and 362*a* are supported by the lead screw support portions of the bottom plate 348 also rotatably. That is, the lead screws 361 and 362 can be rotated on their axes in a state that their top portions and bottom portions are supported by the top plate 347 and the bottom plate 348.

The follower gears 361*b* and 362*b* are located under and are integral with the respective shaft portions 361*a* and 362*a*. The follower gears 361*b* and 362*b* are in mesh with a two-step gear 363 disposed between them.

More specifically, the two-step gear 363 is composed of a top-step gear portion 363*a* and a bottom step gear portion 363*b* that are arranged in this order downward (as viewed in FIG. 3) and are integral with each other. The top-step gear portion 363*a* is laid on the bottom-step gear portion 363*b* in the vertical direction in such a manner that their rotation centers coincide with each other, and they are supported via a support member (not shown) so as to be rotatable with respect to the bottom plate 348.

The top-step gear portion 363*a* is larger in diameter than the bottom-step gear portion 363*b* and is engaged with the output shaft 368 of the pressure pump motor 359. The bottom-step gear portion 363*b* is engaged with the follower gears 361*b* and 362*b* of the lead screws 361 and 362. Therefore, the lead screws 361 and 362 are rotated by the output shaft 368 via the two-step gear 363 as the pressure pump motor 359 rotates.

In this embodiment, when the pressure pump motor 359 rotates in the normal direction, the two-step gear 363 is rotated in the reverse direction and the follower gears 361*b* and 362*b* are rotated in the normal direction. When the pressure pump motor 359 rotates in the reverse direction, the two-step gear 363 is rotated in the normal direction and the follower gears 361*b* and 362*b* are rotated in the reverse direction.

The abutment portion 364 has a plate shape and is disposed parallel with the top plate 347 and the bottom plate 348. The abutment portion 364 is formed, at the center, with a first cylindrical projection 371 that is generally cylindrical and projects upward. The first cylindrical projection 371 is formed, at the center, with a through-hole 373 that penetrates through the top portion of the first cylindrical projection 371.

The top surface of the top portion of the first cylindrical projection 371 is formed with an annular projection 375 that surrounds the through-hole 373. A cylindrical portion 376 projects from the bottom surface of the top portion of the first cylindrical projection 371 so as to surround the through-hole 373. The cylindrical portion 376 is formed with annular steps 376*a* that are parallel with the top plate 347 and the bottom plate 348. The bottom step of the annular steps 376*a* is smaller in diameter than the top step. The cylindrical portion 376 is fitted with one end of the pressure tube 337 by tight fitting, and the steps 376*a* restrict upward movement of the pressure tube 337.

The abutment portion 364 has a pair of, that is, right and left, cylindrical engagement portions 377 and 378 on both sides of the first cylindrical projection 371. Female thread holes 377*a* and 378*a* penetrate through the respective cylindrical engagement portions 377 and 378. The inner circumferential surfaces of the female thread holes 377*a* and 378*a* are formed with female threads in the same direction. A lever push-up portion 379 extends rightward from the right-hand cylindrical engagement portion 378 (as viewed in FIG. 1).

The above-configured abutment portion 364 is supported in such a manner that the male threads of the shaft portions 361*a* and 362*a* of the lead screws 361 and 362 are engaged with the female threads of the female thread holes 377*a* and 378*a*, respectively. The abutment portion 264 is moved upward (as viewed in FIG. 3) as the lead screws 361 and 362 are rotated in the normal direction. The abutment portion 364 is moved downward (as viewed in FIG. 3) as the lead screws 361 and 362 are rotated in the reverse direction. That is, the abutment portion 364 is moved linearly in the vertical direction as the lead screws 361 and 362 make rotational movements.

The air chamber 345 has a bellows member 381, a first sealing member 383, a guide member 385, and a second sealing member 387. The bellows member 381 generally takes the form of a hollow cylinder and has a closed top and a bottom circular opening 381*a*. The side wall of the bellows member 381 has a plurality of folds and is thus in a bellows shape. Therefore, the bellows member 381 contracts in the vertical direction when pressed from above and below in a sandwiched manner. In this manner, the capacity of the bellows member 381 increases or decreases as it expands or contracts. The bellows member 381 is formed by blow-molding resin or the like.

The outer diameter of the top portion of the bellows member 381 is larger than the inner diameter of the large-diameter hole 353 of the top plate 347. The top portion of the bellows member 381 is fixed to the top plate 347 by engaging the topmost one of the plurality of folds with the large-diameter hole 353.

The first sealing member 383 is made of an elastic material such as rubber and has an annular shape. The outer diameter of the first sealing member 383 is slightly larger than the inner diameter of the opening 381*a* of the bellows member 381. As shown in FIG. 3, the first sealing member 383 is fitted in the opening 381*a* by tight fitting.

As shown in FIGS. 3 and 4, the guide member 385 is disposed parallel with the top plate 347 and the bottom plate 348. A second cylindrical projection 389 is provided at the center of the guide member 385 so as to project upward. The second cylindrical projection 389 has a large-diameter portion 391 and a small-diameter portion 393 that are arranged in this order upward. The inner diameter of the large-diameter portion 391 is slightly larger than the outer diameter of the first cylindrical projection 371 of the abutment portion 364. The outer diameter of the large-diameter portion 391 is slightly larger than the outer diameter of the first sealing member 383.

The small-diameter portion 393 is smaller in diameter than the large-diameter portion 391, and its top wall is formed with a through-hole 393*a* that penetrates through the top wall. The above-configured guide member 385 is fixed to the first sealing member 383 in such a manner that the large-diameter portion 391 is inserted in the first sealing member 383 by tight fitting.

The second sealing member 387 is generally cylindrical and is made of an elastic material such as rubber. The outer diameter of the second sealing member 387 is slightly larger than the inner diameter of the small-diameter portion 393 of the guide member 385, whereby the second sealing member 387 is fitted in the small-diameter portion 393 by tight fitting. The inner diameter of the second sealing member 387 increases upward, whereby a diffuser hole 387*a* as the hole of a communication member is formed. The diffuser hole 387*a* communicates with the through-hole 393*a* of the small-diameter portion 393 in a state that the second sealing member 387 is fitted in the small-diameter portion 393. The second sealing member 387 has a close contact portion 387*b* as an annual contact portion that projects downward so as to surround the bottom opening of the diffuser hole 387*a*.

As described above, the air chamber 345, that is, the bellows member 381, the first sealing member 383, the guide member 385, and the second sealing member 387, form an inner space S that communicates with the outside only through the diffuser hole 387*a* of the second sealing member 387. The capacity of the inner space S increases or decreases as the bellows member 381 expands or contracts.

In the air chamber 345, the first cylindrical projection 371 of the abutment portion 364 is fitted in the large-diameter portion 391 of the guide member 385 by loose fitting. In this state, the diffuser hole 387*a* of the second sealing member 387 contains the through-hole 373 of the abutment portion 364 in a vertically projected view. The guide member 385 is supported so as to be movable in the vertical direction with respect to the abutment portion 364.

Therefore, when the abutment portion 364 is moved relatively to the guide member 385 in such a direction as to contact the guide member 385, that is, upward, the annular projection 375 of the abutment portion 364 comes into close contact with the close contact portion 387*b*. As a result, the inner space S communicates with the pressure tube 337 airtightly through the through-hole 373 etc. When the abutment portion 364 is moved relatively to the guide member 385 in such a direction as to go away from the guide member, that is, downward, the annular projection 375 of the abutment portion 364 separates from the close contact portion 387*b*. As a result, the inner space S communicates with the outside (i.e., atmosphere) through the gap between the large-diameter portion 391 of the guide member 385 and the first cylindrical projection 371 of the abutment portion 364.

In this embodiment, in the state that the abutment portion 364 is located at the position of FIG. 3, the bellows member 381 no longer expands in the vertical direction. In this state, the annular projection 375 of the abutment portion 364 is in close contact with the close contact portion 387*b* and the inner space S communicates with the pressure tube 337 airtightly.

Figure 5:
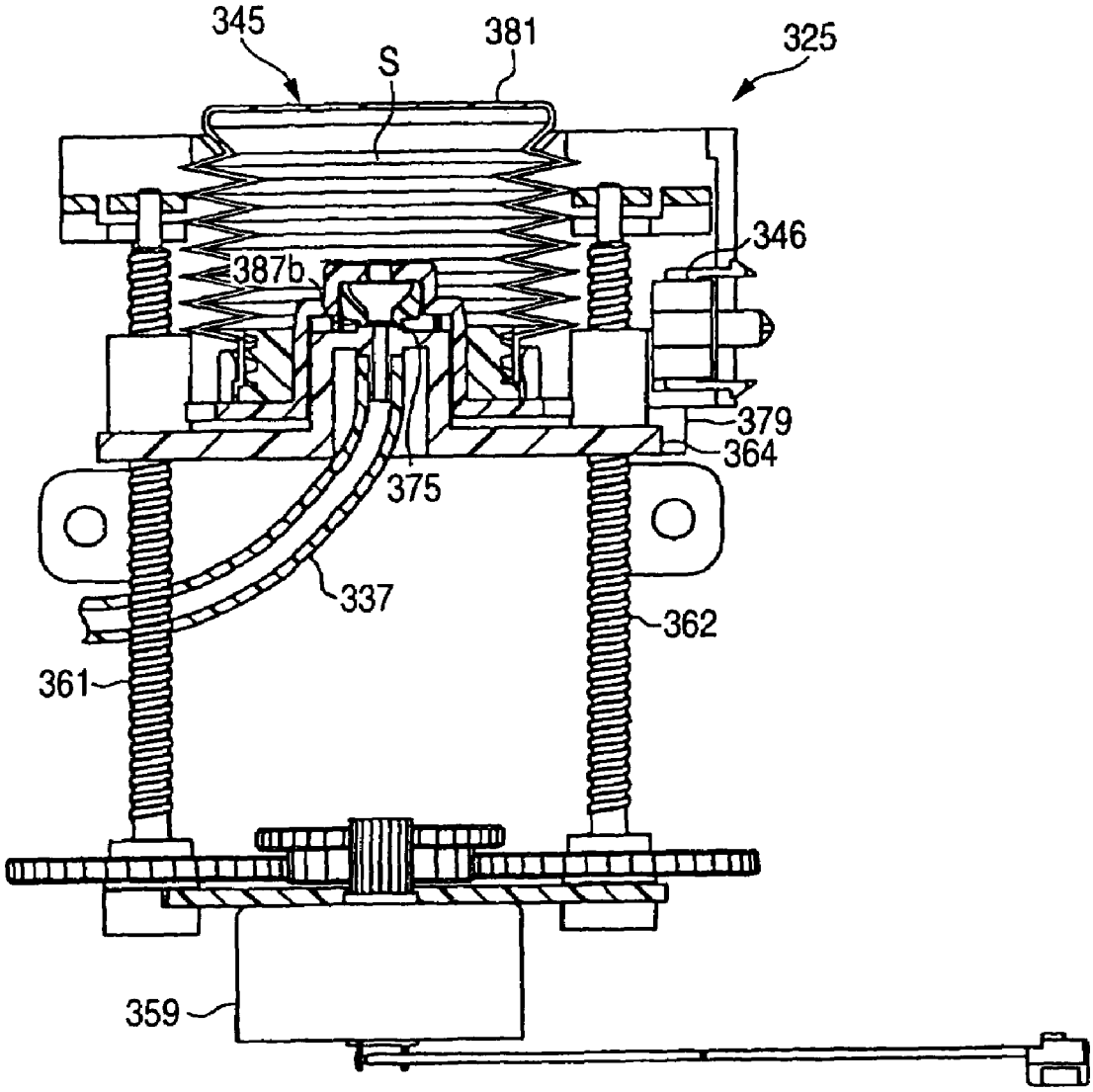
FIGS. 5 and 6 illustrate workings of the pressure pump of according to the first embodiment.
Figure 6:
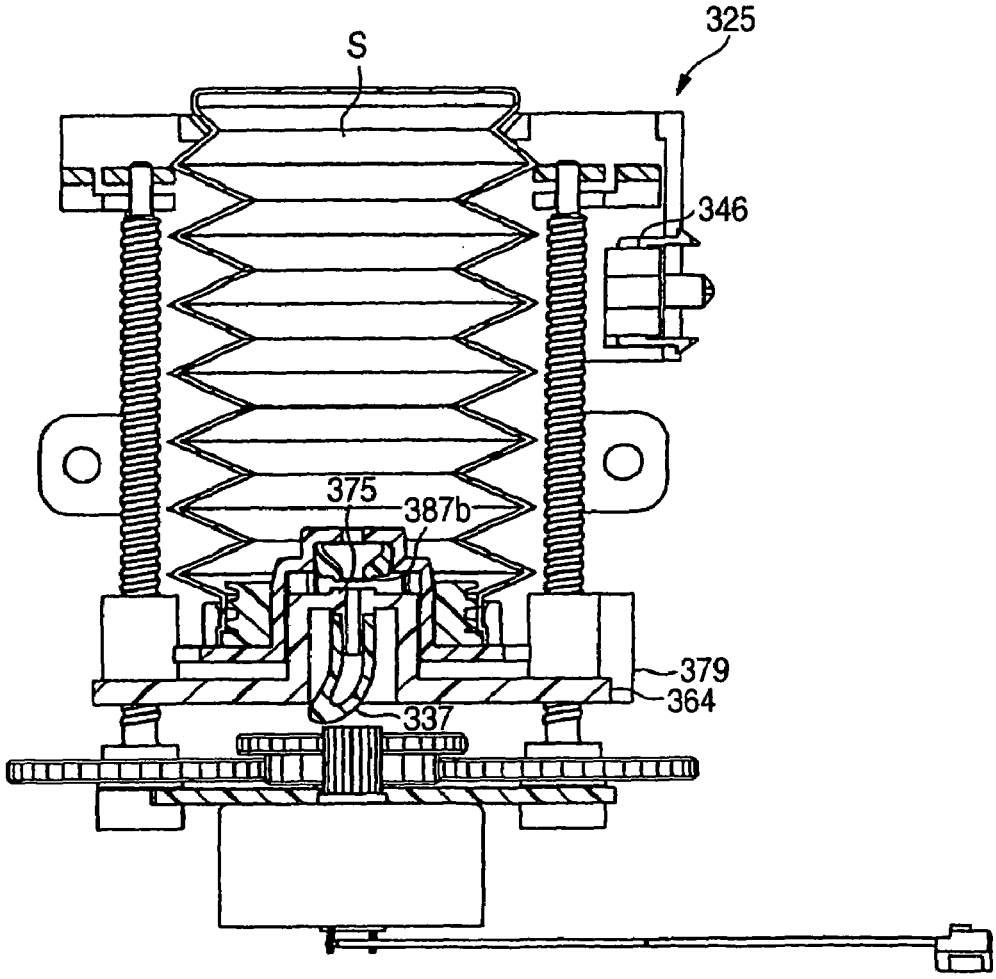

Also in a state that, as shown in FIG. 5, the abutment portion 364 is located above the position of FIG. 3, the bellows member 381 generates recovery force in such a direction as to expand itself in the vertical direction, whereby the annular projection 375 of the abutment portion 364 is in close contact with the close contact portion 387*b* and the inner space S communicates with the pressure tube 337 airtightly. On the other hand, in a state that, as shown in FIG. 6, the abutment portion 364 is located under the position of FIG. 3, since the bellows member 381 can no longer expand from the state of FIG. 3, only the abutment portion 364 has been moved downward and hence is separated from the guide member 385. As a result, the annular projection 375 of the abutment portion 364 is separated from the close contact portion 387*b* and the inner space S communicates with the outside (i.e., atmosphere) through the gap between the large-diameter portion 391 of the guide member 385 and the first cylindrical projection 371 of the abutment portion 364.

As shown in FIGS. 3 and 4, the detecting portion 346 is supported by a support plate 347*a* that extends downward from the top plate 347. As shown in FIG. 4, the detecting portion 346 has a rotary shaft 395 that is perpendicular to the axes of the lead screws 361 and 362 and a lever 397 that is swung on the rotary shaft 395. The lever 397 overlaps, in a vertically projected view, with the lever push-up portion 379 that is provided on the abutment portion 364. The lever 397 extends horizontally when it receives no external force.

When the lever 397 is swung upward by upward force, the detecting portion 346 outputs an on-signal. Therefore, the detecting portion 346 outputs an on-signal as a result of an operation that, as shown in FIG. 5, the lever push-up portion 379 touches the lever 397 (see FIG. 4) of the detecting portion 346 and then the lever 397 is swung upward as the abutment portion 364 is moved upward. The detecting portion 346 does not output an on signal, as shown in FIGS. 3 and 6, when the abutment portion 364 is located at a low position and the lever push-up portion 379 is not in contact with the lever 397 (see FIG. 4) of the detecting portion 246.

In this embodiment, the detecting portion 346 and the lever push-up portion 379 constitute a sensor as a capacity detector.

The pressure pump 325 having the above structure operates in the following manner. When the pressure pump motor 359 is rotated in the normal direction starting from the state of FIG. 3, the abutment portion 364 is elevated along the lead screws 361 and 362 to establish the state of FIG. 5 in which the annular projection 375 of the abutment portion 364 is in close contact with the close contact portion 387*b* of the air chamber 345 (this state is maintained). The bellows member 381 contracts and the capacity of the inner space S of the air chamber 345 decreases. As a result, the capacity of the air chamber 345, the pressure tube 337, the air supply tubes 339 (see FIG. 1), and the spaces 333 (see FIG. 2) of the ink cartridges 323 combined decreases while they are kept airtight, and the inside air pressure increases.

As the pressure of the space 333 of each ink cartridge 323 increases, the ink pack 332 (see FIG. 2) is crushed and ink is supplied from the ink pack 332 to the corresponding valve unit 321 (see FIG. 1).

On the other hand, when the abutment portion 364 of the pressure pump 325 is elevated to the position of FIG. 5, the lever push-up portion 379 of the abutment portion 364 touches the lever 397 (see FIG. 4) of the detecting portion 346 and the lever 397 is swung upward. The detecting portion 346 outputs an on-signal.

As the pressure pump motor 359 is rotated in the reverse direction and the abutment portion 364 of the pressure pump 325 is lowered along the lead screws 361 and 362, the capacity of the inner space S of the air chamber 345 increases while the annular projection 375 of the abutment portion 364 is kept in close contact with the close contact portion 387*b* of the air chamber 345 as shown in FIG. 3. As a result, the capacity of the air chamber 345, the pressure tube 337, the air supply tubes 339, and the spaces 333 of the ink cartridges 323 increases while they are kept airtight. The inside air pressure decreases and no pressurizing force acts on the ink packs 332. Inks stop flowing from the ink packs 332 to the valve units 321.

When the pressure pump motor 359 is rotated in the reverse direction starting from the state of FIG. 3 and the abutment portion 364 of the pressure pump 325 is lowered along the lead screws 361 and 362, the annular projection 375 of the abutment portion 364 is separated from the close contact portion 387*b* of the air chamber 345. As a result, air flows into the air chamber 345, the pressure tube 337, the air supply tubes 339, and the spaces 333 of the ink cartridges 323 through the gap between the annular projection 375 and the close contact portion 387*b*. The pressure in those members is lowered to atmospheric pressure.

The pressure pump 325 repeats the above operation as the pressure pump motor 359 is rotated in the normal and reverse directions. As the pressure pump 325 operates in the above manner, the pressure of the spaces 333 of the ink cartridges 323 is varied and inks are supplied from the ink cartridges 323 to the valve units 321. Inks whose pressures have been adjusted by the valve units 321 are ejected from the recording head 320.

Next, an electrical configuration of the above-configured ink-jet recording apparatus 311 will be described with reference to FIG. 7.

Figure 7:
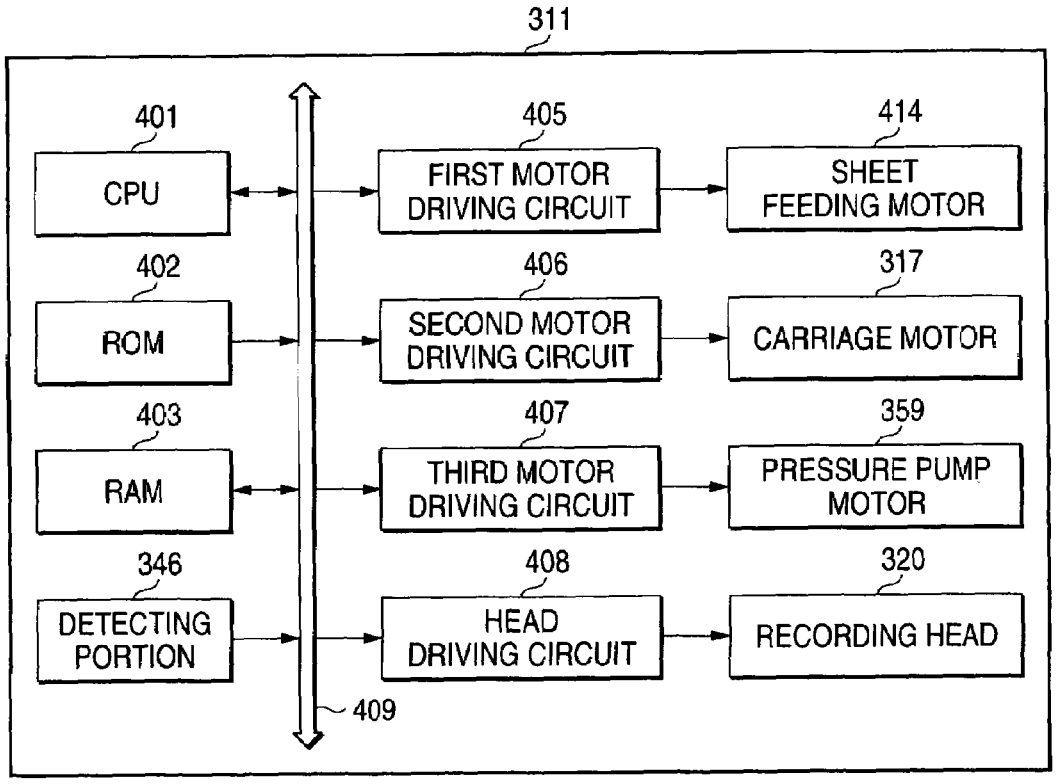
FIG. 7 is a block diagram showing an electrical configuration of the ink-jet recording apparatus according to the first embodiment.

As shown in FIG. 7, the ink-jet recording apparatus 311 includes a CPU 401 as a controller, a ROM 402, and a RAM 403. The ink-jet recording apparatus 311 also includes the detecting portion 346, a first motor driving circuit 405, a second motor driving circuit 406, a third motor driving circuit 407, and a head driving circuit 408. All of the above components are connected to each other via a bus 409.

The CPU 401 receives an on-signal from the detecting portion 346. The CPU 401 is connected, via the first motor driving circuit 405, to a sheet feeding motor 414 for driving the sheet feeding device, and outputs a drive control signal for its drive control.

The CPU 401 is connected to the carriage motor 317 via the second motor driving circuit 406, and outputs a drive control signal for its drive control.

Further, the CPU 401 is connected to the pressure pump motor 359 via the third motor driving circuit 407, and outputs a drive control signal for rotating the pressure pump motor 359 in the normal or reverse direction. Still further, the CPU 401 is connected to the recording head 320 via the head driving circuit 408, and outputs, to nozzle driving bodies (not shown), nozzle drive signals for causing the nozzles of the recording head 320 to eject inks.

The CPU 401 operates according to various programs stored in the ROM 402, and temporarily stores processing results in the RAM 403. More specifically, an air pressurization program and other programs are stored in the ROM 402.

The air pressurization program is a program for stopping output of nozzle drive signals to the recording head 320 via the head driving circuit 408 when the CPU 401 has received an on-signal from the detecting portion 346. The air pressurization program also serves to lower the abutment portion 364 of the pressure pump 325 by rotating the pressure pump motor 359 in the reverse direction via the third motor driving circuit 407 when the CPU 401 has received an on-signal from the detecting portion 346.

The air pressurization program serves to cause the sheet feeding device to feed a recording medium by driving the sheet feeding motor 414 via the first motor driving circuit 405 when the CPU 401 starts to rotate the pressure pump motor 359 in the reverse direction. Further, the air pressurization program serves to supply the pressure pump motor 359 with a drive signal for rotating it in the normal direction when the CPU 401 has driven the pressure pump motor 359 until the annular projection 375 of the abutment portion 364 is separated from the close contact portion 387*b*. Still further, the air pressurization program serves to supply nozzle drive signals to the recording head 320 as the pressure pump motor 359 is rotated in the normal direction.

Therefore, when receiving an on-signal from the detecting portion 346, according to the air pressurization program the CPU 401 stops output of nozzle drive signals to the recording head 320. According to the air pressurization program, the CPU 401 supplies a drive signal to the pressure pump motor 359 to rotate it in the reverse direction.

After supplying the drive signal to the pressure pump motor 359 to rotate it in the reverse direction, according to the air pressurization program the CPU 401 drives the sheet feeding motor 414 and causes the sheet feeding device to feed a recording medium. When the abutment portion 364 has lowered by the reverse rotation of the pressure pump motor 359 until the annular projection 375 is separated from the close contact portion 387*b* in the pressure pump 325, according to the air pressurization program the CPU 401 drives the pressure pump motor 359 in the normal direction. Further, according to the air pressurization program, the CPU 401 supplies nozzle drive signals to the recording head 320.

That is, in the ink-jet recording apparatus 311 according to this embodiment, during printing, the CPU 401 drives the pressure pump motor 359 via the third motor driving circuit 407 so as to rotate it in the normal direction, whereby pressurized air is formed in the pressure pump 325. As a result, the air in the spaces 333 of the ink cartridges 323 is pressurized and inks are supplied from the ink packs 332 to the valve units 321. Inks whose pressures have been adjusted in the valve units 321 are ejected from the recording head 320 as ink jets and stuck to a recording medium, that is, printing is performed.

When the abutment portion 364 of the pressure pump 325 has been elevated and the lever 397 of the detecting portion 346 has been swung by the lever push-up portion 379 of the abutment portion 364 (see FIG. 5), the detecting portion 346 outputs an on-signal to the CPU 401. When receiving the on-signal, first the CPU 401 stops the output of nozzle drive signals to the recording head 320 according to the air pressurization program. As a result, the recording head 320 stops ejecting inks.

In this state, the CPU 401 supplies a drive signal to the pressure pump motor 359 according to the air pressurization program, whereupon the pressure pump motor 359 starts to be rotated in the reverse direction. As a result, the abutment portion 364 of the pressure pump 325 is lowered and the capacity of the inner space S of the air chamber 345 of the pressure pump 325 is increased. The pressure of the spaces 333 of the ink cartridges 323 is decreased and inks stop flowing from the ink packs 332 to the valve units 321.

At this time, if the recording head 320 attempted to eject inks, empty ink ejection might occur due to an ink shortage because of ejection, from the recording head 320, of all the ink that was temporarily stored in a valve unit 321. This embodiment is free of such a phenomenon because the ejection of inks from the recording head 320 is stopped.

In this state, according to the air pressurization program, the CPU 401 drives the sheet feeding motor 414 to cause the sheet feeding device to feed a recording medium. As a result, a recording medium is fed while the ejection of inks is stopped, which contributes to shortening of the printing time and increase of the efficiency of printing.

Then, the pressure pump motor 359 is rotated in the reverse direction and the abutment portion 364 is lowered until the annular projection 375 of the pressure pump 325 is separated from the close contact portion 387*b* as shown in FIG. 6, whereby air is introduced through the gap between the annular projection 375 and the close contact portion 387*b*. As a result, the pressure of the inner space S of the air chamber 345 and the pressure of the spaces 333 of the ink cartridges 323 are made equal to atmospheric pressure.

When the pressure of the inner space S of the air chamber 345 and the pressure of the spaces 333 of the ink cartridges 323 have been made equal to atmospheric pressure, the CPU 401 starts to drive the pressure pump motor 359 in the normal direction according to the air pressurization program. Also, the CPU 401 starts to output nozzle drive signals to the recording head 320 according to the air pressurization program. As a result, the pressure of the air in the spaces 333 of the ink cartridges 323 is increased by the pressure pump 325, whereby inks are supplied from the ink packs 332 to the valve units 321. As the recording head 320 is driven, inks are supplied from the valve units 321 to the recording head 320 and inks are ejected from the recording head 320 to a recording medium. In the ink-jet recording apparatus 311 according to this embodiment, the above operation is repeated as long as the printing continues. The printing can thus be performed efficiently.

In the ink-jet recording apparatus 311 according to this embodiment, in a halt period in which printing is not performed, the pressure pump 325 is in a state that the abutment portion 364 is at a low position where the annular projection 375 is separated from the close contact portion 387*b* (see FIG. 6). Therefore, in a printing halt period, the pressure of the inner space S of the air chamber 345 and the pressure of the spaces 333 of the ink cartridges 323 are kept equal to atmospheric pressure.

Therefore, in this state, the ink cases 331 of the ink cartridges 323 are prevented from expansion and hence the ink cartridges 323 can easily be removed from the cartridge holder 312*a*. Further, an event can be prevented that ink leaks from the ink outlet 332*a* or the like when a cartridge 323 is removed from the cartridge holder 312*a*.

This embodiment provides the following advantages:

(1) In this embodiment, the bellows member 381 of the air chamber 345 is contracted as the abutment portion 364 is moved upward, whereby the capacity of the inner space S of the air chamber 345 is decreased. As a result, the pressure of the air existing from the air chamber 345 to the spaces 333 of the ink cartridges 323 is increased and the pressure pump 325 is rendered in a pressurized state. The ink packs 332 of the ink cartridges 323 are crushed, inks are supplied from the ink pack 332 to the valve unit 321, and inks are ejected from the recording head 320.

The bellows member 381 of the air chamber 345 is expanded as the abutment portion 364 is moved downward, whereby the capacity of the inner space S of the air chamber 345 is increased. As a result, the pressure of the air existing from the inner space S of the air chamber 345 to the spaces 333 of the ink cartridges 323 is decreased and the pressure pump 325 is rendered in a non-pressurized state. Further, the annular projection 375 of the abutment portion 364 is separated from the close contact portion 387*b*, whereby air flows into the inner space S of the air chamber 345 and the spaces 333 of the ink cartridges 323. The pressure of the air existing from the inner space S of the air chamber 345 to the spaces 333 of the ink cartridges 323 is made approximately equal to atmospheric pressure.

In the state that the pressure of the air existing from the inner space S of the air chamber 345 to the spaces 333 of the ink cartridges 323 is approximately equal to atmospheric pressure, the ink cases 331 of the ink cartridges 331 do not expand. If settings are made so that an ink cartridge 323 should be attached to or removed from the cartridge holder 312*a* of the ink-jet recording apparatus 311 in such a state, the ink cartridge 323 can easily be attached or removed. An event can be prevented ink leaks from the ink outlet 332*a* of the ink pack 332 in attaching or removing an ink cartridge 323.

That is, in this embodiment, the pressure pump 325 can be rendered in the pressurized state or the non-pressurized state and the pressure of the air existing from the inner space S of the air chamber 345 to the spaces 333 of the ink cartridges 323 can be made approximately equal to atmospheric pressure by varying the vertical position of the abutment portion 364.

To make the pressure of the air existing from the inner space S to the spaces 333 of the ink cartridges 323 approximately equal to atmospheric pressure, it is not necessary to provide a new air release valve such as an electromagnetic valve, which prevents increase in the number of components and complication of the control.

(2) In this embodiment, the capacity of the inner space S of the air chamber 345 is varied by expanding and contracting the bellows member 381. Therefore, the expansion/contraction direction of the air chamber 345 can be made linear and hence the structure of the pressing device 343 for varying the capacity of the air chamber 345 can be simplified.

Since the bellows member 381 is expanded and contracted by weak force, the load for varying the capacity of the air chamber 345 can be reduced.

(3) In this embodiment, the air chamber 345 employs the bellows member 381 that is formed by blow molding. Therefore, the air chamber 345 can be manufactured by a simple manufacturing apparatus for blow molding and hence the manufacturing cost can be reduced.

(4) In this embodiment, the close contact portion 387*b* of the air chamber 345 that is the portion to be brought in contact with the abutment portion 364 is made of an elastic material. This increases the closeness of the contact between the air chamber 345 and the abutment portion 364 and hence the occlusiveness of the inner space S of the air chamber 345 when the pressure pump 325 is in the pressurized state. The airtightness can thus be increased in the pressurized state.

(5) In this embodiment, the pressing device is composed of the pressure pump motor 359, the lead screws 361 and 362, and the abutment portion 364. With this structure, rotational motion of the pressure pump motor 359 is converted into linear motion by the lead screws 361 and 362, which can make the pressure pump 325 compact as a whole. The direction of linear motion of the abutment portion 364 can be changed and the pressure pump 325 can be rendered in the pressurized state or the non-pressurized state merely by controlling rotation direction of the pressure pump motor 359. This makes the control easier.

(6) In this embodiment, the lead screws 361 and 362 are used as the conversion members. Being more compact than a cam mechanism, the lead screws 361 and 362 makes the pressure pump 325 more compact than in the case where a cam mechanism is used as a conversion member.

(7) In this embodiment, the pressing device 343 of the pressure pump 325 has the two lead screws 361 and 362. Therefore, the abutment portion 364 of the pressing device 343 is moved in the vertical direction along the two lead screws 361 and 362. As a result, the bellows member 381 can be expanded and contracted stably without suffering from buckling or the like.

(8) In this embodiment, the pressure pump 325 has the detecting portion 346 and the lever push-up portion 379, and the CPU 401 outputs an on-signal when the lever 397 of the detecting portion 346 is swung by the lever push-up portion 379 as a result of elevation of the abutment portion 364. When receiving an on-signal, the CPU 401 control the pressure pump motor 359 according to the air pressurization program to cause it to rotate in the reverse direction. Then, the CPU 401 control the pressure pump motor 359 to cause it to rotate in the normal direction.

Therefore, the CPU 401 can judge, on the basis of an on-signal from the detecting portion 346, whether the capacity of the inner space S of the air chamber 345 has become smaller than a prescribed value as a result of contraction of the air chamber 345. On the basis of an on-signal from the detecting portion 346, the CPU 401 causes the pressure pump motor 359 to rotate in the reverse direction and to rotate thereafter in the normal direction. This allows the pressure pump 325 to generate pressurized air successively. This prevents maintenance of a state that the air chamber 345 has been contracted fully and the capacity of the inner space S of the air chamber 345 has been minimized to establish a state that the pressure pump 325 can not generate pressurized air any more.

(9) In this embodiment, the detecting portion 346 and the lever push-up portion 379 of the pressure pump 325 make it possible to judge whether the capacity of the inner space S of the air chamber 345 has become smaller than the prescribed value. Therefore, the capacity of the inner space S of the pressure pump 325 can be detected roughly by the simple structure.

(10) In this embodiment, when the fact that the capacity of the inner space S of the air chamber 345 has become smaller than the prescribed value has been detected by the detecting portion 346 and the lever push-up portion 379, according to the air pressurization program the CPU 401 controls the recording head 320 so as to stop its driving. Therefore, when a state has been established that the capacity of the inner space S of the air chamber 345 has become smaller than the prescribed value and inks can not be supplied from the ink packs 332 to the valve units 321 any more, the driving of the recording head 320 is stopped. This prevents empty ink ejection of the recording head 320 due to an ink shortage of a valve unit 321.

(11) In this embodiment, when receiving an on-signal from the detecting portion 346, the CPU 401 stops driving the recording head 320 and controls the driving of the sheet feeding motor 414 according to the air pressurization program to cause the sheet feeding device to feed a recording medium. Therefore, a recording medium is fed by the sheet feeding device while the ejection of inks toward a recording medium is stopped, which contributes to increase of the efficiency of printing.

Second Embodiment

Figure 8:
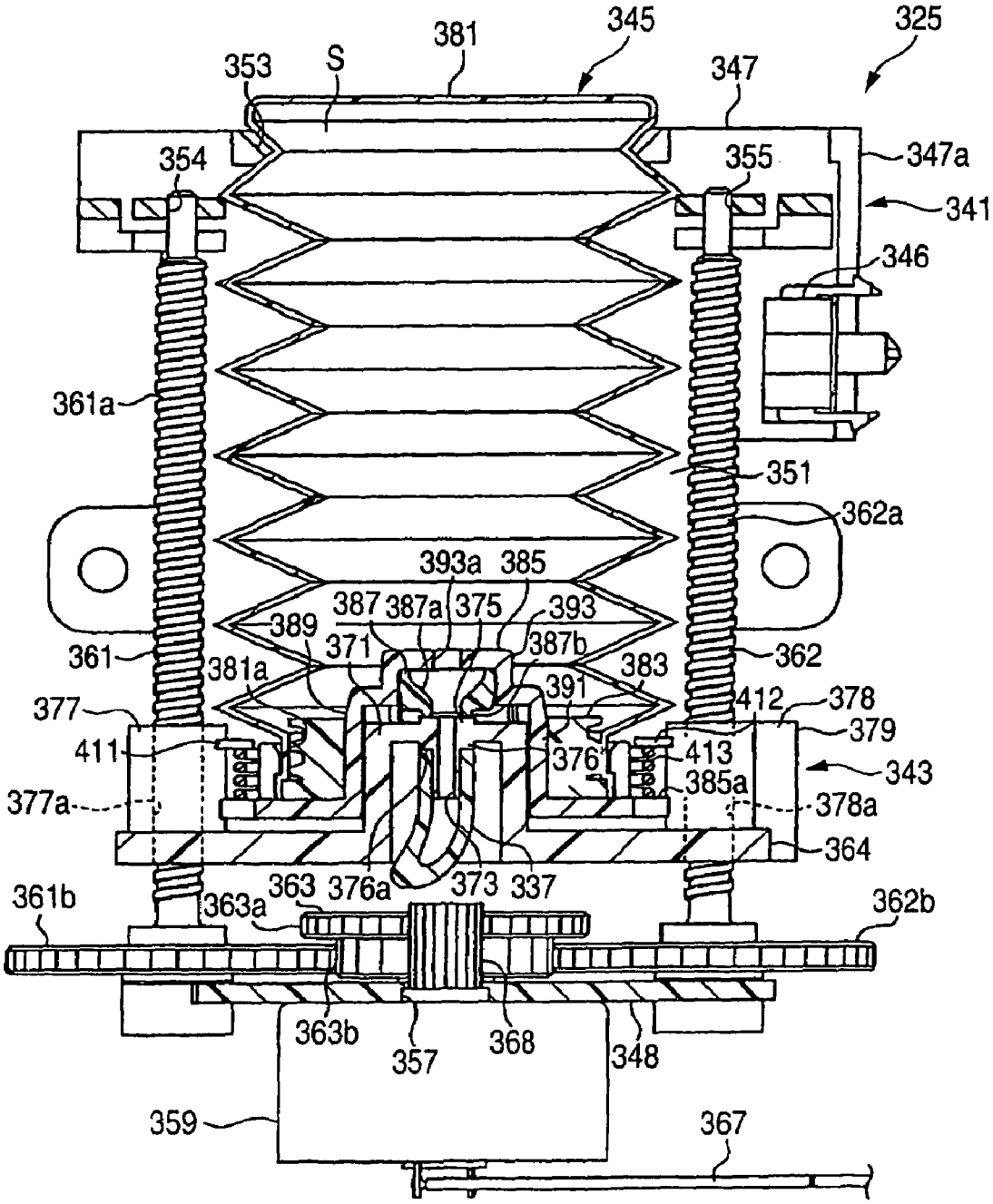
FIG. 8 is a sectional view of a pressure pump according to a second embodiment.
Figure 9:
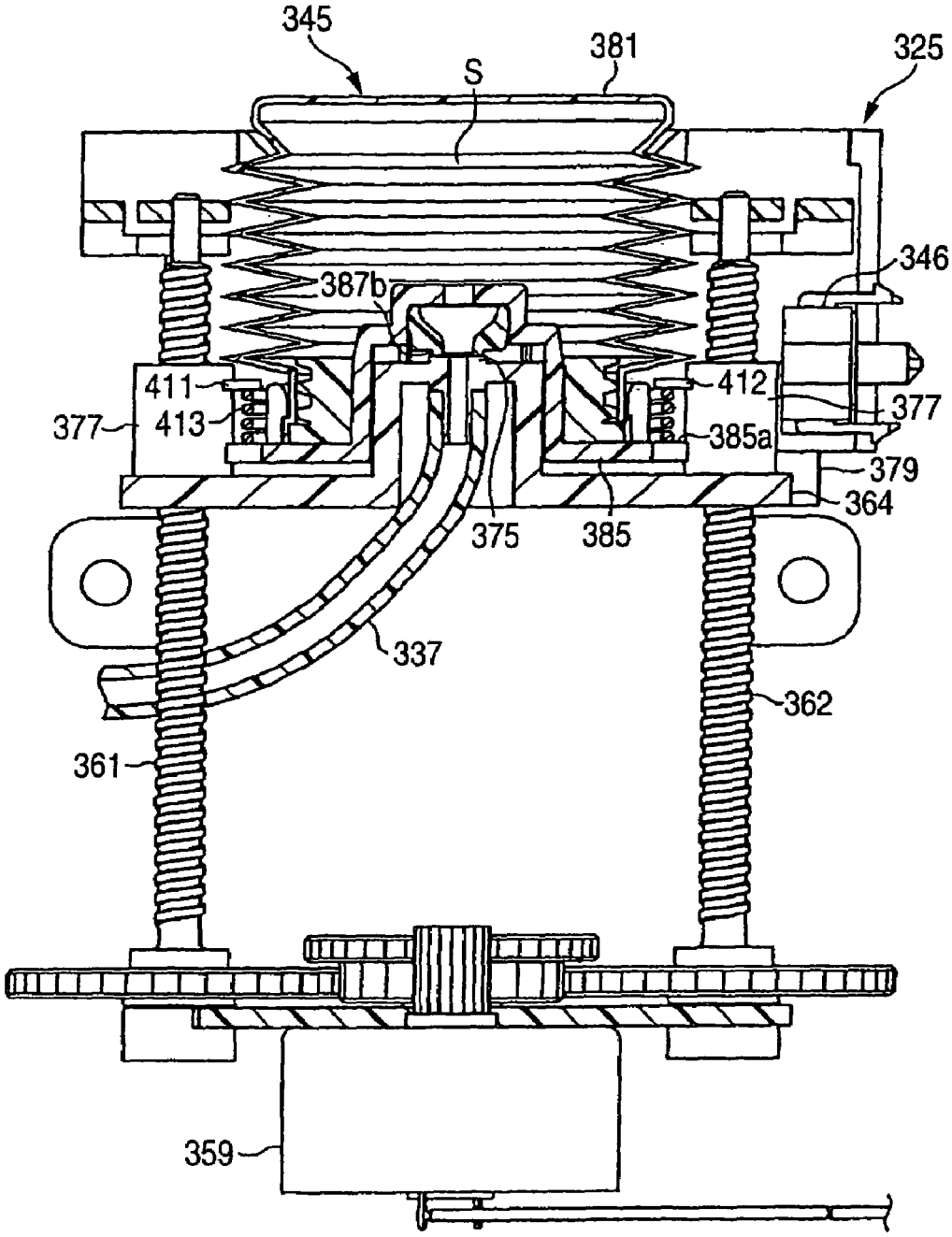
FIGS. 9 and 10 illustrate workings of the pressure pump according to the second embodiment.
Figure 10:
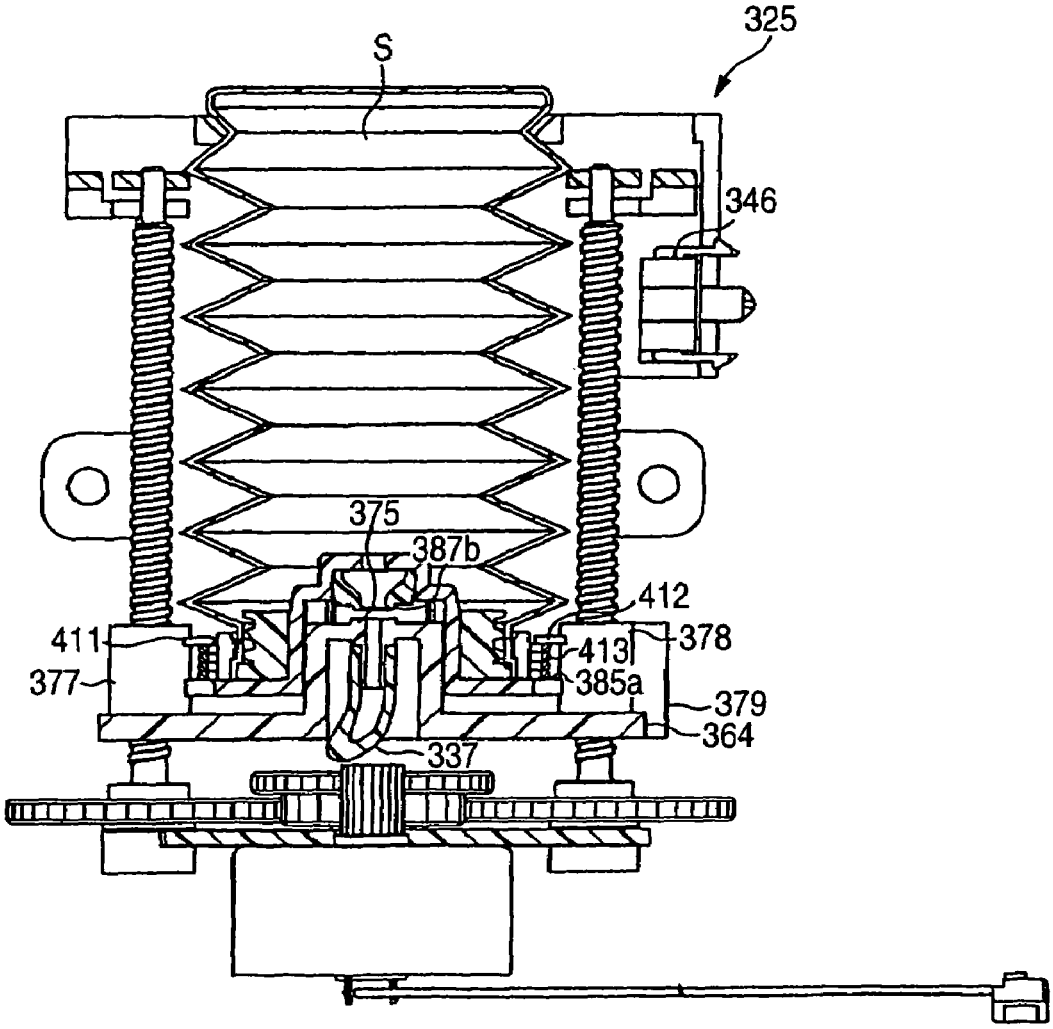

Next, a second embodiment of the invention will be described with reference to FIGS. 8-10. This embodiment is the same in configuration as the first embodiment except that an urging member is provided between the air chamber 345 and the pressing device 343 of the first embodiment. Therefore, in this embodiment, for the convenience of description, only the different points from the first embodiment will be described in detail and the other points will not be described with the components having the same components in the first embodiment given the same reference symbols as the latter. FIG. 8 is a sectional view of a pressure pump 325 according to this embodiment that corresponds to FIG. 3 that relates to the first embodiment. FIGS. 9 and 10 illustrate workings of the pressure pump 325 according to this embodiment that correspond to FIGS. 5 and 6, respectively, that relates to the first embodiment.

As shown in FIG. 8, engagement projections 411 and 412 extend from the side surfaces of the pair of cylindrical engagement portions 377 and 378 which are provided on the abutment portion 364 of the pressing device 343. The engagement projections 411 and 412 extend toward the first cylindrical projection 371 which is provided at the center of the abutment portion 364 in such a manner that the bottom surfaces of the engagement projections 411 and 412 are opposed to a peripheral portion 385*a* of the top surface of the guide member 385 of the air chamber 345.

A coil spring 413 as an urging member is provided on the peripheral portion 385*a* of the top surface of the guide member 385 so as to surround the outer circumference of the opening 381*a* of the bellows member 381. The bottom end of the coil spring 413 is engaged with the peripheral portion 385*a* and the top end of the coil spring 413 is engaged with the engagement projections 411 and 412.

The coil spring 413 will be described below in detail. The coil spring 413 is provided so as to expand in the vertical direction and thereby exert elastic force on the peripheral portion 385*a* and the engagement projections 411 and 412 in the state that, as shown in FIG. 8, the pressing device 343 (i.e., abutment portion 364) is located at such a position that the bellows member 381 cannot expand in the vertical direction any more. When the pressing device 343 (i.e., abutment portion 364) is lowered from the position of FIG. 8 to the position of FIG. 10, the coil spring 413 is contracted because the bellows member 381 cannot expand in the vertical direction any more.

That is, when the pressing device 343 (i.e., abutment portion 364) is located at or above the position of FIG. 8, the coil spring 413 pushes down the guide member 385 so as to keep the state that the annular projection 375 of the abutment portion 364 is in close contact with the close contact portion 387*b* of the air chamber 345. Therefore, when the pressing device 343 is located at or above the position of FIG. 8 (e.g., the position of FIG. 9), not only the recovery force of the bellows member 381 that tends to expand in the vertical direction but also the elastic force of the coil spring 413 acts on the annular projection 375 of the abutment portion 364 via the close contact portion 387*b*.

When the abutment portion 364 is lowered from the position of FIG. 9 to the position of FIG. 8, the capacity of the inner space S of the air chamber 345 increases while the annular projection 375 of the abutment portion 364 is kept in close contact with the close contact portion 387*b* of the air chamber 345 by the above-mentioned recovery force and elastic force. And the capacity of the air chamber 345, the pressure tube 337, and the air supply tubes 339, and the spaces 333 of the ink cartridges 323 combined increases while it is kept airtight. As a result, the pressure of the air in that space decreases, the application of the pressurizing force to the ink packs 332 is stopped, and inks stop flowing from the ink packs 332 to the valve units 321.

On the other hand, when the abutment portion 364 is moved from the position of FIG. 8 to the low position of FIG. 10, the coil spring 413 is contracted to establish a state that the annular projection 375 of the abutment portion 364 is separated from the close contact portion 387*b* of the air chamber 345. As a result, air flows into the air chamber 345, the pressure tune 337, the air supply tubes 339, and the spaces 333 of the ink cartridges 323 through the gap between the annular projection 375 and the close contact portion 387*b*, whereby the pressure of that space is lowered to atmospheric pressure.

Next, workings of the above-configured pressure pump 325 will be described.

In the ink-jet recording apparatus 311, in a halt period in which printing is not performed, the pressure pump 325 is position-controlled so as to be in the state that the abutment portion 364 is at the low position where the annular projection 375 is separated from the close contact portion 387*b* (see FIG. 10). That is, as in the case of the first embodiment, the pressure of the inner space S of the air chamber 345 and the pressure of the spaces 333 of the ink cartridges 323 are kept equal to atmospheric pressure. Therefore, in this state, the ink cases 331 of the ink cartridges 323 are prevented from expansion and hence the ink cartridges 323 can easily be removed from the cartridge holder 312*a*. Further, an event can be prevented that ink leaks from the ink outlet 332*a* or the like when a cartridge 323 is removed from the cartridge holder 312*a*.

When the ink-jet recording apparatus 311 has started a printing operation, the pressure pump motor 359 is controlled to as to rotate in the normal direction, whereby the abutment portion 364 is elevated while the annular projection 375 is kept in close contact with the close contact portion 387*b*. As a result, the air in the spaces 333 of the ink cartridges 323 is pressurized and inks are supplied from the ink packs 332 to the valve units 321. Inks whose pressures have been adjusted in the valve units 321 are ejected from the recording head 320 as ink jets and stuck to a recording medium, that is, printing is performed.

The abutment portion 364 of the pressure pump 325 is elevated and the lever 397 of the detecting portion 346 is swung by the lever push-up portion 379 of the abutment portion 364 (see FIG. 9). The ejection of inks from the recording head 320 is stopped in response to an on-signal supplied from the detecting portion 346. Then, the pressure pump motor 359 is rotated in the reverse direction, whereby the abutment portion 364 is lowered. As a result, the capacity of the inner space S of the air chamber 345 of the pressure pump 325 is increased. The pressure of the spaces 333 of the ink cartridges 323 is decreased and inks stop flowing from the ink packs 332 to the valve units 321.

Then, the pressure pump motor 359 is rotated in the reverse direction and the abutment portion 364 is lowered until the annular projection 375 is separated from the close contact portion 387*b* as shown in FIG. 10, whereby air is introduced through the gap between the annular projection 375 and the close contact portion 387*b*. As a result, the pressure of the inner space S of the air chamber 345 and the pressure of the spaces 333 of the ink cartridges 323 are made equal to atmospheric pressure.

When the pressure of the inner space S of the air chamber 345 and the pressure of the spaces 333 of the ink cartridges 323 have been made equal to atmospheric pressure, the driving of the pressure pump motor 359 starts to be controlled so that it will rotate in the normal direction. As described above, since the abutment portion 364 is elevated while the annular projection 385 is kept in close contact with the close contact portion 387*b*, the pressure of the air in the spaces 333 of the ink cartridges 323 is increased by the pressure pump 325, whereby inks are supplied from the ink packs 332 to the valve units 321. At the same time, driving of the recording head 320 is started. Inks are supplied from the valve units 321 to the recording head 320 and inks are ejected from the recording head 320 to a recording medium. In the ink-jet recording apparatus 311, the above operation is thereafter repeated as long as the printing operation continues. The printing can thus be performed efficiently.

After completion of the printing operation, the pressure pump motor 359 of the pressure pump 325 is rotated in the reverse direction and the abutment portion 364 is lowered until the annular projection 375 is separated from the close contact portion 387*b* (see FIG. 10). The pressure pump 325 waits for the next printing operation.

Next, workings of the coil spring 413 will be described.

Assume that the supply of power to the ink-jet recording apparatus 311 was stopped when the abutment portion 364 was located at a position (e.g., the position of FIG. 9) higher than the position of FIG. 8 and the ink-jet recording apparatus 311 has been left in that state for a long time. In such a case, the bellows member 381 would creep and be biased toward the contracted form of FIG. 9. Where the bellows member 381 crept and was so biased, when the abutment portion 364 is elevated from the position of FIG. 10 to the position of FIG. 9 at the start of a printing operation, force occurs in the bellows member 381 in such a direction as to contract it. This force serves to separate the annular projection 375 from the close contact portion 387*b*. Therefore, although the pressure pump motor 359 is rotated in the normal direction, the annular projection 375 does not come into contact with the close contact portion 387*b* and hence no pressurized air is supplied to the spaces 333 of the ink cartridges 323. This may cause an event that inks are not supplied from the ink packs 332 to the valve units 321 and empty ejection occurs in the recording head 320.

However, in this embodiment in which the coil spring 413 is provided, when the abutment portion 364 is located above the position of FIG. 8, the coil spring 413 pushes the guide member 385 downward and hence the state that the annular projection 375 of the abutment portion 364 is in close contact with the close contact portion 387*b* of the air chamber 345 is maintained. Therefore even where the bellows member 381 crept and was biased toward the contracted form, the annular projection 375 can reliably be brought into close contact with the close contact portion 387*b*. As a result, an event can be prevented that no pressurized air is supplied to the ink cartridges 323 or pressurized air is supplied to the ink cartridges 323 insufficiently.

The second embodiment provides the following advantages in addition to the advantages of the first embodiment:

(12) The coil spring 413 that produces elastic force in such a direction that the annular projection 375 of the abutment portion 364 is brought into close contact with the close contact portion 387*b* of the air chamber 345 is disposed between the engagement projections 411 and 412 extending from the cylindrical engagement portions 377 and 378 and the peripheral portion 385*a* of the top surface of the guide member 385.

Therefore, even if the bellows member 381 was left in the same state for a long time and it crept and was biased so as to produce force of separating the annular projection 375 from the close contact portion 387*b*, the annular projection 375 can reliably be brought into close contact with the close contact portion 387*b* by means of the elastic force produced by the coil spring 413.

The above embodiments can be modified in the following manners:

Although in the above embodiments the bellows member 381 of the air chamber 345 is formed by blow molding, it may be formed by other molding methods.

Although in the above embodiments the close contact portion 387*b* of the air chamber 345 is made of an elastic material, it may be made of materials other than elastic materials.

In the above embodiments, the air chamber 345 employs the bellows member 381 having a bellows shape. However, the bellows member 381 may be replaced by members having other shapes as long as they can increase and decrease the capacity of the inner space S of the air chamber 345 and tend to recover in a capacity increasing direction when the capacity has decreased. For example, a rubber ball may be used.

In the above embodiments, the pressure pump 325 employs the lead screws 361 and 362 as the conversion members. However, other conversion members may be used as long as they can convert rotational motion of the pressure pump motor 359 into linear motion. For example, a crank mechanism or a cam may be used as a conversion member.

In the above embodiments, the pressure pump 325 employs the two lead screws 361 and 362. Alternatively, one lead screw or three or more lead screws may be used. Whereas the number of components can be reduced by decreasing the number of lead screws, the bellows member 381 can be expanded and contracted stably by increasing the number of lead screws. When the number of lead screws is changed, the number of cylindrical engagement portions that are provided on the abutment portion 364 should be changed accordingly.

Although in the above embodiments the pressure pump 325 is equipped with the detecting portion 346, the pressure pump 325 may be constructed without using the detecting portion 346.

In the above embodiments, the CPU 401 causes the pressure pump motor 359 to rotate in the reverse or normal direction according to the air pressurization program on the basis of an on-signal supplied from the detecting portion 346. Alternatively, the CPU 401 may be configured so as to be able to control, irrespective of input of an on-signal from the detecting portion 346, the pressure pump motor 359 so that it rotates in the normal or reverse direction.

In the above embodiments, the capacity detector is composed of the detecting portion 346 and the lever push-up portion 379. Other capacity detectors may be used as long as they can detect whether the capacity of the inner space S of the air chamber 345 is smaller than a prescribed value. For example, a detector may be used that detects the capacity of the inner space S on the basis of the number of rotations and the rotation direction of the pressure pump motor 359.

In the above embodiments, the air pressurization program is such as to cause the CPU 401 to stop supplying nozzle drive signals to the recording head 320 when receiving an on-signal from the detecting portion 346. Alternatively, the air pressurization program may be such as not to cause the CPU 401 to stop supplying nozzle drive signals to the recording head 320 even when receiving an on-signal from the detecting portion 346.

In the above embodiments, the air pressurization program is such as to cause the CPU 401 to drive the sheet feeding motor 414 to cause the sheet feeding device to feed a recording medium in starting to rotate the pressure pump motor 359 in the reverse direction. Alternatively, the air pressurization program is such as not to cause the CPU 401 to drive the sheet feeding motor 414 in starting to rotate the pressure pump motor 359 in the reverse direction.

In the above embodiments, each of the ink cartridges 323 as the liquid cartridges is composed of the ink pack 332 as the liquid container and the ink case 331 as the pressure chamber. Each liquid cartridge may be composed of another kind of liquid container and a pressure chamber. For example, a liquid container and a pressure chamber may be formed by partitioning a box by a flexible portion such as a film.

In the second embodiment, the coil spring 413 as the urging member is provided between the engagement projections 411 and 412 that are formed on the cylindrical engagement portions 377 and 378 and the peripheral portion 385*a* of the top surface of the guide member 385 so as to surround the outer circumference of the opening 381*a* of the bellows member 381. However, the invention is not limited to such a case. Any structures can be employed as long as they can urge the air chamber 345 toward the pressing device and thereby maintain a state that the annular projection 375 is in close contact with the close contact portion 387*b* of the air chamber.

The above embodiments are directed to the ink-jet recording apparatus 311 (including printing apparatus such as a facsimile machine and a copier) which eject inks. However, the invention may be implemented as a liquid ejection apparatus that ejects another liquid, examples of which are liquid ejection apparatus that eject a liquid such as an electrode material or colorants that are used for manufacture of a liquid crystal display, an EL display, a field emission display, or the like, a liquid ejection apparatus that ejects a bioorganic material that is used for manufacture of a biochip, and a sample ejection apparatus as a precision pipette.

A third embodiment of the invention will be hereinafter described with reference to the drawings.

Figure 11:
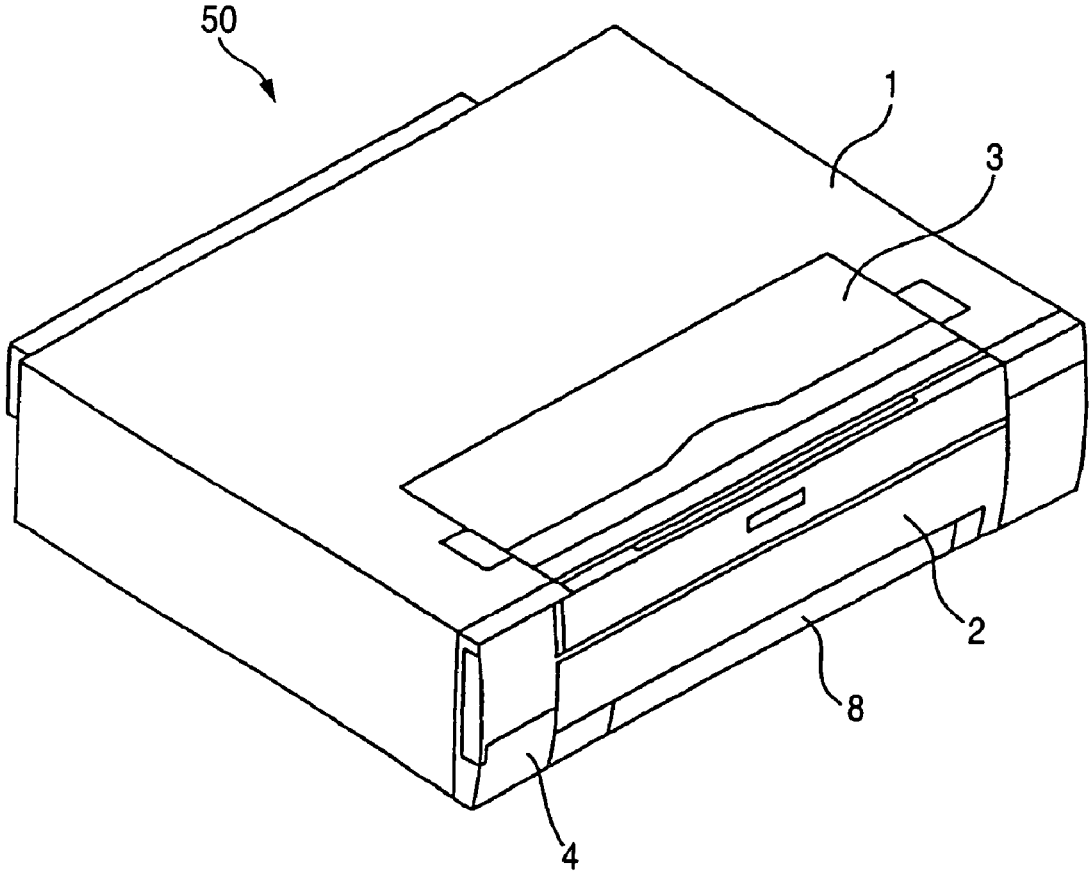
FIG. 11 is a perspective view of an ink-jet recording apparatus.
Figure 12:
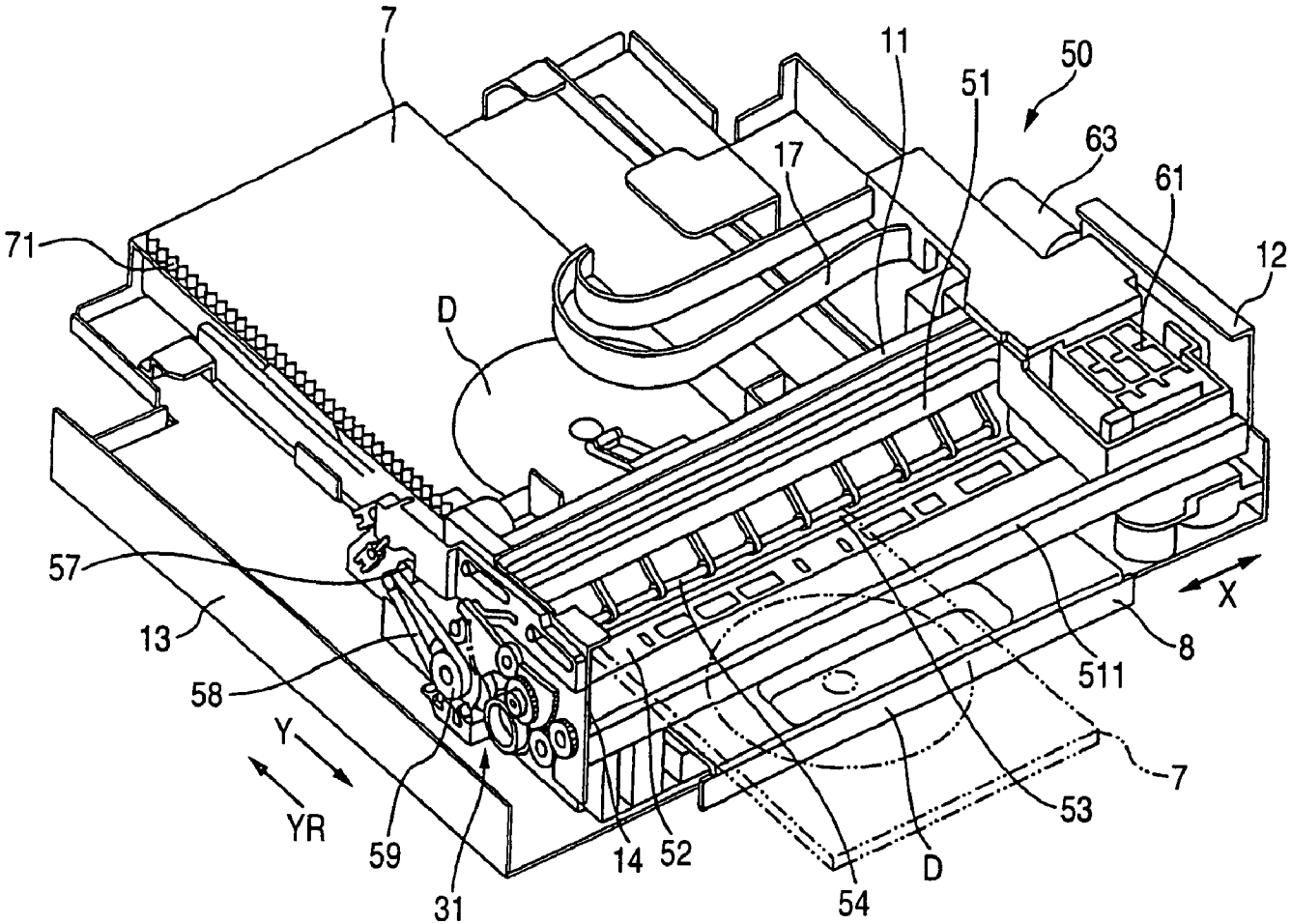
FIG. 12 is a perspective view of the ink-jet recording apparatus in a state that a main body cover is removed.
Figure 13:
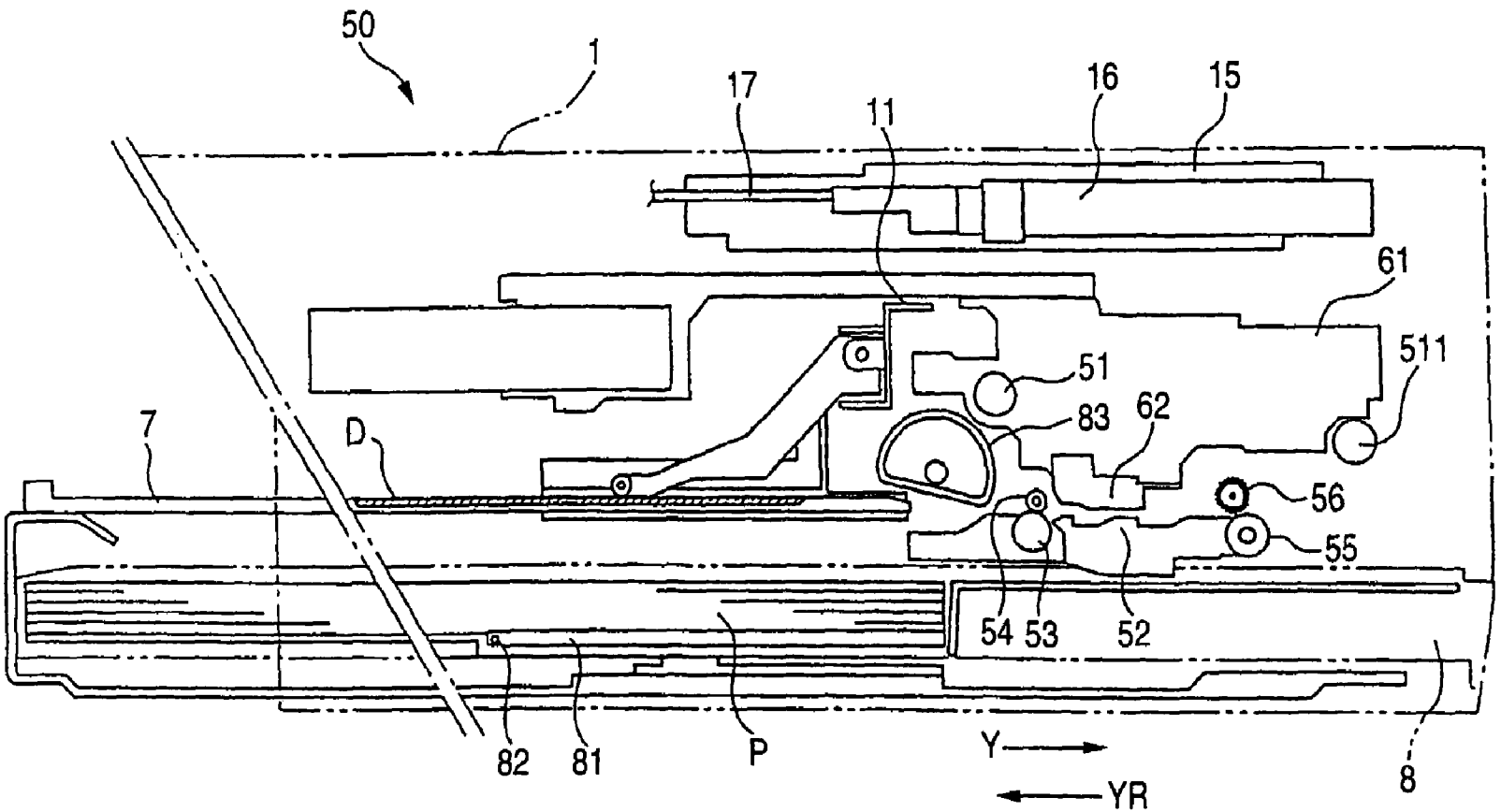
FIG. 13 is a schematic side sectional view of the inkjet recording apparatus.
Figure 14:
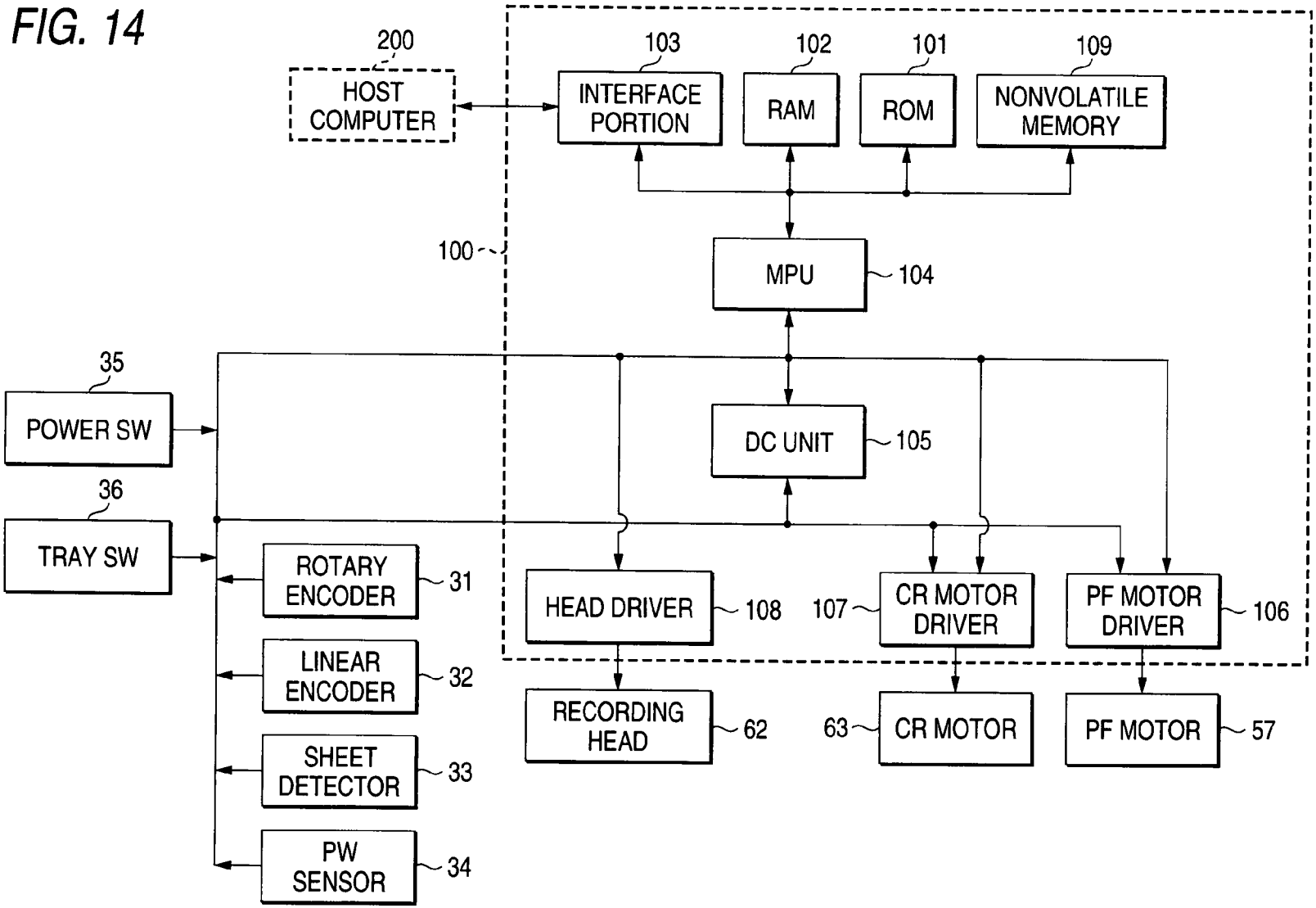
FIG. 14 is a block diagram of a control unit that performs various controls of the ink-jet recording apparatus.

FIG. 11 is a perspective view of an ink-jet recording apparatus. FIG. 12 is a perspective view of the ink-jet recording apparatus in a state that a main body cover is removed. FIG. 13 is a schematic side sectional view of the ink-jet recording apparatus. FIG. 14 is a block diagram of a control unit that performs various controls of the ink-jet recording apparatus.

First, the configuration of the ink-jet recording apparatus 50 as a liquid ejection apparatus according to the invention will be described with reference to FIGS. 11-13. Having a box-shaped appearance and being approximately the same in size as video tape recorders, the ink-jet recording apparatus 50 is assumed to be used in a state that it is accommodated in a TV rack or the like. A front cover 2 that can be opened by drawing it toward a user's side occupies the front central portion of the box-shaped main body cover 1. A recording sheet P as an ejection target member that has been subjected to recording is discharged from an opening portion that appears when the front cover 2 is opened by drawing it toward a user's side. Where recording is performed on the label surface of an optical recording disc D such as a DVD, a disc tray 7 projects temporarily from the inside of the ink-jet recording apparatus 50 while recording is performed on the optical recording disc D as an ejection target member that is mounted on the disc tray 7. The front cover 2 serves as a stacker for stacking of recording sheets P that have been discharged after being subjected to recording in a state that it has been drawn to a user's side. A sheet cassette 8 as a recording sheets accommodation portion for stacking of recording sheets P is provided under the front cover 2. Recording sheets P can be put into the sheet cassette 8 in a state that it has been drawn to a user's side. An openable cover 3 that can be opened upward is provided above the front cover 2. An ink cartridge unit 15 is provided under the openable cover 3. A plurality of ink cartridges 16 (see FIG. 3) as liquid containers that are charged with inks as liquids are provided detachably in the cartridge unit 15 so as to be arranged in the width direction of the ink-jet recording apparatus 50. An ink cartridge 16 can be replaced in a state that the openable cover 3 is opened. A memory slot cover 4 having a memory slot into and from which a flash memory card can be inserted and removed is provided on the left of the front cover 2 (as viewed from a user's side).

The internal configuration of the ink-jet recording apparatus 50 will be described below with reference to FIG. 12. The chassis of the ink-jet recording apparatus 50 is composed of a bottom chassis 13, a main frame 11 that extends in the width direction of the main body of the ink-jet recording apparatus 50, a right side frame 12 and a left side frame 14 that are disposed on both sides of the main frame 11 and are parallel with the depth direction of the main body of the ink-jet recording apparatus 50. A carriage guide shaft 51 and a sub-carriage guide shaft 511 are disposed between and pivotally supported by the right side frame 12 and the left side frame 14 so as to extend in the main scanning direction X and to have a prescribed interval in the auxiliary scanning direction Y. The carriage guide shaft 51 and the sub-carriage guide shaft 511 are guide shafts for supporting a carriage 61 in such a manner that the carriage 61 can reciprocate in the main scanning direction X. The carriage 61 is mounted with a recording head 62 as a liquid ejection head for ejecting inks toward a recording sheet P. The carriage guide shaft 61 penetrates through the rear portion of the carriage 61 and the sub-carriage guide shaft 511 supports the front portion of the carriage 61 from below, whereby the carriage 61 is supported so as to be able to reciprocate in the main scanning direction X in a state that the distance (i.e., platen gap PG) between the recording head 62 (see FIG. 13) mounted on the carriage 61 and a recording sheet P facing the head surface of the recording head 62 is kept constant.

Transport paths of a recording sheet P as an ejection target member and the disc tray 7 will be described below with reference to FIGS. 12 and 13.

An automatic sheet feeder for feeding recording sheets P as recording subject members to an auxiliary scan driving device (described later) one by one is equipped with the sheet cassette 8 and a sheet feed roller 83. A hopper 81 is provided at the bottom of the sheet cassette 8 in which a plurality of recording sheets P are stacked. The hopper 81 is provided so as to be able to swing with a shaft 82 as a swing shaft. The hopper 81 pushes up the recording sheets P stacked thereon and thereby presses the recording sheets P against the sheet feed roller 83 located above. The sheet feed roller 83 is generally D-shaped as viewed from the side and its outer circumferential portion is made of a high-friction material (e.g., rubber). The top recording sheet P that is in contact with the arc portion of the sheet feed roller 83 is fed in the auxiliary scanning direction Y as the sheet feed roller 83 rotates. The automatic sheet feeder is equipped with a separation pad (not shown) as a separation member that is disposed under the sheet feed roller 83 and prevents an event that when a recording sheet P whose surface is pressed against the outer circumferential surface of the sheet feed roller 83 by the hopper 81 is fed in the sheet feed direction (i.e., auxiliary scanning direction Y) by driving rotation of the sheet feed roller 83, another recording sheet P is also fed in such a manner that the two recording sheets P are laid on each other. A recording sheet(s) P is fed by rotation of the sheet feed roller 82 so as to be held between the separation pad and the sheet feed roller 83, whereby a feed-intended recording sheet P and anther recording sheet P being fed together with the former can be separated from each other. The automatic sheet feeder is also equipped with a sheet returning lever (not shown) as a sheet returning swing body that is disposed under the sheet feed roller 83 and can advance to the sheet feed path so as to push, toward the sheet cassette 8, the tip of a recording sheet P that has been separated by the separation pad and is partially projects out from the sheet cassette 8 (where recording sheets P are stacked) to return that recording sheet P to the sheet cassette 8.

A transport drive roller 53 whose outer circumferential surface is uniformly coated with a high-frictional-resistance coating and a transport follower roller 54 that is pivotally supported so as to be capable of follower rotation in a state that it is pressed against the transport drive roller 53 are disposed downstream of the sheet feed roller 83 in the auxiliary scanning direction Y. The transport drive roller 53, the transport follower roller 54, a PF motor 57 as a transport driving motor for driving the transport drive roller 53 and a rotary encoder 31 as a rotation amount detector for detecting the amount of rotations of the transport drive roller 53 constitute an auxiliary scan driving device for transporting a recording sheet P or the disc tray 7 in the auxiliary scanning direction Y by a prescribed length.

In the auxiliary scan driving device, a recording sheet P or the disc tray 7 is held between the transport drive roller 53 and the transport follower roller 54. Rotational drive force of the PF motor 57 is transmitted to a pulley 59 via an endless belt 58, and the rotation of the pulley 59 is transmitted to the transport drive roller 53 via intermediate gears etc. (not shown). The recording sheet P or the disc tray 7 is transported in the auxiliary scanning direction Y by the resulting driving rotation of the transport drive roller 53. The amount of rotations of the PF motor 57 is controlled by a control unit 100 (described later) on the basis of the amount of rotations of the transport drive roller 53 that is detected by the rotary encoder 31 so that the recording sheet P or the disc tray 7 is transported by the prescribed length.

A platen 52 is disposed downstream of the transport drive roller 53 in the auxiliary scanning direction Y so as to be opposed to the head surface of the recording head 62 in the vertical direction. Recording is performed in such a manner that inks are ejected from the recording head 62 that is reciprocated in the main scanning direction by a main scan driving device toward a recording sheet P or the disc tray 7 that has been transported by the above-described auxiliary scan driving device and that is supported by the platen 52 from below. The main scan driving device includes the carriage 61 and a CR motor 63 as a carriage driving motor that is a drive power source for reciprocating the carriage 61. Rotational drive force (i.e., rotational motion) of the CR motor 63 is converted by a drive force transmission mechanism (an endless belt etc.; not shown) into linear, reciprocative motion, which is transmitted to the carriage 61. In this embodiment, whereas the recording head 62 is attached to the bottom portion of the carriage 61, no ink cartridges are mounted on the carriage 61 which is reciprocated in the main scanning direction X. Inks are supplied from the ink cartridges 16 accommodated in the above-mentioned ink cartridge unit 15 to the carriage 61 via a flexible collective tube 17. Ink tubes 171 as independent liquid supply paths are formed inside the flexible collective tube 17 in a number that is equal to the number of ink cartridges 16. The ink in each ink cartridge 16 is pressurized by a bellows pump unit as an air compressor (described later) and supplied to the recording head 62 individually via the corresponding ink tube 171 of the flexible collective tube 17.

A sheet discharge drive roller 55 that receives rotational drive force of the PF motor 57 and is thereby drive-rotated and a sheet discharge follower roller 56 that is pivotally supported so as to be able to make follower rotation in a state that it is urged by the sheet discharge drive roller 55 are disposed downstream of the recording head 62 in the auxiliary scanning direction Y. During and after a recording operation, a recording sheet P is held between the sheet discharge drive roller 55 and the sheet discharge follower roller 56 and rotational drive force of the PF motor 57 is transmitted to the pulley 59 via the endless belt 58. The rotation of the pulley 58 is transmitted to the sheet discharge drive roller 55 via intermediate gears etc. The recording sheet P is transported in the auxiliary scanning direction Y by the resulting driving rotation of the sheet discharge drive roller 55 and is discharged from the opening portion that appears as a result of opening of the front panel 2. The disc tray 7 that can be mounted with an optical recording disc D is disposed over the sheet cassette 8. The side surface of the disc tray 7 is formed with a rack 71 (see FIG. 12). The disc tray 7 can be moved straightly while keeping an approximately horizontal posture by rotation of a pinion gear (not shown) that is in mesh with the rack 71. After being transported by rotation of the pinion gear until its tip is held between the transport drive roller 53 and the transport follower roller 54, the disc tray 7 is fed in the auxiliary scanning direction Y or the reverse feed direction YR by rotating the transport drive roller 53 in the corresponding one of the two directions. In mounting or removing an optical recording disc D on or from the disc tray 7, the disc tray 7 is transported to a position (indicated by phantom lines in FIG. 12) where part of the disc tray 7 projects from the opening portion that appears as a result of opening of the front panel 2.

Next, the configuration of the control unit 100 will be described with reference to FIG. 14.

The control unit 100 is connected, so as to be able to send and receive data to and from it, to a host computer 200 that sends recording control data to the ink-jet recording apparatus 50. The control unit 100 includes a ROM 101, a RAM 102, and interface portion 103, an MPU 104, a DC unit 105, a PF motor driver 106, a CR motor driver 107, a head driver 108, and a nonvolatile memory 109 as a nonvolatile storage medium. Output signals of the rotary encoder 31 as the rotation amount detector for detecting the amount of rotations of the transport drive roller 53, a linear encoder 32 as a carriage movement length detector for detecting the movement length of the carriage 61, a sheet detector 33 for detecting the head and the tail of a recording sheet P being transported, a PW sensor 34 for detecting the width, in the main scanning direction X, of a recording sheet P mounted on the carriage 61, a power switch 35 for turning on or off the power to the ink-jet recording apparatus 50, and a tray switch 36 by which to effect a manipulation of letting in or out the disc tray 7 are input to the MPU 104 and the DC unit 105.

In this embodiment, the PW sensor 34 is an optical sensor that is attached to the bottom portion of the carriage 61 and is used for detecting the feed position of the disk tray 7 by recognizing an identification mark (not shown) that is attached to the disk tray 7. The PW sensor 34 is also used for detecting presence/absence of a disc D on the disk tray 7 and the center of a disk D.

The MPU 104 performs computation for executing a control program of the ink-jet recording apparatus 50 and other necessary kinds of computation. Control programs (firmware) that are necessary for controlling the ink-jet recording apparatus 50 and data etc. that are necessary for processing are stored in the ROM 101. Having an interface function for communication with the host computer 200, the interface portion 103 receives recording control data from the host computer 200. The interface portion 103 also has driver and interface functions for the memory slot 37. The RAM 102 is used as a working area of the MPU 104 and a temporary storage area of various data including recording control data that are transferred via the interface portion 103. The nonvolatile memory 109 stores various kinds of information that need to be stored even after power-off of the ink-jet recording apparatus 50. The DC unit 105 is a control circuit for performing speed controls on the PF motor 57 and the CR motor 63 which are DC motors. The DC unit 105 performs various kinds of computation for speed controls on the PF motor 57 and the CR motor 63 on the basis of output signals of the rotary encoder 31, the linear encoder 32, and the sheet detector 33, and sends, to the PF motor driver 106 and the CR motor driver 107, motor control signals that are based on computation results. The PF motor driver 106 drive-controls the PF motor 57 on the basis of the motor control signal that is sent from the DC unit 105. In this embodiment, the PF motor 57 serves as a source of rotational drive force for driving the sheet feed roller 83, the transport drive roller 53, the sheet discharge drive roller 55, and the pinion gear (not shown) that is in mesh with the rack 71 (see FIG. 12) formed on the side surface of the disk tray 7 and that serves to transport the disc tray 7. The CR motor driver 107 reciprocates the carriage 61 in the main scanning direction by drive-controlling the CR motor 63 on the basis of a motor control signal from the DC unit 105 or stops the carriage 61 and keeps it stationary. The head driver 59 drive-controls the recording head 62 on the basis of a head control signal from the MPU 104.

Next, the bellows pump unit as an air compressor for pressure-supplying inks from the ink cartridges 16 to the recording head 62 by sending air to the ink cartridges 16 will be described with reference to FIGS. 15-19.

Figure 15:
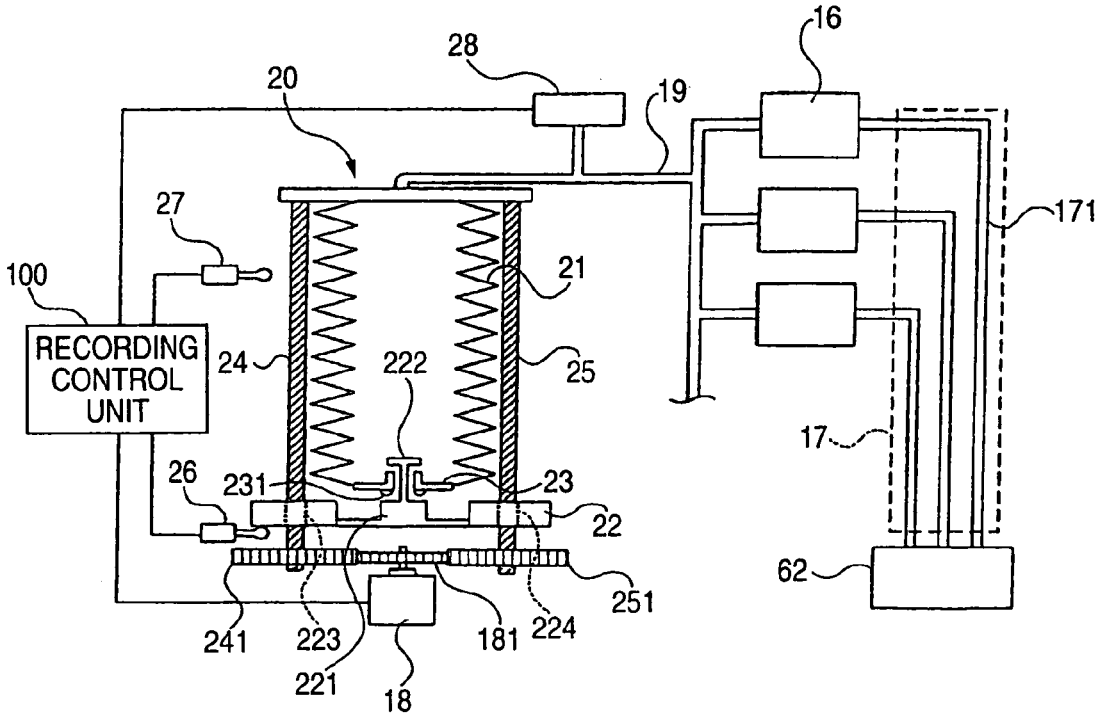
FIGS. 15-19 are sectional views showing an ink pressurization system using a bellows pump unit.

FIG. 15 is a sectional view schematically showing the bellows pump unit and an ink pressurization system using the bellows pump unit.

The bellows pump unit 20 is configured so as to be able to increase and decrease the pressure in an air pressure tube 19 as an air pressure path by contracting and expanding a bellows pump 21 as an air chamber that can contract and expand. The bellows pump unit 20 includes an open-close valve mechanism that is composed of a valve body 22 that is moved in the vertical direction by rotation of a pressure increase/reduction motor 18 as a source of valve body drive force and a valve seat 23 that is attached to the bellows pump 21. The bellows pump 21 is expanded or contracted by the valve body 22, whereby the pressure of the inside air is increased (the air is compressed) or reduced (the air is released). The valve body 22 is supported in such a manner that rotary shafts 24 and 25 are screwed in respective threaded holes 223 and 224 of the valve body 22. The rotary shafts 24 and 25 are pivotally supported, and gears 241 and 251 that are attached to the respective rotary shafts 24 and 25 are in mesh with a gear 181 that is attached to the rotary shaft of the pressure increase/reduction motor 18. As the pressure increase/reduction motor 18 rotates the respective rotary shafts 24 and 25 are rotated in the same direction by the same amount of rotations, whereby the valve body 22 is moved in the compression direction or the expansion direction of the bellows pump 21. Pressurized air is sent from the bellows pump 21 to the ink cartridges 16 via an air pressure tube 19. Inks are pressure-sent from the ink cartridges 16 to the ink tube 17 by pressurized air that is sent from the bellows pump 21.

The bellows pump unit 20 includes an initial pressurization position sensor 26 as an initial pressurization position detector for detecting that the valve body 22 has moved to an initial pressurizing position and a pressurization limit position sensor 27 as a pressurization limit position detector for detecting that the valve body 22 has moved to a pressurization limit position. Each of the initial pressurization position sensor 26 and the pressurization limit position sensor 27 is a sensor having a mechanical contact. Switching is effected when part of the valve body 22 pushes the mechanical contact of the initial pressurization position sensor 26 or the pressurization limit position sensor 27. Detection signals of the initial pressurization position sensor 26 and the pressurization limit position sensor 27 are input to the recording control unit 100. The initial pressurization position is set in advance as a movement limit position of the valve body 22 in the expansion direction (opposite to the compression direction) of the bellows pump 21, and is a start position where an operation of compressing (pressurizing) the bellows pump 21 is started. On the other hand, the pressurization limit position is set in advance as a movement limit position of the valve body 22 in the compression direction of the bellows pump 21. When the valve body 22 has reached the pressurization limit position, the valve body 22 is moved in the expansion direction of the bellows pump 21 to reduce the pressure of the bellows pump (i.e., release the air). After the valve body 22 has reached the initial pressurization position, the valve body 22 is again moved in the compression direction to pressurize the air in the bellows pump 21 again. In the bellows pump unit 20, an air pressure sensor 28 as a pressure detector for detecting the pressure of the bellows pump 21 is attached to the air pressure tube 19. For example, the air pressure sensor 28 is a pressure sensor using a photoreflector or the like. A detection signal of the air pressure sensor 28 is input to the recording control unit 100. The recording control unit 100 having control functions to serve as a liquid pressure control apparatus according to the invention controls increase and decrease of the pressure of ink supply from the ink cartridges 16 to the recording head 62 by controlling the pressure increase/reduction motor 18 on the basis of the position of the valve body 22 that is detected by the initial pressurization position sensor 26 and the pressurization limit position sensor 27 and the pressure of the bellows pump 21 (i.e., the pressure in the air pressure tube 19) that is detected by the air pressure sensor 28.

Figure 16:
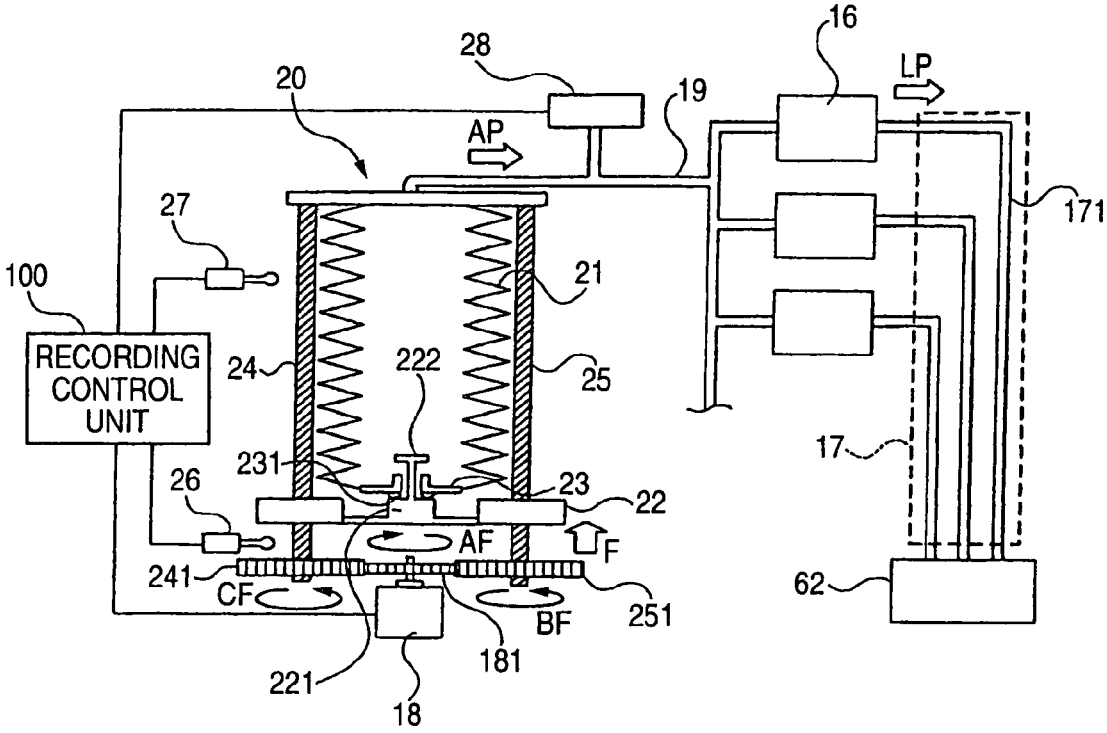

FIG. 16 is a sectional view schematically showing the bellows pump unit 20 and the ink pressurization system using the bellows pump unit 20, and shows a state that the valve body 22 has just started to move in the compression direction of the bellows pump 21 from the initial pressurization position.

When the pressure increase/reduction motor 18 is rotated in a rotation direction indicated by symbol AF, the gear 181 is rotated in the rotation direction indicated by symbol AF, whereby the rotary shaft 24 is rotated in a rotation direction indicated by symbol CF via the gear 241 that is in mesh with the gear 181 and the rotary shaft 25 is rotated in a rotation direction indicated by symbol BF via the gear 251 that is also in mesh with the gear 181. As a result, the valve body 22 is moved in such a direction (indicated by symbol F) as to compress the bellows pump 21, whereby a contact portion 221 of the valve body 22 comes into contact with the valve seat 23. A ring-like rubber member 231 is provided on the surface of the valve seat 23 with which the contact portion 221 comes into contact. When the rubber member 231 comes into close contact with the contact portion 221, the inside of the bellows pump 21, which was open to the atmosphere in the state that the valve body 22 was located at the initial pressurization position, is closed airtightly.

Figure 17:
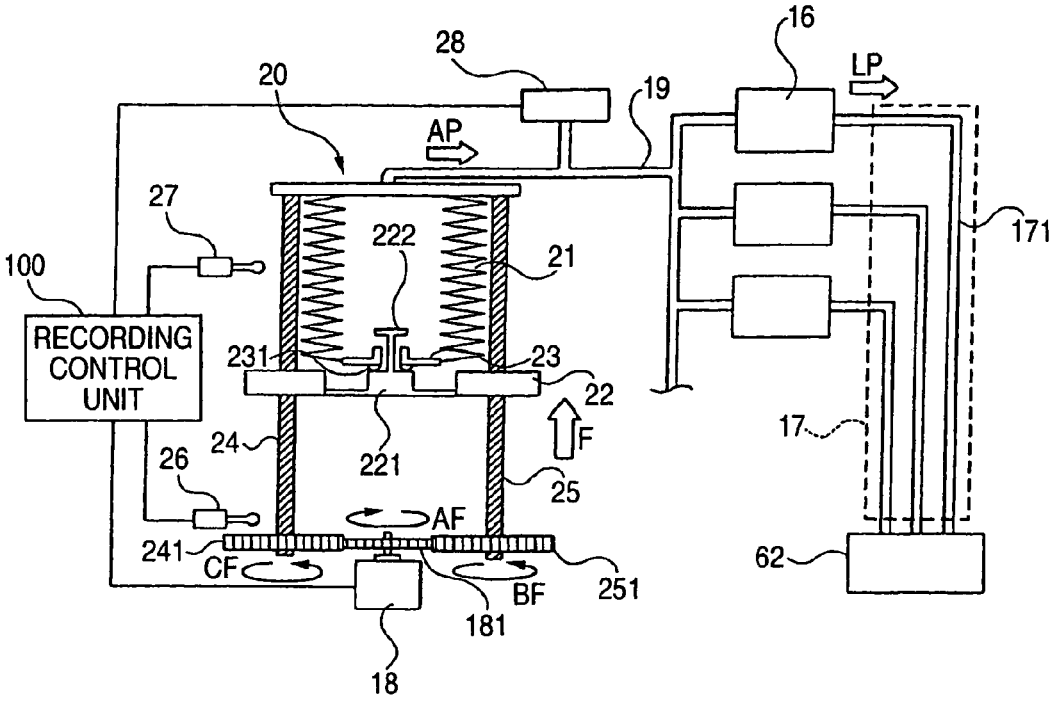

FIG. 17 is a sectional view schematically showing the bellows pump unit 20 and the ink pressurization system using the bellows pump unit 20, and shows a state that the valve body 22 has been moved further in the compression direction of the bellows pump 21 with the bellows pump 21 kept airtight.

As the valve body 22 is moved in the compression direction (indicated by symbol F) of the bellows pump 21 with the inside of the bellows pump 21 closed airtightly by rotating the pressure increase/reduction motor 18 in the rotation direction indicated by symbol AF, the air in the closed bellows pump 21 is compressed (pressurized) and air (indicated by symbol AP) that is sent to the air pressure tube 19 is pressurized increasingly. As a result, the pressure in each ink cartridge 16 is increased and the pressure of ink supply (indicated by symbol LP) from each ink cartridge 16 is increased. When the pressure of ink supply from each ink cartridge 16 has reached a prescribed value, the rotation of the pressure increase/reduction motor 18 is stopped and the air pressure of the bellows pump 21 is maintained. When the air pressure of the bellows pump 21 has become lower than a prescribed value due to ink ejection from the recording head 62, the pressure increase/reduction motor 18 is again rotated in the rotation direction indicated by symbol AF to increase the air pressure of the bellows pump 21. In this manner, the pressure of ink supply from each ink cartridge 16 to the recording head 62 is kept at the prescribed value by performing the controls of increasing and maintaining the air pressure of the bellows pump 21 on the basis of the air pressure of the bellows pump 21 that is detected by the air pressure sensor 28.

The prescribed air pressure is set at such a value that the pressure of ink supply from each ink cartridge 16 to the recording head 62 is equal to the upper limit value of an ink supply pressure range where desired ink ejection characteristics can be obtained.

Figure 18:
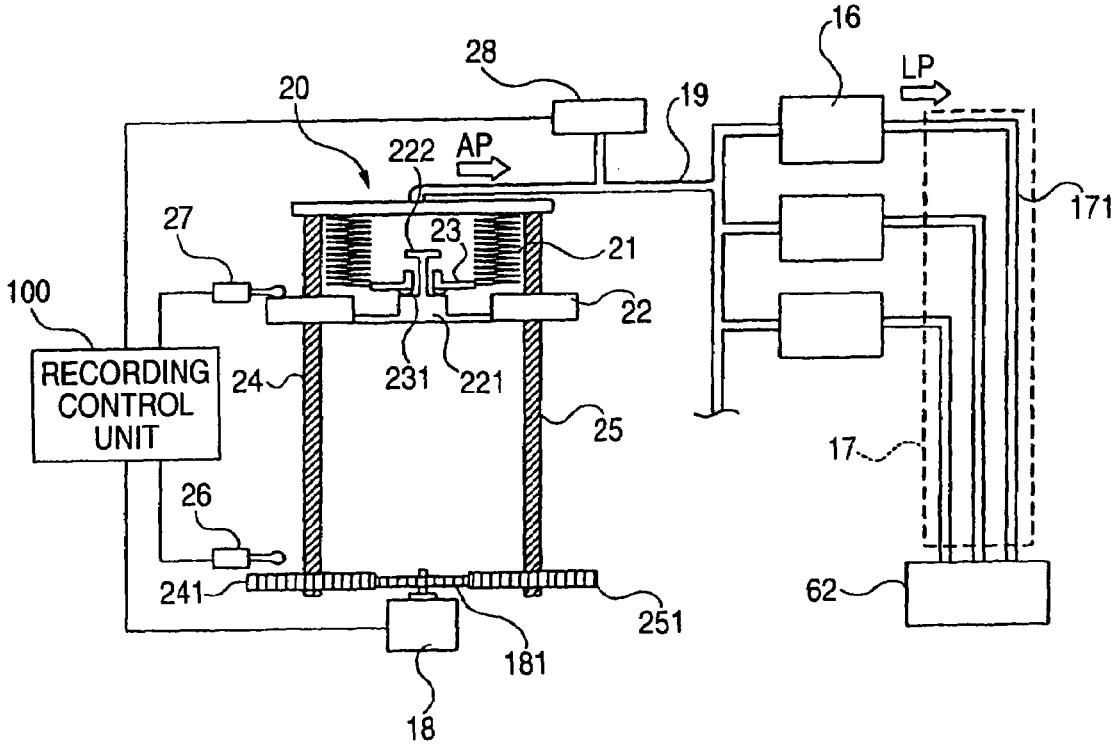

FIG. 18 is a sectional view schematically showing the bellows pump unit and the ink pressurization system using the bellows pump unit, and shows a state that the valve body 22 has been moved further in the compression direction of the bellows pump 21 with the bellows pump 21 kept airtight and the valve body 22 has reached the pressurization limit position.

When the valve body 22 has been moved to the pressurization limit position, the bellows pump 21 cannot be compressed any further. Therefore, if the air pressure of the bellows pump 21 has become lower than a prescribed value at the position, the valve body 22 is required to moved to the initial pressurization position, and then the bellows pump 21 is compressed again by the valve body 22. In this embodiment, the pressurization limit position is set in advance as a movement limit position of the valve body 22 in the compression direction so that when a continuous ink ejecting operation has been performed on a recording sheet P having a maximum size for the ink-jet recording apparatus 50 with the valve body 22 staying at a certain position, resulting pressure reduction of the bellows pump 21 is smaller than the difference between the upper limit value and the lower limit value of the ink supply pressure range where the desired ink ejection characteristics can be obtained. The pressure reduction of the bellows pump 21 when the valve body 22 is located at the pressurization limit position decreases as the volume of the air inside the bellows pump 21 when the valve body 22 is located at the pressurization limit position increases. It is appropriate to set the size of the bellows pump 21 and the pressurization limit position of the valve body 22 so that pressure reduction of the bellows pump 21 that occurs when a continuous ink ejecting operation has been performed on a recording sheet P having the maximum size for the ink-jet recording apparatus 50 becomes sufficiently smaller than the difference between the upper limit value and the lower limit value of the ink supply pressure range where the desired ink ejection characteristics can be obtained. This makes it possible to complete a continuous ink ejecting operation on a recording sheet P without interruption. And the ink supply pressure can always be kept stable with high accuracy during a continuous ink ejecting operation on a recording sheet P, which can reduce the degree of deterioration of the ink ejection accuracy due to dispersion or variation of the pressure of ink supply to the recording head 62. Further, since a continuous ink ejecting operation on a recording sheet P having the maximum size for the ink-jet recording apparatus 50 can be completed without interruption, reduction of the throughput of the ink ejection can be prevented.

Figure 19:
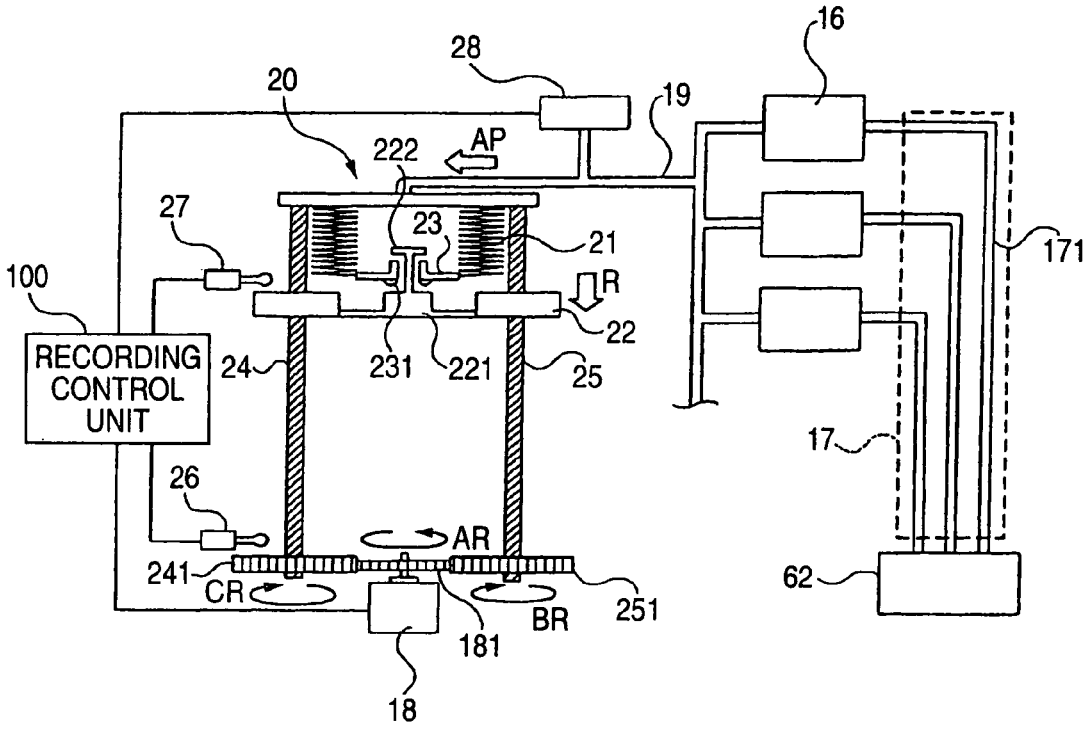

FIG. 19 is a sectional view schematically showing the bellows pump unit 20 and the ink pressurization system using the bellows pump unit 20, and shows a state that the valve body 22 has been moved further in the compression direction of the bellows pump 21 with the bellows pump 21 kept airtight and the valve body 22 has reached the pressurization limit position.

When the valve body 22 has reached the pressurization limit position, the pressure increase/reduction motor 18 is rotated in the reverse rotation direction (indicated by symbol AR), whereby the rotary axis 24 is rotated in the rotation direction indicated by symbol CR via the gear 241 that is in mesh with the gear 181 and the rotary axis 25 is rotated in the rotation direction indicated by symbol BR via the gear 251 that is in mesh with the gear 181. As a result, the valve body 22 is moved in such a direction (indicated by symbol R) as to expand the bellows pump 21 and the contact portion 221 of the valve body 22 is separated from the valve seat 23. The rubber member 231 of the valve seat 23 that was in close contact with the contact portion 221 is separated from the contact portion 221, whereby the bellows pump 21 that has been kept airtight is opened. Air flows into the bellows pump 21 through the gap between the valve body 22 and the valve seat 23 and the pressure of the air inside the bellows pump 21 that has been kept airtight decreases suddenly to atmospheric pressure. The pressure of air (indicated by symbol AP) to be sent to the air pressure tube 19 is reduced to atmospheric pressure. As a result, the pressure in each cartridge 16 is reduced and the pressure of ink supply (indicated by symbol LP) from each ink cartridge 16 is reduced to about atmospheric pressure. As the valve body 22 is moved further in the expansion direction (indicated by symbol R) of the bellows pump 21, the engagement portion 222 of the valve body 22 is engaged with the valve seat 23 and the valve seat 23 is pulled to expand the bellows pump 21 while air flows into the bellows pump 21 through the gap between the valve body 22 and the valve seat 23.

The configuration of the ink-jet recording apparatus 50 has been outlined above. Next, a description will be made of how the recording control unit 100 having the control functions to serve as the liquid pressure control apparatus according to the invention controls the pressure of ink supply from each ink cartridge 16 to the recording head 62.

Figure 20:
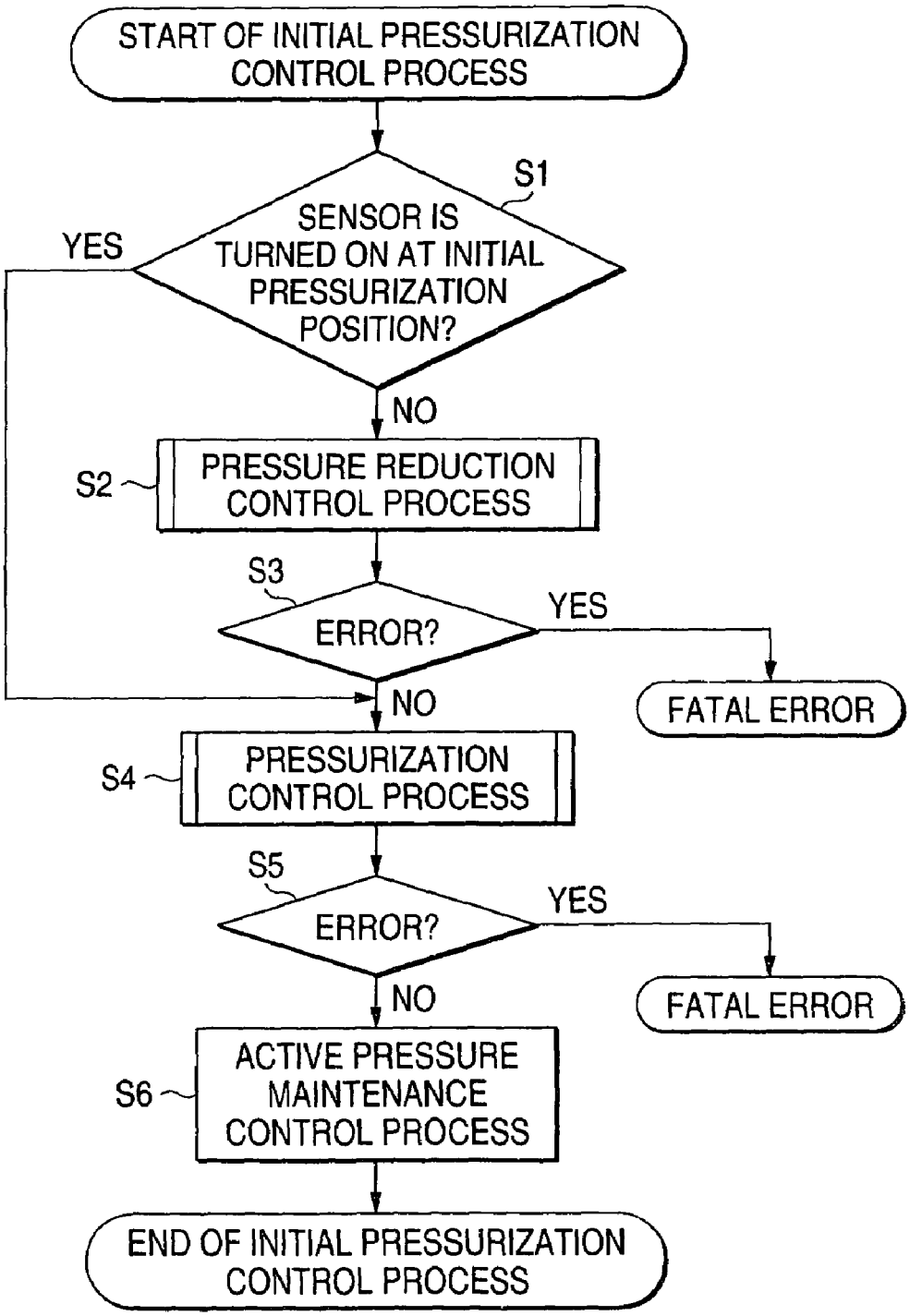
FIG. 20 is a flowchart of an initial pressurization control process for the ink supply pressure.

FIG. 20 is a flowchart of an initial pressurization control process for the air pressure of the bellows pump unit 20.

The initial pressurization control process is executed before recording (e.g., immediately after turning-on of the power to the ink-jet recording apparatus 50) to increase the ink supply pressure from a value that is lower than a prescribed value to the prescribed value.

First, at step S1, it is judged whether the valve body 22 detection state of the initial pressurization position sensor 26 is an on-state. If the initial pressurization position sensor 26 is in an off-state, that is, the valve body 22 is not located at the initial pressurization position (step S1: no), at step S2, that is, in a pressure reduction control process (described later), the valve body 22 is moved to the initial pressurization position while the pressure of the bellows pump 21 is reduced. At step S3, it is judged whether an error has occurred in the pressure reduction control process (step S2). If an error has occurred (step S3: yes), the execution of this process is finished with a judgment result that a fatal error has occurred. On the other hand, if no error has occurred in the pressure reduction control process (step S3: no) or if the initial pressurization position sensor 26 is in an on-state (step S1: yes), that is, the valve body 22 is located at the initial pressurization position, at step S4 the air pressure of the bellows pump 21 is increased in a pressurization control process (described later). At step S5, it is judged whether an error has occurred in the pressurization control process (step S4). If an error has occurred (step S5: yes), the execution of this process is finished with a judgment result that a fatal error has occurred. If no error has occurred (step S5: no), a pressure maintenance control process (described later) is activated at step S6 and the execution of this process is finished.

In this embodiment, the term "fatal error" means an error from which the ink-jet recording apparatus 50 cannot recover even if the power is turned off and then turned on. In the event of a fatal error, the control unit 100 stores an abnormality code in the nonvolatile memory 109. When the power is applied to the ink-jet recording apparatus 50, the control unit 100 checks whether an abnormality code is written in the nonvolatile memory 109. If an abnormality code is written in the nonvolatile memory 109, the control unit 100 stops a control of increasing and decreasing the ink supply pressure and performs a control of rendering the ink-jet recording apparatus 50 into a state that recording on a recording sheet P or the label surface of an optical recording disc D cannot be performed at all.

Figure 21:
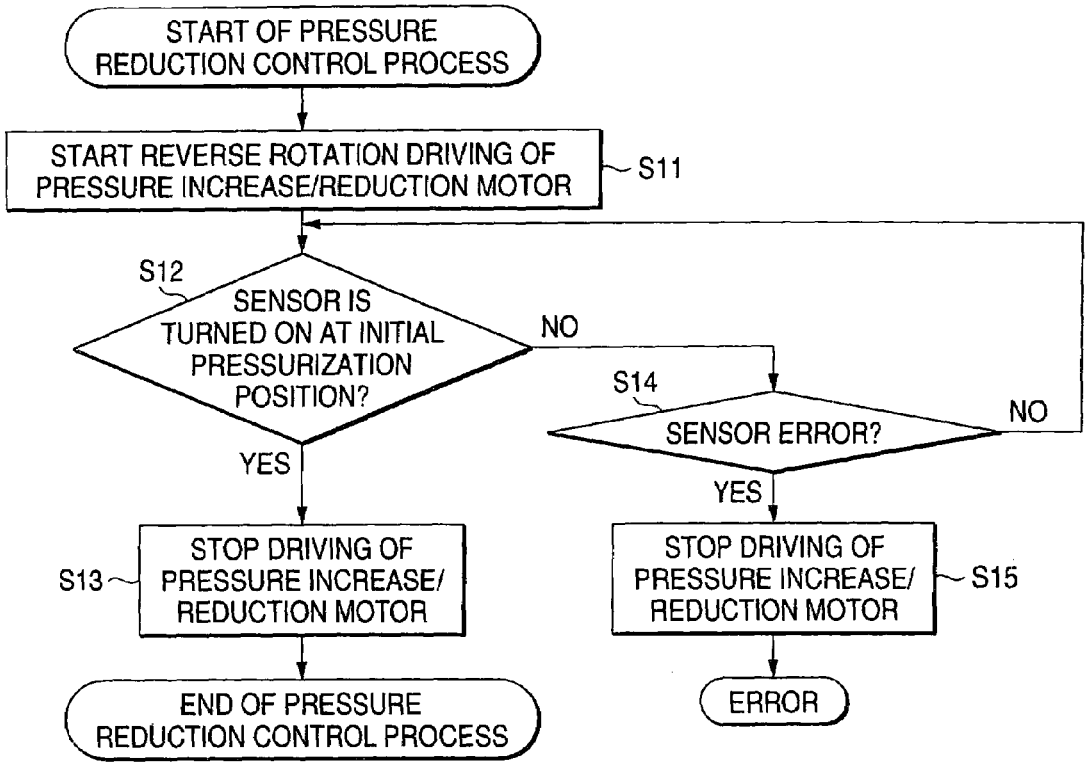
FIG. 21 is a flowchart of a pressure reduction control process for the ink supply pressure.

FIG. 21 is a flowchart of the pressure reduction control process for the air pressure of the bellows pump unit 20.

First, at step S11, reverse rotation driving (i.e., rotational driving in the rotation direction indicated by symbol AR in FIG. 19) of the pressure increase/reduction motor 18 of the bellows pump unit 20 is started. At step S12, it is judged whether the initial pressurization position sensor 26 is in an on-state. If the initial pressurization position sensor 26 is not in an on-state (step S12: no), that is, if it is detected that the valve body 22 has not been moved to the initial pressurization position, it is judged at step S14 whether a sensor error has occurred in an abnormality detection control process (described later). If a sensor error has occurred (step S14: yes), the reverse rotation driving of the pressure increase/reduction motor 18 is stopped at step S15 and the execution of this process is finished with issuance of an error. On the other hand, if no sensor error has occurred (step S14: no), the process returns to step S12 to continue the reverse rotation driving of the pressure increase/reduction motor 18. When it is detected that the initial pressurization position sensor 26 is in an on-state (step S12: yes), that is, when it is detected that the valve body 22 has been moved to the initial pressurization position, the rotational driving of the pressure increase/reduction motor 18 is stopped at step S13 and the execution of this process is finished.

Figure 22:
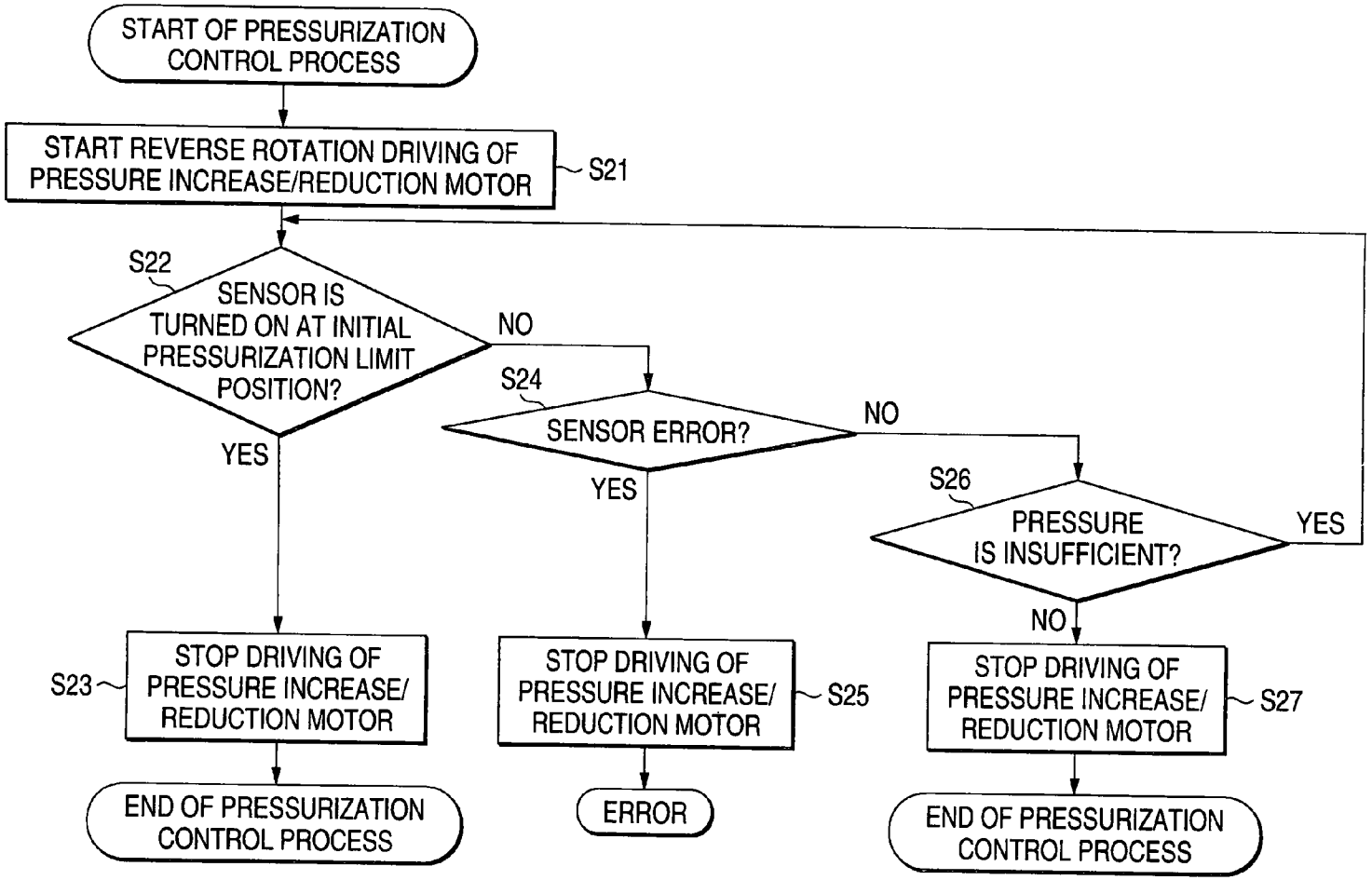
FIG. 22 is a flowchart of a pressurization control process for the ink supply pressure.

FIG. 22 is a flowchart of the pressurization control process for the air pressure of the bellows pump unit 20.

First, at step S21, normal rotation driving (i.e., rotational driving in the rotation direction indicated by symbol AF in FIG. 16) of the pressure increase/reduction motor 18 of the bellows pump unit 20 is started. At step S22, it is judged whether the pressurization limit position sensor 27 is in an on-state. If the pressurization limit position sensor 26 is not in an on-state (step S22: no), that is, if it is detected that the valve body 22 has not been moved to the pressurization limit position, it is judged at step S24 whether a sensor error has occurred in an abnormality detection control process (described later). If a sensor error has occurred (step S24: yes), the normal rotation driving of the pressure increase/reduction motor 18 is stopped at step S25 and the execution of this process is finished with issuance of an error. On the other hand, if no sensor error has occurred (step S24: no), it is judged at step S26 whether the air pressure of the bellows pump 21 is insufficient. If the air pressure of the bellows pump 21 is insufficient (step S26: yes), the process returns to step S22 to continue the normal rotation driving of the pressure increase/reduction motor 18. If the air pressure of the bellows pump 21 is not insufficient (step S26: no), the normal rotation driving of the pressure increase/reduction motor 18 is stopped at step S27 and the execution of this process is finished. When it is detected that the pressurization limit position sensor 27 is in an on-state (step S22: yes), that is, when it is detected that the valve body 22 has been moved to the pressurization limit position in a state that the air pressure of the bellows pump 21 is insufficient, the normal rotation driving of the pressure increase/reduction motor 18 is stopped in such a state at step S23 and the execution of this process is finished.

Figure 23:
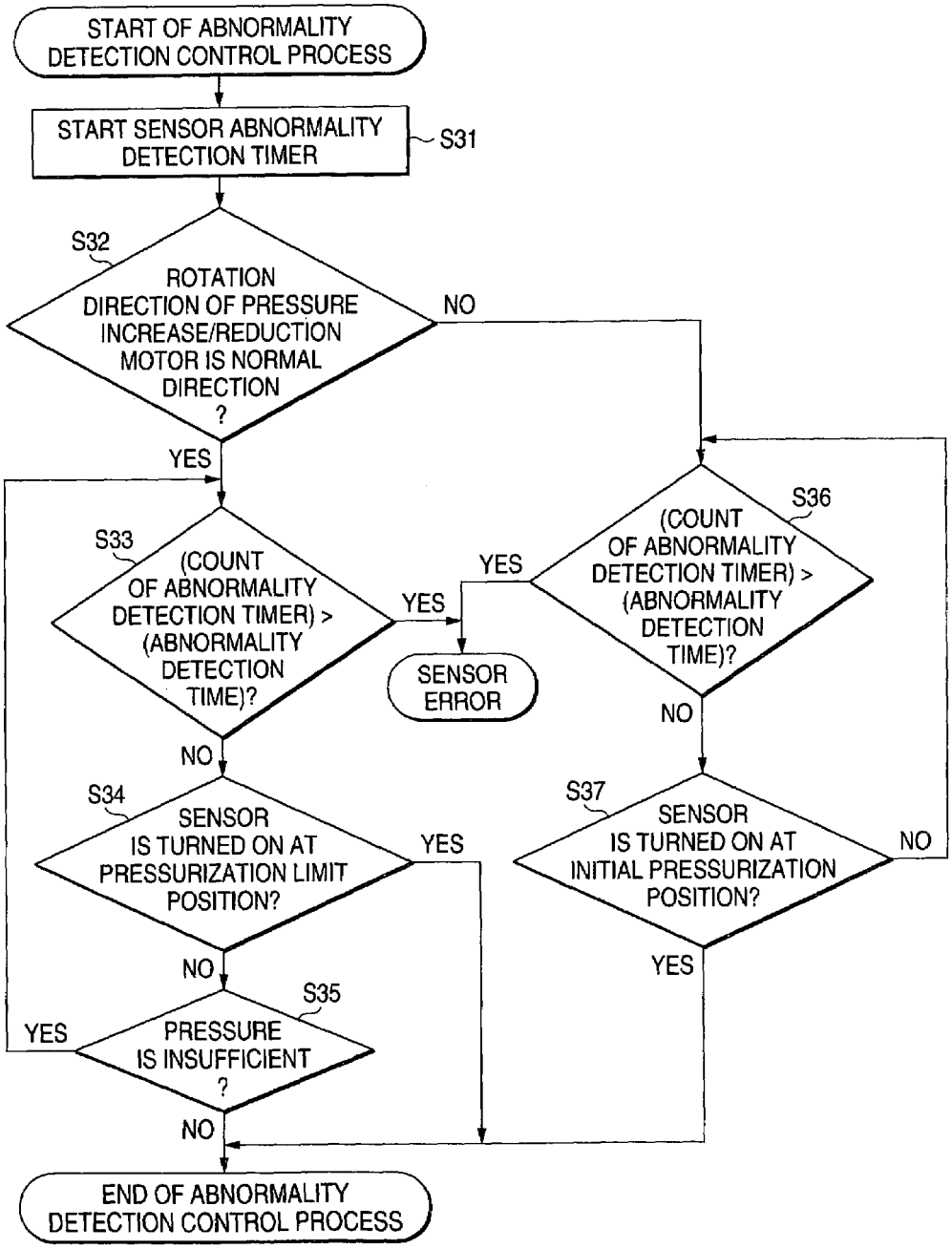
FIG. 23 is a flowchart of an abnormality detection control process.

FIG. 23 is a flowchart of the abnormality detection control process for the air pressure of the bellows pump unit 20.

This process is executed in rotating the pressure increase/reduction motor 18 in the normal or reverse rotation direction in the above-described pressure reduction control process (FIG. 21) or the pressurization control process (FIG. 22).

In rotating the pressure increase/reduction motor 18 in the normal or reverse rotation direction, first, a sensor abnormality detection timer is started at step S31. At step S32, it is judged whether the rotation direction of the pressure increase/reduction motor 18 is the normal rotation direction. If the rotation direction of the pressure increase/reduction motor 18 is the normal rotation direction (step S32: yes), at step S33 the count of the sensor abnormality detection timer that was started at step S31 is compared with an abnormality detection time as a default count and it is judged whether the count of the sensor abnormality detection timer has exceeded the abnormality detection time. If the count of the sensor abnormality detection timer has not exceeded the abnormality detection time (step S33: no), it is judged at step S34 whether the pressurization limit position sensor 27 is in an on-state. If the pressurization limit position sensor 27 is in an on-state (step S34: yes), that is, if the valve body 22 has been moved to the pressurization limit position, the execution of this process is finished in this state. If the pressurization limit position sensor 27 is not in an on-state (step S34: no), it is judged at step S35 whether the air pressure of the bellows pump 21 is insufficient. If the air pressure of the bellows pump 21 is insufficient (step S35: yes), the process returns to step S33 to continue the driving of the pressure increase/reduction motor 18 in the normal rotation direction to thereby compress (pressurize) the bellows pump 21 further. If the air pressure of the bellows pump 21 is not insufficient (step S35: no), that is, if the air pressure of the bellows pump 21 has been increased to a prescribed value, the execution of this process is finished. If it is judged at step S33 that the count of the sensor abnormality detection timer has exceeded the abnormality detection time (step S33: yes), that is, if the valve body 22 has not reached the pressurization limit position with the air pressure of the bellows pump 21 kept insufficient even when the time of the continuous driving of the pressure increase/reduction motor 18 in the normal rotation direction has exceeded the abnormality detection time, it is judged that the air pressure sensor 28 or the pressurization limit position sensor 27 is abnormal and the execution of this process is finished with issuance of a sensor error.

If a sensor error is issued in the abnormality detection control process, the rotational driving of the pressure increase/reduction motor 18 is stopped in the above-described pressurization control process (see FIG. 22). This decreases the probability that excessively strong force acts on the valve body 22 to destroy the bellows pump unit 20 or excessively high pressure acts on the air pressure tube 19, the ink cartridges 16, the ink tubes 171, or the recording head 62 to cause air leakage or ink leakage.

On the other hand, if the rotation direction of the pressure increase/reduction motor 18 is the reverse rotation direction (step S32: no), at step S36 the count of the sensor abnormality detection timer is compared with the abnormality detection time as the default count and it is judged whether the count of the sensor abnormality detection timer has exceeded the abnormality detection time. If the count of the sensor abnormality detection timer has not exceeded the abnormality detection time (step S36: no), it is judged at step S36 whether the initial pressurization position sensor 26 is in an on-state. If the initial pressurization position sensor 26 is in an on-state (step S36: yes), that is, if the valve body 22 has been moved to the initial pressurization position, the execution of this process is finished in this state. If the initial pressurization position sensor 26 is not in an on-state (step S36: no), the process returns to step S36 to continue the driving of the pressure increase/reduction motor 18 in the reverse rotation direction to thereby move the bellows pump 21 further toward the initial pressurization position. If it is judged at step S36 that the count of the sensor abnormality detection timer has exceeded the abnormality detection time (step S36: yes), that is, if it is detected that the valve body 22 has not reached the initial pressurization position even when the time of the continuous driving of the pressure increase/reduction motor 18 in the reverse rotation direction has exceeded the abnormality detection time, it is judged that the initial pressurization position sensor 26 is abnormal and the execution of this process is finished with issuance of a sensor error. If a sensor error is issued in the abnormality detection control process, the rotational driving of the pressure increase/reduction motor 18 is stopped in the above-described pressurization reduction control process (see FIG. 21). This decreases the probability that excessively strong force acts on the valve body 22 to destroy the bellows pump unit 20.

For example, the above-mentioned abnormality detection time as the default count is set at a count corresponding to an operation time of the pressure increase/reduction motor 18 that is long enough for the valve body 22 to move from the initial pressurization position to the pressurization limit position. A time that is taken by the valve body 22 to move from the initial pressurization position to the pressurization limit position while bearing a maximum load is equal to a maximum time that is taken to move the valve body 22 from the initial pressurization position to the pressurization limit position without stopping it by causing the pressure increase/reduction motor 18 to operate continuously at a constant rotation speed. Therefore, employing a count corresponding to this time as the abnormality detection time makes it possible to judge, in a shortest time, that an abnormality has occurred in the air pressure sensor 28, the pressurization limit position sensor 27, or the initial pressurization position sensor 26 when the count of the abnormality detection timer has exceeded the abnormality detection time. This in turn makes it possible to minimize a time during which the pressure increase/reduction motor 18 operates in a state that the air pressure sensor 28, the pressurization limit position sensor 27, or the initial pressurization position sensor 26 is abnormal.

Figure 24:
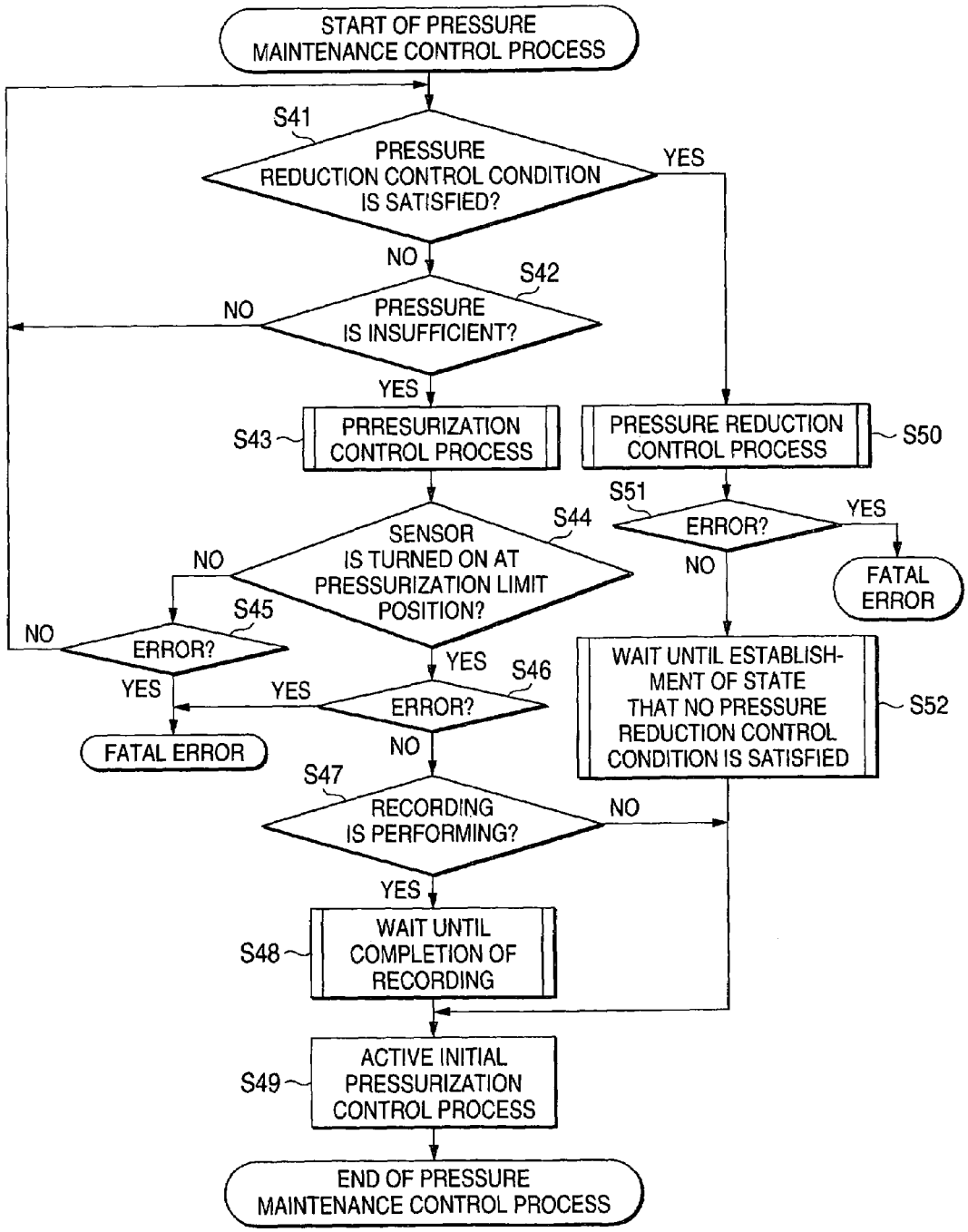
FIG. 24 is a flowchart of a first example of a pressure maintenance control process.
Figure 25:
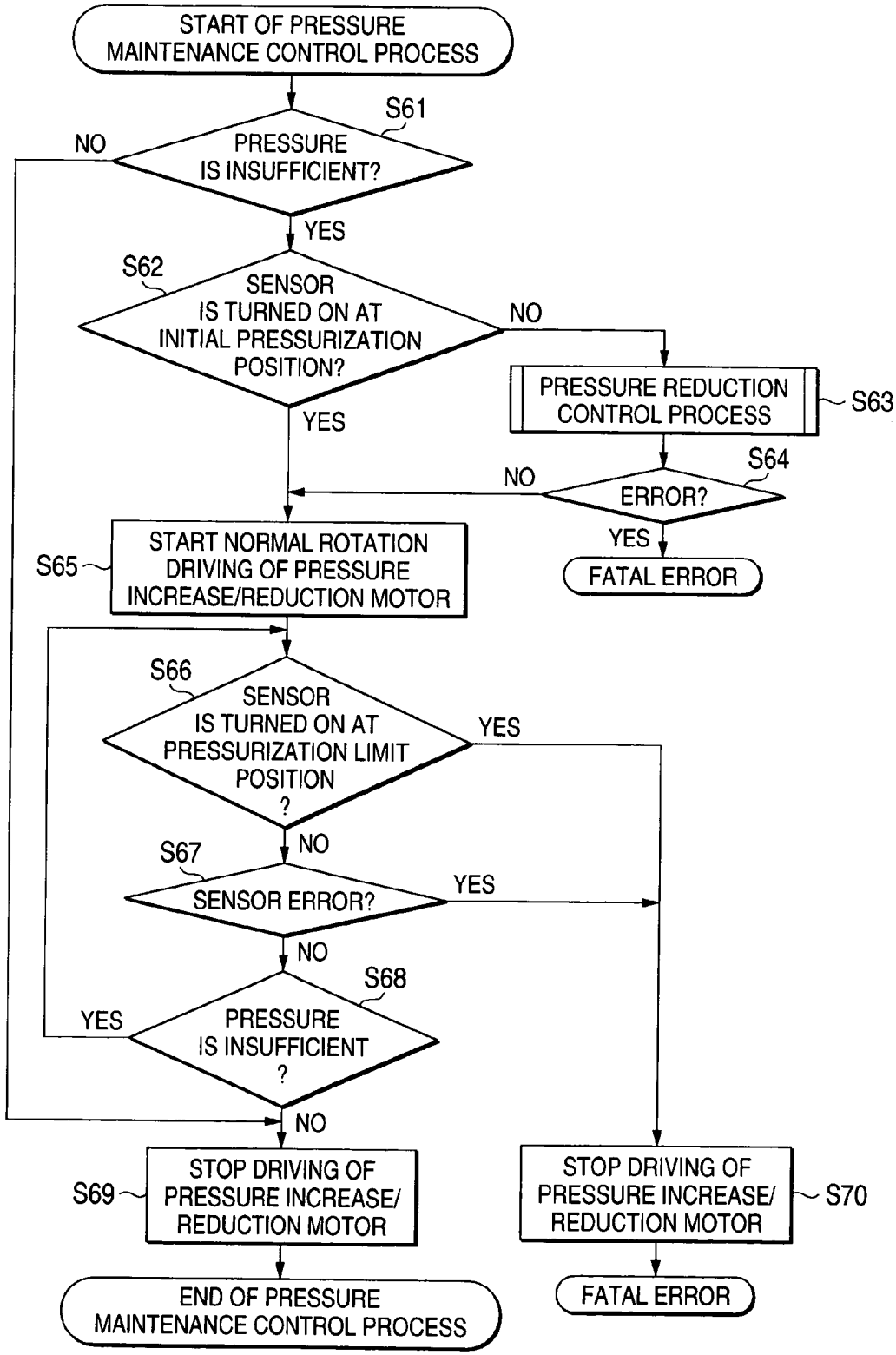
FIG. 25 is a flowchart of a second example of the pressure maintenance control process.

FIG. 24 is a flowchart of a first example of the pressure maintenance control process for the air pressure of the bellows pump unit 20.

This process is activated in the above-described initial pressurization control process (see FIG. 20). First, at step S41, it is judged whether a pressure reduction control condition is satisfied. A judgment result "a pressure reduction control condition is satisfied" is produced if the power switch 35 was manipulated in a state that the power to the ink-jet recording apparatus 50 was "on," the ink-jet recording apparatus 50 has not been manipulated by a user for more than 3 minutes and resultingly the control status of the ink-jet recording apparatus 50 has made a transition to a power saving mode, or the openable cover 3 for the ink cartridge unit 15 that accommodates the ink cartridges 16 is open. When a transition has been made to the power saving mode, the recording control unit 100 effects power saving by stopping the output of 42 V to 42-V components such as the PF motor driver 106, the CR motor driver 107, and the head driver 108 and producing, by chopping the voltage of 42 V, a lower voltage (about 20 V) at which a DC-DC converter (not shown) can operate that supplies 5 V to microcomputer components such as the MPU 104.

If a pressure reduction control condition is satisfied (step S41: yes), the pressure reduction control process (see FIG. 21) is executed at step S50. It is judged at step S51 whether an error has occurred in the pressure reduction control process (step S50). If an error has occurred (step S51: yes), the execution of this process is finished in this state with a judgment result that a fatal error has occurred. On the other hand, if no error has occurred (step S51: no), at step S52 the process waits until establishment of a state that no pressure reduction control condition is satisfied. Upon establishment of a state that no pressure reduction control condition is satisfied, the initial pressurization control process is activated at step S49 and the execution of the pressure maintenance control process is finished. The state that no pressure reduction control condition is satisfied is that the openable cover 3 is closed and the ink-jet recording apparatus 50 was manipulated by a user. If it is judged at step S41 that a pressure reduction control condition is satisfied as a result of manipulation of the power switch 35 in a state that the power to the ink-jet recording apparatus 50 was "on," the pressure reduction control process is executed at step S50. If it is judged at step S51 that no error has occurred, a control of turning off the power to the ink-jet recording apparatus 50 is performed in this state.

As described above, at the time of attachment or removal of an ink cartridge 16 that is enabled in a state that the openable cover 3 is opened, the pressure of ink supply from the ink cartridges 16 can be lowered to atmospheric pressure upon opening of the openable cover 3. This makes it possible to decrease the probability of ink leakage at the time of attachment or removal of an ink cartridge 16. Further, the ink supply pressure acting on the recording head 62 can be reduced to atmospheric pressure when the control status of the ink-jet recording apparatus 50 makes a transition to the power saving mode or the power to the ink-jet recording apparatus 50 is turned off. Therefore, the probability can be decreased that the pressure of ink supply from the ink cartridges 16 shortens the lives of the recording head 62 and the ink tubes 171 or ink leaks when an ink cartridge 16 is attached or removed while the control status of the ink-jet recording apparatus 50 is the power saving mode or the power to the ink-jet recording apparatus 50 is "off."

If it is judged that no pressure reduction control condition is satisfied (step S41: no), it is then judged at step S42 whether the air pressure of the bellows pump 21 is insufficient. If the air pressure of the bellows pump 21 is not insufficient (step S42: no), the process returns to step S41. If the air pressure of the bellows pump 21 is insufficient (step S42: yes), at step S43 the air pressure of the bellows pump 21 is increased to the prescribed value in the pressurization control process (see FIG. 22). After the air pressure of the bellows pump 21 has been increased to the prescribed value, it is judged at step S44 whether the pressurization limit position sensor 27 is in an on-state. If the pressurization limit position sensor 27 is not in an on-state (step S44: no), that is, if it is detected that the valve body 22 has not been moved to the pressurization limit position, it is judged at step S45, that is, in the abnormality detection control process (see FIG. 23), whether a sensor error has occurred. If no sensor error has occurred (step S45: no), the process returns to step S41. If a sensor error has occurred (step S45: yes), the execution of this process is finished with a judgment result that a fatal error has occurred.

On the other hand, if the pressurization limit position sensor 27 is in an on-state (step S44: yes), that is, if it is detected that the valve body 22 has been moved to the pressurization limit position, it is judged at step S46 whether an error has occurred in the pressurization control process (step S43). If an error has occurred (step S46: yes), this process is finished in this state with a judgment result that a fatal error has occurred. If no error has occurred (step S46: no), it is judged at step S47 whether recording is being performed on a recording sheet P or the label surface of an optical recording disc D. If recording is not being performed on a recording sheet P or the label surface of an optical recording disc D (step S47: no), at step S49 the above-described initial pressurization control process (see FIG. 20) is activated to increase the air pressure of the bellows pump 21 again. If recording is being performed on a recording sheet P or the label surface of an optical recording disc D (step S47: yes), at step S48 the process waits until completion of the recording. Upon completion of the recording, at step S49 the initial pressurization control process (see FIG. 20) is activated to increase the air pressure of the bellows pump 21 again.

As described above, the pressurization limit position of the valve body 22 is set in advance as a movement limit position of the valve body 22 in the compression direction so that when a continuous ink ejecting operation has been performed on a recording sheet P having a maximum size for the ink-jet recording apparatus 50 with the valve body 22 staying at a certain position, resulting pressure reduction of the bellows pump 21 is smaller than the difference between the upper limit value and the lower limit value of the ink supply pressure range where the desired ink ejection characteristics can be obtained. Therefore, even in a state that the valve body 22 has been moved to the pressurization limit position, recording on a recording sheet P having the maximum size for the ink-jet recording apparatus 50 can be performed with the ink supply pressure kept in a range where the desired ink ejection characteristics can be obtained without the need for increasing the air pressure of the bellows pump 21 again during the recording as long as in this state the air pressure of the bellows pump 21 is close to the upper limit of the ink supply pressure range where the desired ink ejection characteristics can be obtained. Therefore, if recording is being performed (step S47: yes) when the valve body 22 has been moved to the pressurization limit position with the air pressure of the bellows pump 21 kept at the prescribed value (i.e., the upper limit of the ink supply pressure range where the desired ink ejection characteristics can be obtained), the recording on the recording sheet P is continued without interruption. Upon completion of the recording, the initial pressurization control process (see FIG. 20) is activated to increase the pressure of the bellows pump 21. With this measure, recording on a recording sheet P or the label of an optical recording disc D can be completed without interruption. During recording, the ink supply pressure can always be kept stable with high accuracy, which can reduce the degree of deterioration of the ink ejection accuracy due to dispersion or variation of the pressure of ink supply to the recording head 62. Further, since recording on a recording sheet P or the label surface of an optical recording disc D can be completed without interruption, the throughput of the recording can be prevented from being reduced by increasing the air pressure of the bellows pump 21 again.

FIG. 15 is a flowchart of a second example of the pressure maintenance control process for the air pressure of the bellows pump unit 20.

This process is activated in the above-described initial pressurization control process (see FIG. 20) and is executed repeatedly in a prescribed cycle after the activation.

First, it is judged at step S61 whether the air pressure of the bellows pump 21 is insufficient. If the air pressure of the bellows pump 21 is not insufficient (step S61: no), the execution of this process is finished in this state. On the other hand, if the air pressure of the bellows pump 21 is insufficient (step S61: yes), it is then judged at step S62 whether the initial pressurization position sensor 26 is in an on-state. If the initial pressurization position sensor 26 is not in an on-state (step S62: no), that is, if it is detected that the valve body 22 has not been moved to the initial pressurization position, the above-described pressure reduction control process (see FIG. 21) is executed at step S63. At step S64, it is judged whether an error has occurred in the pressure reduction control process (step S63). If an error has occurred (step S64: yes), the execution of this process is finished with a judgment result that a fatal error has occurred. On the other hand, if the initial pressurization position sensor 26 is in an on-state (step S62: yes), that is, it is detected that the valve body 22 has been moved to the initial pressurization position, or if no error has occurred in the pressure reduction control process of step S63 (step S64: no), normal rotation driving (i.e., rotational driving in the rotation direction indicated by symbol AF in FIG. 16) of the pressure increase/reduction motor 18 of the bellows pump unit 20 is started at step S65. At step S66, it is judged whether the pressurization limit position sensor 27 is in an on-state. If the pressurization limit position sensor 27 is not in an on-state (step S66: no), that is, if it is detected that the valve 22 has not been moved to the pressurization limit position, it is judged at step S67 whether a sensor error has occurred in the above-described abnormality detection control process (see FIG. 23). If a sensor error has occurred (step S67: yes), the normal rotation driving of the pressure increase/reduction motor 18 is stopped immediately at step S70 and the execution of this process is finished with a judgment result that a fatal error has occurred.

On the other hand, if no sensor error has occurred (step S67: no), it is judged at step S68 whether the air pressure of the bellows pump 21 is insufficient. If the air pressure of the bellows pump 21 is insufficient (step S68: yes), the process returns to step S66 to continue the normal rotation driving of the pressure increase/reduction motor 18. If the air pressure of the bellows pump 21 is not insufficient (step S68: no), the rotational driving of the pressure increase/reduction motor 18 is stopped at step S27 and the execution of this process is finished. If the pressurization limit position sensor 27 is in an on-state (step S66: yes), that is, if it is detected that the valve member 22 has been moved from the initial pressurization position to the pressurization limit position with the air pressure of the bellows pump 21 kept insufficient (i.e., the air pressure of the bellows pump 21 did not become higher than the prescribed value), the normal rotation driving of the pressure increase/reduction motor 18 is stopped immediately at step S70 with a judgment result that pressure leakage has occurred in the bellows pump unit 20 (air pressure leakage) or the ink tubes 171. The execution of this process is finished with a judgment result that a fatal error has occurred.

If the pressure of the bellows pump 21 does not increase though the valve body 22 has been moved in the compression direction from the initial pressurization position to the pressurization limit position, it is highly probable that pressure leakage has occurred in the bellows pump unit 20 (air pressure leakage) or the ink tubes 171, that is, it is probable that ink of an ink cartridge 16 has leaked. If ink leakage has occurred actually, it is necessary to prevent spread of the ink leakage. Therefore, the normal rotation driving of the pressure increase/reduction motor 18 is stopped immediately and the execution of the process is finished with a judgment result that a fatal error has occurred. This measure can prevent spread of the ink leakage. That is, this measure can minimize the amount of leakage of ink when ink leakage has occurred in an ink tube 171. Even if the rotational driving of the pressure increase/reduction motor 18 is stopped immediately when it is judged that pressure leakage has occurred in the bellows pump unit 20 (air pressure leakage) or the ink tubes 171, it is probable that slight ink leakage will occur further until the pressure of the bellows pump 21 decreases to atmospheric pressure. In view of this, when it is judged that pressure leakage has occurred in the bellows pump unit 20 (air pressure leakage) or the ink tubes 171, the rotational driving of the pressure increase/reduction motor 18 may be stopped after performing a pressure reduction control on the bellows pump unit 20. This can prevent even slight ink leakage that may occur after the rotational driving of the pressure increase/reduction motor 18 is stopped, and hence can make the amount of leakage of ink smaller in the event of ink leakage from an ink tube 171. As such, this modification is even preferable.

Figure 26:
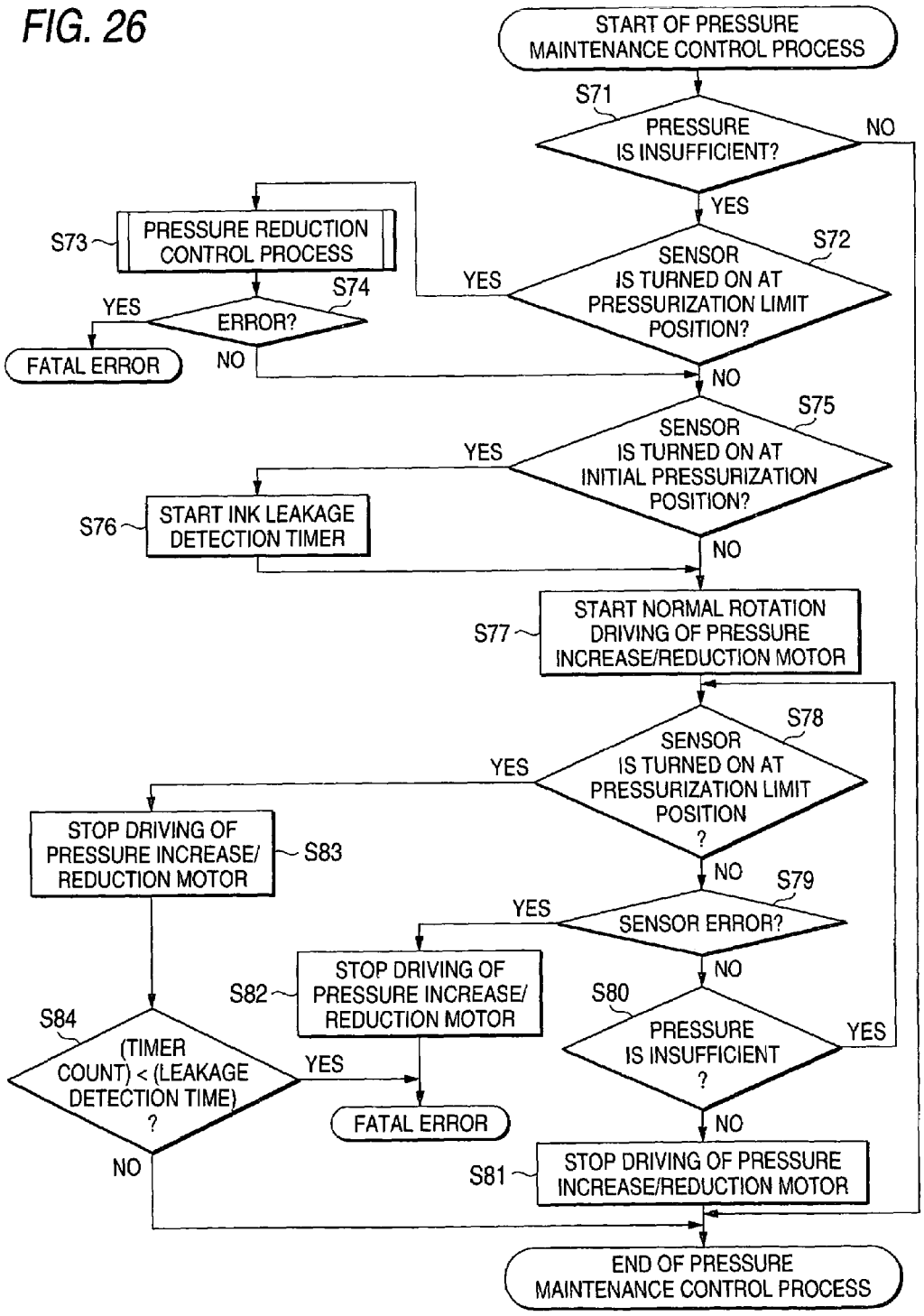
FIG. 26 is a flowchart of a third example of the pressure maintenance control process.

FIG. 26 is a flowchart of a third example of the pressure maintenance control process for the air pressure of the bellows pump unit 20.

This process is activated in the above-described initial pressurization control process (see FIG. 20) and is executed repeatedly in a prescribed cycle after the activation.

First, it is judged at step S71 whether the air pressure of the bellows pump 21 is insufficient. If the air pressure of the bellows pump 21 is not insufficient (step S71: no), the execution of this process is finished in this state. On the other hand, if the air pressure of the bellows pump 21 is insufficient (step S71: yes), it is then judged at step S72 whether the pressurization limit position sensor 27 is in an on-state. If the pressurization limit position sensor 27 is in an on-state (step S72: yes), that is, if it is detected that the valve body 22 has been moved to the pressurization limit position, the above-described pressure reduction control process (see FIG. 21) is executed at step S73. At step S74, it is judged whether an error has occurred in the pressure reduction control process (step S73). If an error has occurred (step S74: yes), the execution of this process is finished with a judgment result that a fatal error has occurred. On the other hand, if the pressurization limit position sensor 27 is not in an on-state (step S72: no), that is, it is detected that the valve body 22 has not been moved to the pressurization limit position, or if no error has occurred in the pressure reduction control process of step S73 (step S74: no), it is judged at step S75 whether the initial pressurization position sensor 26 is in an on-state. If the initial pressurization position sensor 26 is not in an on-state, that is, if it is detected that the valve body 22 has not been moved to the initial pressurization position, normal rotation driving of the pressure increase/reduction motor 18 is started at step S77. On the other hand, if it is detected that the initial pressurization position sensor 26 is in an on-state (step S75: yes), that is, if it is detected that the valve body 22 has been moved to the initial pressurization position, an ink leakage detection timer is started at step S76 and normal rotation driving of the pressure increase/reduction motor 18 is started at step S77.

At step S78, it is judged whether the pressurization limit position sensor 27 is in an on-state. If the pressurization limit position sensor 27 is not in an on-state (step S78: no), it is judged at step S79 whether a sensor error has occurred in the above-described abnormality detection control process (see FIG. 23). If a sensor error has occurred (step S79: yes), the normal rotation driving of the pressure increase/reduction motor 18 is stopped immediately at step S82 and the execution of this process is finished with a judgment result that a fatal error has occurred. On the other hand, if no sensor error has occurred (step S79: no), it is judged at step S80 whether the air pressure of the bellows pump 21 is insufficient. If the air pressure of the bellows pump 21 is insufficient (step S80: yes), the process returns to step S78 to continue the normal rotation driving of the pressure increase/reduction motor 18. If the air pressure of the bellows pump 21 is not insufficient (step S80: no), the rotational driving of the pressure increase/reduction motor 18 is stopped at step S81 and the execution of this process is finished. If the pressurization limit position sensor 27 is in an on-state (step S78: yes), that is, if it is detected that the valve member 22 has been moved from the initial pressurization position to the pressurization limit position with the air pressure of the bellows pump 21 kept insufficient, the rotational driving of the pressure increase/reduction motor 18 is stopped immediately at step S83.

It is judged at step S84 whether the count of the ink leakage detection timer that was started at step S76 is smaller than a count that would be obtained if ink ejection were performed continuously at a maximum ejection amount of the recording head 62 as the valve body 22 is moved from the initial pressurization position to the pressurization limit position. If the count of the ink leakage detection timer is larger than or equal to the count that would be obtained if ink ejection were performed continuously at the maximum ejection amount of the recording head 62 as the valve body 22 is moved from the initial pressurization position to the pressurization limit position (step S84: no), the execution of this process is finished in this state. On the other hand, if the count of the ink leakage detection timer is smaller than the count that would be obtained if ink ejection were performed continuously at the maximum ejection amount of the recording head 62 as the valve body 22 is moved from the initial pressurization position to the pressurization limit position (step S84: yes), the normal rotation driving of the pressure increase/decrease motor 18 is stopped in this state with a judgment result that pressure leakage has occurred in the bellows pump unit 20 (air pressure leakage) or the ink tubes 171. The execution of this process is finished with a judgment result that a fatal error has occurred.

If ink ejection is continued at the maximum ejection amount of the recording head 62, the time that is taken to move the valve body 22 from the initial pressurization position to the pressurization limit position becomes equal to a theoretical shortest time that should be obtained in the case where the air pressure of the bellows pump unit 20 is applied to the ink cartridges 16 normally, that is, with no such leakage as lowers the air pressure of the bellows pump unit 20 or the ink supply pressure. That is, if the count of the ink leakage detection timer is smaller than the count that would be obtained if ink ejection were performed continuously at the maximum ejection amount of the recording head 62 as the valve body 22 is moved from the initial pressurization position to the pressurization limit position (step S84: yes), it means that the air in the bellows pump 21 was pressurized at a higher rate than a rate that would be obtained when ink ejection is performed continuously at the maximum ejection amount of the recording head 62. The fact that the valve 22 has been moved from the initial pressurization position to the pressurization limit position in a shorter time than the theoretical shortest time indicates that it is highly probable that pressure leakage has occurred in the bellows pump unit 20 (air pressure leakage) or the ink tubes 171, that is, it is probable that ink of an ink cartridge 16 has leaked. If ink leakage has occurred actually, it is necessary to prevent spread of the ink leakage. Therefore, the normal rotation driving of the pressure increase/reduction motor 18 is stopped immediately and the execution of the process is finished with a judgment result that a fatal error has occurred. This measure can prevent spread of the ink leakage. That is, this measure can minimize the amount of leakage of ink when ink leakage has occurred in an ink tube 171. Even if the rotational driving of the pressure increase/reduction motor 18 is stopped immediately when it is judged that pressure leakage has occurred in the bellows pump unit 20 (air pressure leakage) or the ink tubes 171, it is probable that slight ink leakage will occur further until the pressure of the bellows pump 21 decreases to atmospheric pressure. In view of this, when it is judged that pressure leakage has occurred in the bellows pump unit 20 (air pressure leakage) or the ink tubes 171, the rotational driving of the pressure increase/reduction motor 18 may be stopped after performing a pressure reduction control on the bellows pump unit 20. This can prevent even slight ink leakage that may occur after the rotational driving of the pressure increase/reduction motor 18 is stopped, and hence can make the amount of leakage of ink smaller in the event of ink leakage from an ink tube 171. As such, this modification is even preferable.

It goes without saying that the invention is not limited to the above embodiments and various modifications are possible without departing from the spirit and scope of the invention that are described in the claims.

The invention can be implemented in a liquid pressure control apparatus for controlling the pressure of liquid supply from a liquid container to a liquid ejection head and can be used in a liquid ejection apparatus having such a liquid pressure control apparatus.

Although the invention has been illustrated and described for the particular preferred embodiments, it is apparent to a person skilled in the art that various changes and modifications can be made on the basis of the teachings of the invention. It is apparent that such changes and modifications are within the spirit, scope, and intention of the invention as defined by the appended claims.

What is claimed is:

1. A method for controlling a liquid ejection apparatus, comprising the steps of:

decreasing a capacity of an air chamber in an airtight state, to generate pressurized air;

increasing the capacity of the air chamber in a state that an inner space of the air chamber communicates with atmosphere;

compressing a liquid container by the pressurized air so that liquid stored in the liquid container is supplied to a liquid ejection head;

detecting the capacity of the air chamber; and halting a liquid ejecting operation of the liquid ejection head when the capacity of the air chamber detected by the detecting step is smaller than or equal to a predetermined value.

2. The method as set forth in claim 1, further comprising the step of moving a target to which liquid ejected from the liquid ejection head is to stick when the capacity of the air chamber detected by the detecting step is smaller than or equal to the predetermined value.

3. The method as set forth in claim 1, wherein the pressurized air is generated when the liquid ejection head ejects liquid onto a recording medium during a printing operation.

4. A liquid ejection apparatus comprising:

a liquid ejection head, which ejects liquid which is supplied from a liquid container storing the liquid therein;

an air chamber, which has a variable capacity;

a capacity changing member, which changes a capacity of the air chamber to apply pressure to the air chamber so that liquid is supplied from the liquid container to the liquid ejection head based on the pressure;

a pressure detector, which detects the pressure in the air chamber; and a controller, which sets a minimum capacity value of the air chamber so that a pressure reduction, caused by performing a continuous liquid ejecting operation to an ejection target member having a maximum size for the liquid ejection apparatus with the capacity of the air chamber fixed, is smaller than a pressure difference between an upper limit value and a lower limit value of a liquid supply pressure range where a predetermined liquid ejection characteristic is obtained, wherein the pressure in the air chamber is increased to the upper limit value before a liquid ejecting operation is performed on an ejection target member; and wherein the liquid ejecting operation is performed in a state that the capacity of the air chamber is fixed.

5. The liquid ejection apparatus as set forth in claim 4, wherein the air chamber has a communication portion through which an inner space of the air chamber communicates with atmosphere;

wherein the capacity changing member is a valve member which is moved in a third direction in which the capacity of the air chamber decreases and in a fourth direction in which the capacity of the air chamber increases;

wherein the valve member is moved in the third direction while being pressed against the communication portion, thereby closing the communication portion and increasing the pressure in the air chamber; and wherein the valve member is moved in the fourth direction while being separated from the communication portion, thereby causing the communication portion to communicate with the atmosphere and reducing the pressure in the air chamber to atmospheric pressure.

6. The liquid ejection apparatus as set forth in claim 5, further comprising:

a first position detector, which detects whether the valve member is moved to a first limit position corresponding to the minimum capacity value; and a second position detector, which detects whether the valve member is moved to a second limit position past which the valve member is prohibited to move in the fourth direction, wherein when the valve member is moved to the first limit position before the pressure in the air chamber reaches a prescribed value, the valve member is moved to the first limit position to increase the pressure in the air chamber to the upper limit value.

7. The liquid ejection apparatus as set forth in claim 4, wherein when liquid ejecting operations are performed continuously on a plurality of ejection target members, the pressure in the air chamber is increased to the upper limit value in an interval between one liquid ejecting operation of the liquid ejecting operations and a next liquid ejecting operation.

8. A method for controlling liquid pressure of a liquid ejection apparatus, comprising the steps of:

changing a capacity of an air chamber to apply pressure therein;

compressing a liquid container storing liquid by the pressure in the air chamber;

supplying liquid to a liquid ejection head by liquid supply pressure based on the pressure;

detecting the pressure in the air chamber;

setting a minimum capacity value of the air chamber so that a pressure reduction, caused by performing a continuous liquid ejecting operation on an ejection target member having a maximum size for the liquid ejection apparatus with the capacity of the air chamber fixed, is smaller than a pressure difference between an upper limit value and a lower limit value of a liquid supply pressure range where a predetermined liquid ejection characteristic is obtained;

increasing the pressure in the air chamber to the upper limit value before a liquid ejecting operation is performed to an ejection target member; and performing the liquid ejecting operation in a state that the capacity of the air chamber is fixed.

9. The method as set forth in claim 8, further comprising the step of increasing the pressure in the air chamber to the upper limit value in an interval between one liquid ejecting operation of liquid ejecting operations and the next liquid ejecting operation when the liquid ejecting operations are performed continuously to a plurality of ejection target members.

10. The liquid ejection apparatus as set forth in claim 8, wherein the capacity changing step includes the substeps of:

moving the valve member to press the air chamber in a fifth direction in which the capacity of the air chamber is reduced; and moving the valve member in a sixth direction in which the capacity of the air chamber is increased, the method further comprising the steps of:

first detecting whether the valve member is moved to a first limit position corresponding to the minimum capacity value;

second detecting whether the valve member is moved to a second limit position past which the valve member is prohibited to move in the sixth direction; and moving the valve member to the first limit position to increase the pressure in the air chamber to the upper limit value when the valve member is moved to the first limit position before the pressure in the air chamber reaches a predetermined value.

11. A liquid ejection apparatus comprising:

a liquid ejection head for ejecting liquid which is supplied from a liquid cartridge storing the liquid therein; and a pressure pump for generating pressurized air to be supplied to the liquid cartridge to apply pressure on the liquid in the liquid cartridge so as to supply liquid from the liquid cartridge to the liquid ejection head, the pressure pump including:

an air chamber which communicates with the liquid cartridge, has a variable capacity, and has a communication portion through which an inner space and an outer space of the air chamber communicate with each other; and a pressing member which is moved in a first direction in which a capacity of the air chamber decreases while being pressed against the communication portion of the air chamber, thereby closing the communication portion and generating the pressurized air, wherein the pressing member includes:

a motor;

an abutment portion, which closes the communication portion when the pressing member is pressed against the air chamber and which opens the communication portion when the pressing member is separated from the air chamber; and a conversion member, which converts a rotational movement of the motor into a reciprocation movement of the abutment portion in the first direction and a second direction opposite to the first direction, wherein the conversion member comprises at least one a lead screw.

12. A liquid ejection apparatus comprising:

a liquid ejection head for ejecting liquid which is supplied from a liquid cartridge storing the liquid therein; and a pressure pump for generating pressurized air to be supplied to the liquid cartridge to apply pressure on the liquid in the liquid cartridge so as to supply liquid from the liquid cartridge to the liquid ejection head, the pressure pump including:

an air chamber which communicates with the liquid cartridge, has a variable capacity, and has a communication portion through which an inner space and an outer space of the air chamber communicate with each other; and a pressing member which is moved in a first direction in which a capacity of the air chamber decreases while being pressed against the communication portion of the air chamber, thereby closing the communication portion and generating the pressurized air, wherein the pressing member includes:

a motor;

an abutment portion, which closes the communication portion when the pressing member is pressed against the air chamber and which opens the communication portion when the pressing member is separated from the air chamber; and a conversion member, which converts a rotational movement of the motor into a reciprocation movement of the abutment portion in the first direction and a second direction opposite to the first direction; and a capacity detector, which detects the capacity of the air chamber; and a controller, which controls a movement of the abutment portion on the basis of the capacity detected by the capacity detector.

13. The liquid ejection apparatus as set forth in claim 12, wherein the capacity detector is a sensor for detecting a position of the abutment portion.

* * * * *